US008984865B2

(12) United States Patent
Tanaka et al.

(10) Patent No.: US 8,984,865 B2
(45) Date of Patent: Mar. 24, 2015

(54) EXHAUST GAS PURIFICATION DEVICE FOR INTERNAL COMBUSTION ENGINE

(75) Inventors: Hiroshi Tanaka, Susono (JP); Yusuke Saito, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 14/239,956

(22) PCT Filed: Aug. 30, 2011

(86) PCT No.: PCT/JP2011/069589

§ 371 (c)(1),
(2), (4) Date: Feb. 20, 2014

(87) PCT Pub. No.: WO2013/030949

PCT Pub. Date: Mar. 7, 2013

(65) Prior Publication Data

US 2014/0202138 A1 Jul. 24, 2014

(51) Int. Cl.
*F01N 3/00* (2006.01)
*F01N 3/18* (2006.01)
(Continued)

(52) U.S. Cl.
CPC ..... *F01N 3/18* (2013.01); *F02D 41/123* (2013.01); *F02D 41/1475* (2013.01); *F01N 2550/02* (2013.01); *F02D 41/0235* (2013.01); *F02D 41/126* (2013.01); *F02D 2200/0802* (2013.01)
USPC ..... 60/286; 60/295; 60/299; 502/327

(58) Field of Classification Search
CPC ..... F02D 41/123; F02D 41/1475; F02D 41/0235; F02D 41/126; F02D 2200/0802; F01N 3/18; F01N 2550/02
See application file for complete search history.

(56) References Cited

U.S. PATENT DOCUMENTS 5,958,827 A * 9/1999 Suda et al. ..... 502/304
7,446,070 B2 * 11/2008 Hori et al. ..... 502/60
(Continued)

FOREIGN PATENT DOCUMENTS

JP 2005-066559 A 3/2005
JP 2006-183624 A 7/2006
(Continued)

*Primary Examiner* — Jesse Bogue
(74) *Attorney, Agent, or Firm* — Gifford, Krass, Sprinkle, Anderson & Citkowski, P.C.

(57) ABSTRACT

The invention relates to an exhaust control device of an engine (10) comprising a catalyst (45) in an exhaust passage (40). In this invention, the active element transforms as a solid solution in the carrier when a catalyst temperature is higher than or equal to a predetermined solid solution temperature and an atmosphere in the catalyst is an oxidation atmosphere and the active element precipitates from the carrier when the catalyst temperature is higher than or equal to a predetermined precipitation temperature and the atmosphere in the catalyst is a reduction atmosphere. According to this invention, an air-fuel ratio of an exhaust gas flowing into the catalyst is controlled to an air-fuel ratio leaner than the stoichiometric air-fuel ratio when the active element solid solution degree is smaller than a target solid solution or a lower limit of a target solid solution degree range and the catalyst temperature is higher than or equal to the predetermined solid solution temperature, and the air-fuel ratio of the exhaust gas flowing into the catalyst is controlled to an air-fuel ratio richer than the stoichiometric air-fuel ratio when the active element solid solution degree is larger than the target solid solution degree or an upper limit of the target solid solution degree range and the catalyst temperature is higher than or equal to the predetermined precipitation temperature.

17 Claims, 20 Drawing Sheets

(51) Int. Cl.

| | |
|---|---|
| ***F02D 41/12*** | (2006.01) |
| ***F02D 41/14*** | (2006.01) |
| *F02D 41/02* | (2006.01) |

(56) References Cited

U.S. PATENT DOCUMENTS

| | | | | |
|---|---|---|---|---|
| 2005/0049143 | A1 | 3/2005 | Eguchi et al. | |
| 2007/0021294 | A1* | 1/2007 | Hori et al. | 502/60 |
| 2007/0297971 | A1* | 12/2007 | Matsueda et al. | 423/594.12 |
| 2009/0131251 | A1 | 5/2009 | Matsueda et al. | |
| 2010/0093526 | A1 | 4/2010 | Tanaka et al. | |

FOREIGN PATENT DOCUMENTS

| | | | |
|---|---|---|---|
| JP | 2008-012480 | A | 1/2008 |
| WO | 2008096575 | A1 | 8/2008 |

* cited by examiner (A)

(B)

EXHAUST GAS PURIFICATION DEVICE FOR INTERNAL COMBUSTION ENGINE

TECHNICAL FIELD

The invention relates to an exhaust gas purification device of an internal combustion engine.

BACKGROUND ART

A catalyst for purifying components in an exhaust gas discharged from a combustion chamber of an internal combustion engine is described in the patent literature 1.

This catalyst has an element for activating an oxidation reaction or a reduction reaction of the component in the exhaust gas (hereinafter, this element may be referred to as—active element—) and a carrier for carrying the active element, which carrier being comprised of a composite oxide.

Further, this catalyst has a property in which the active element transforms into the carrier as a solid solution when an atmosphere in the catalyst is an oxidation atmosphere and the active element precipitates from the carrier when the atmosphere in the catalyst is a reduction atmosphere.

CITATION LIST

Patent Literature

[PATENT LITERATURE 1] International Publication No. 2008/096575

[PATENT LITERATURE 2] Unexamined JP Patent Publication No. 2006-183624

[PATENT LITERATURE 3] Unexamined JP Patent Publication No. 2008-12480

[PATENT LITERATURE 4] Unexamined JP Patent Publication No. 2005-66559

SUMMARY OF INVENTION

Problem to be Solved

In general, an ability of the catalyst for purifying the component in the exhaust gas (hereinafter, this ability may be referred to as—purification ability—) changes depending on a time and a degree of the usage of the catalyst.

Therefore, in the case that a control of the engine is performed, in order to demonstrate a desired property of the engine, it is necessary to perform the control of the engine or structure a control logic used for the control of the engine in consideration of the change of the purification ability of the catalyst.

In this regard, it is cumbersome to perform the control of the engine as explained above or structure such a control logic.

The object of the invention is to provide an exhaust gas purification device of an internal combustion engine in which a control of the engine can be performed relatively easily or a control logic used for the control of the engine can be structured relatively easily, independently of a time or a degree of a usage of a catalyst.

Means for Solving the Problem

The invention of this application for accomplishing the aforementioned object relates to an exhaust gas purification device of an internal combustion engine, comprising in an exhaust passage, a catalyst for purifying a component in an exhaust gas and having an active element for activating an oxidation reaction or a reduction reaction of the component in the exhaust gas and a carrier for carring the active element, in which catalyst, the active element transforming as a solid solution in the carrier when a temperature of the catalyst is higher than or equal to a predetermined solid solution temperature which is a predetermined temperature and an atmosphere in the catalyst is an oxidation atmosphere and the active element precipitating from the carrier when the temperature of the catalyst is higher than or equal to a predetermined precipitation temperature which is a predetermined temperature and the atmosphere in the catalyst is a reduction atmosphere.

In this invention, an air-fuel ratio of an exhaust gas flowing into the catalyst is controlled to an air-fuel ratio leaner than the stoichiometric air-fuel ratio when an active element solid solution degree, which indicates a proportion of the active element having transformed as a solid solution in the carrier relative to the total active element is smaller than a target solid solution which is a target active element solid solution degree or smaller than a lower limit of a target solid solution degree range which is a range of the target active element solid solution degree and the temperature of the catalyst is higher than or equal to the predetermined solid solution temperature during the operation of the engine.

On the other hand, in this invention, the air-fuel ratio of the exhaust gas flowing into the catalyst is controlled to an air-fuel ratio richer than the stoichiometric air-fuel ratio when the active element solid solution degree is larger than the target solid solution degree or larger than an upper limit of the target solid solution degree range and the temperature of the catalyst is higher than or equal to the predetermined precipitation temperature.

According to this invention, the following effect can be obtained. That is, during the engine operation (i.e. during the operation of the engine), the catalyst temperature (i.e. the temperature of the catalyst) may become higher than or equal to the predetermined solid solution temperature or the predetermined precipitation temperature and the catalyst inflow exhaust air-fuel ratio (i.e. the air-fuel ratio of the exhaust gas flowing into the catalyst) may become leaner or richer than the stoichiometric air-fuel ratio and as a result, the atmosphere in the catalyst may become the oxidation atmosphere or the reduction atmosphere.

Therefore, in the case that the catalyst has a property in which the active element transforms as a solid solution in the carrier when the catalyst temperature is higher than or equal to the predetermined solid solution temperature and the atmosphere in the catalyst is the oxidation atmosphere and the active element precipitates from the carrier when the catalyst temperature is higher than or equal to the predetermined precipitation temperature and the atmosphere in the catalyst is the reduction atmosphere, there is a possibility that the transformation of the active element as a solid solution in the carrier and the precipitation of the active element from the carrier occur repeatedly in the catalyst during the engine operation.

That is, the amount of the precipitated active element (i.e. the active element having precipitated from the carrier) changes due to the change of the catalyst temperature and the catalyst inflow exhaust air-fuel ratio during the engine operation and therefore, the purification ability of the catalyst (i.e. the ability of the catalyst to purify the component in the exhaust gas) changes.

Further, when the active element usage degree (i.e. the degree of the usage of the active element in the activation of the component in the exhaust gas) increases, the active element may deteriorate and as a result, the activation ability of the active element (i.e. the ability of the active element to increase the oxidation reaction activation or the reduction reaction activation of the component in the exhaust gas) may decrease.

In other words, when the catalyst usage degree (i.e. the degree of the usage of the catalyst in the purification of the component in the exhaust gas) increases, the purification ability of the catalyst may decrease. That is, the purification ability of the catalyst changes due to the change of the activation ability of the active element during the engine operation.

Therefore, in order to demonstrate the desired property of the engine, it is necessary to structure the control logic used for the engine control (i.e. the control of the engine) and perform the engine control so as to demonstrate the desired property of the engine in consideration of the change of the purification ability of the catalyst during the engine operation.

In this regard, the change of the purification ability of the catalyst during the engine operation varies depending on the manner of the engine operation and the catalyst usage degree and therefore, the structuring of the control logic and the performance of the engine control as described above are cumbersome.

On the other hand, if the change of the purification ability of the catalyst is within the assumed range, independently of the manner of the engine operation and the catalyst usage degree, the control logic can be structured relatively easily and the engine control can be performed relatively easily.

According to this invention, when the active element solid solution degree is smaller than the target solid solution degree or smaller than the lower limit of the target solid solution degree range and the catalyst temperature is higher than or equal to the predetermined solid solution temperature, the catalyst inflow exhaust air-fuel ratio is controlled to an air-fuel ratio leaner than the stoichiometric air-fuel ratio.

Thereby, when the catalyst temperature is higher than or equal to the predetermined solid solution temperature, the atmosphere in the catalyst becomes the oxidation atmosphere and therefore, the precipitated active element transforms as a solid solution in the carrier and as a result, the active element solid solution degree increases.

On the other hand, according to this invention, when the active element solid solution degree is larger than the target solid solution degree or larger than the upper limit of the target solid solution degree range and the catalyst temperature is higher than or equal to the predetermined precipitation temperature, the catalyst inflow exhaust air-fuel ratio is controlled to an air-fuel ratio richer than the stoichiometric air-fuel ratio.

Thereby, when the catalyst temperature is higher than or equal to the predetermined precipitation temperature, the atmosphere in the catalyst becomes the reduction atmosphere and therefore, the solid solution active element precipitates from the carrier and as a result, the active element solid solution degree decreases. Thus, the active element solid solution degree is controlled to the target solid solution degree or within the target solid solution degree range. Thereby, the amount of the precipitated active element is maintained constant and therefore, the purification ability of the catalyst during the engine operation can be assumed easily. Thus, according to this invention, the effect that the control logic used for the engine control can be structured relatively easily and the engine control can be performed relatively easily, can be obtained.

In this invention, any method can be employed as the method for acquiring the temperature of the catalyst as far as the temperature of the catalyst can be acquired according to the method and for example, as this method, a method for acquiring as the temperature of the catalyst in this invention, the catalyst temperature detected by a sensor provided in the catalyst for detecting the temperature of the catalyst or a method for acquiring as the temperature of the catalyst in this invention, the catalyst temperature calculated on the basis of various parameters relating to the engine (e.g. the engine speed, the engine load, the amount of the fuel supplied to a combustion chamber of the engine, the amount of the air supplied to the combustion chamber, etc.) may be employed.

Further, in this invention, the predetermined solid solution temperature and the predetermined precipitation temperature may be equal to each other or may be different from each other.

Further, in this invention, the target solid solution degree may be constant, independently of conditions or may be changed, depending on conditions. For example, according to the another invention of this application, in the aforementioned invention, as the degree of the usage of the catalyst in the purification of the component in the exhaust gas increases, the target solid solution degree is set as a smaller value or the upper and lower limits of the target solid solution degree range are set as smaller values.

According to this invention, the following effect can be obtained. That is, as explained above, the activation ability of the active element decreases due to the deterioration thereof as the active element usage degree, that is, the catalyst usage degree increases. Thus, in the case that the active element solid solution degree does not change and therefore, the amount of the precipitated active element does not change, the purification ability of the catalyst decreases as the catalyst usage degree increases.

On the other hand, in this invention, as the catalyst usage degree increases, the target solid solution degree is set to a lower value (or the upper and lower limits of the target solid solution degree range are set to lower values) and as a result, the amount of the precipitated active element increases. Therefore, even if the activation ability of the already precipitated active element decreases due to the increase of the catalyst usage degree, the active element newly precipitates from the carrier and therefore, the purification ability of the catalyst is maintained at the original ability or at least is maintained at the ability near the original ability.

Therefore, according to this invention, the effect that independently of the catalyst usage degree, the purification ability of the catalyst can be maintained at the original ability or can be at least maintained at the ability near the original ability and the purification ability of the catalyst during the engine operation can be easily assumed, can be obtained.

In this invention, the degree of the decrease of the target solid solution degree (or the degree of the decrease of the upper and lower limits of the target solid solution degree range) may be suitably determined, depending on the required purification ability of the catalyst and therefore, the target solid solution degree (or the upper and lower limits of the target solid solution degree range) may be decreased such that the purification ability of the catalyst corresponds to the original purification ability and the target solid solution degree (or the upper and lower limits of the target solid solution degree range) may be decreased such that the purification ability of the catalyst increases as the catalyst usage degree increases.

Further, in this invention, any method may be employed as the method for acquiring the catalyst usage degree as far as the degree of the usage of the catalyst in the purification of the exhaust component can be acquired according to the method and for example, as this method, a method for acquiring as the catalyst usage degree of this invention, the catalyst usage degree detected by a sensor provided in the catalyst for detecting the catalyst usage degree or a method for acquiring as the catalyst usage degree of this invention, the catalyst usage degree calculated on the basis of the parameter influencing the catalyst usage degree (e.g. the catalyst usage time (in other words, the time of the usage of the active element precipitating from the carrier in the purification of the exhaust component), the amount of the exhaust gas flowing into the catalyst, the running distance of a vehicle in the case that the engine is installed on the vehicle, etc.) may be employed.

Further, in the aforementioned invention, the active element solid solution degree may be the active element solid solution degree obtained according to any method and for example, may be the active element solid solution degree detected by a sensor for detecting the active element solid solution degree or may be the active element solid solution degree calculated on the basis of various parameters relating to the engine.

For example, according to the further another invention of this application, the active element solid solution degree is calculated on the basis of various parameters relating to the engine as follows.

That is, according to this invention, in the aforementioned invention, the active element solid solution degree is calculated on the basis of the temperature of the catalyst and the air-fuel ratio of the exhaust gas flowing into the catalyst when the temperature of the catalyst is higher than or equal to the predetermined solid solution temperature and the air-fuel ratio of the exhaust gas flowing into the catalyst is leaner than the stoichiometric air-fuel ratio during the operation of the engine and the temperature of the catalyst and the air-fuel ratio of the exhaust gas flowing into the catalyst when the temperature of the catalyst is higher than or equal to the predetermined precipitation temperature and the air-fuel ratio of the exhaust gas flowing into the catalyst is richer than the stoichiometric air-fuel ratio during the operation of the engine.

In this case, when the catalyst temperature is higher than or equal to the predetermined solid solution temperature and the catalyst inflow exhaust air-fuel ratio is leaner than the stoichiometric air-fuel ratio, the calculated active element solid solution degree tends to increase as the catalyst temperature increase and as the catalyst inflow exhaust air-fuel ratio increases. On the other hand, when the catalyst temperature is higher than or equal to the predetermined precipitation temperature and the catalyst inflow exhaust air-fuel ratio is richer than the stoichiometric air-fuel ratio, the calculated active element solid solution degree decreases as the catalyst temperature increases and as the catalyst inflow exhaust air-fuel ratio decreases.

According to this invention, the following effect can be obtained. That is, when the catalyst temperature is higher than or equal to the predetermined solid solution temperature and the catalyst inflow exhaust air-fuel ratio is leaner than the stoichiometric air-fuel ratio (hereinafter, this may be referred to as—at the high temperature lean condition—), the active element transforms as a solid solution in the carrier.

At this time, the amount of the active element transforming as a solid solution in the carrier per unit time increases as the catalyst temperature increases and the lean degree of the catalyst inflow exhaust air-fuel ratio increases. That is, the amount of the active element transforming as a solid solution in the carrier per unit time depends on the catalyst temperature and the catalyst inflow exhaust air-fuel ratio. In this regard, according to this invention, at the high temperature lean condition, the active element solid solution degree is calculated on the basis of the catalyst temperature and the catalyst inflow exhaust air-fuel ratio.

Therefore, according to this invention, the effect that the active element solid solution degree can be accurately calculated at the high temperature lean condition can be obtained.

On the other hand, when the catalyst temperature is higher than or equal to the predetermined precipitation temperature and the catalyst inflow exhaust air-fuel ratio is richer than the stoichiometric air-fuel ratio (hereinafter, this may be referred to as—at the high temperature rich condition—), the active element precipitates from the carrier.

At this time, the amount of the active element precipitating from the carrier per unit time increases as the catalyst temperature increases and the rich degree of the catalyst inflow exhaust air-fuel ratio increases. That is, the amount of the active element precipitating from the carrier per unit time depends on the catalyst temperature and the catalyst inflow exhaust air-fuel ratio. In this regard, according to this invention, at the high temperature rich condition, the active element solid solution degree is calculated on the basis of the catalyst temperature and the catalyst inflow exhaust air-fuel ratio.

Therefore, according to this invention, the effect that the active element solid solution degree can be accurately calculated at the high temperature rich condition can be obtained.

Otherwise, according to the further another invention of this application, the active element solid solution degree is calculated on the basis of various parameters relating to the engine as follows. That is, according to this invention, in the aforementioned invention, the active element solid solution degree is calculated on the basis of the temperature of the catalyst during the operation of the engine. In this case, as the catalyst temperature increases, the calculated active element solid solution degree tends to increase.

According to this invention, the following effect can be obtained. That is, as the amount of the precipitated active element increases, the degree of the activation of the exhaust component (i.e. the component in the exhaust gas) by the active element increases and therefore, the degree of the purification of the exhaust component by the catalyst increases. On the other hand, a heat is produced due to the purification of the exhaust component by the catalyst.

Therefore, as the amount of the precipitated active element increases, the amount of the heat produced due to the purification of the exhaust component by the catalyst increases and therefore, the catalyst temperature increases. That is, the amount of the active element precipitating from the carrier can be estimated on the basis of the catalyst temperature and therefore, the amount of the solid solution active element, that is, the active element solid solution degree can be estimated.

In this regard, in this invention, the active element solid solution degree is calculated on the basis of the catalyst temperature during the engine operation. That is, the active element solid solution degree is calculated using the catalyst temperature which is a parameter changing depending on the active element solid solution degree.

Therefore, according to this invention, the effect that the active element solid solution degree can be calculated accurately, can be obtained.

Otherwise, according to the further another invention of this application, the active element solid solution degree is calculated on the basis of various parameters relating to the engine as follows. That is, according to this invention, in the aforementioned invention, air-fuel ratio output means for outputting an output value corresponding to the air-fuel ratio of the exhaust gas is arranged in the exhaust passage downstream of the catalyst and the active element solid solution degree is calculated on the basis of an output value trace length during the engine operation, which length being a length of the trace of the output value of the air-fuel ratio output means in a predetermined time during the operation of the engine. In this case, as the output value trace length during the engine operation increases, the calculated active element solid solution degree tends to increase.

According to this invention, the following effect can be obtained. That is, by a study of the inventors of this application, it has been realized that as the amount of the precipitated active element decreases, that is, as the active element solid solution degree increases, the output value trace length increases.

In this regard, in this invention, the active element solid solution degree is calculated on the basis of the output value trace length during the engine operation. That is, the active element solid solution degree is calculated using the output value trace length which is a parameter changing depending on the active element solid solution degree.

Therefore, according to this invention, the effect that the active element solid solution degree can be calculated accurately, can be obtained. In addition, according to this invention, the effect that the active element solid solution degree can be calculated without using the catalyst temperature, can be obtained.

Otherwise, according to the further another invention of this application, the active element solid solution degree is calculated on the basis of various parameters relating to the engine as follows. That is, according to this invention, in the aforementioned invention, air-fuel ratio output means for outputting an output value corresponding to the air-fuel ratio of the exhaust gas is arranged in the exhaust passage downstream of the catalyst and the active element solid solution degree is calculated on the basis of a positive direction inversion number during the engine operation, which number being the number of the inversion of the change rate of the output value of the air-fuel ratio output means from the negative value to the positive value in a predetermined time during the operation of the engine, or a negative direction inversion number during the engine operation, which number being the number of the inversion of the change rate of the output value of the air-fuel ratio output means from the positive value to the negative value in a predetermined time during the operation of the engine, or a total inversion number during the engine operation, which number being the number of the sum of the positive and negative direction inversion numbers during the engine operation.

In this regard, in the case that the active element solid solution degree is calculated on the basis of the positive direction inversion number during the engine operation, the calculated active element solid solution degree tends to increase as the positive direction inversion number during the engine operation increases, in the case that the active element solid solution degree is calculated on the basis of the negative direction inversion number during the engine operation, the calculated active element solid solution degree tends to increase as the negative direction inversion number during the engine operation increases, and in the case that the active element solid solution degree is calculated on the basis of the total inversion number during the engine operation, the calculated active element solid solution degree tends to increase as the total inversion number during the engine operation increases.

According to this invention, the following effect can be obtained. That is, by the study of the inventors of this application, it has been realized that as the amount of the active element precipitating from the carrier decreases, that is, as the active element solid solution degree increases, the positive, negative and total inversion number increase.

In this regard, in this invention, the active element solid solution degree is calculated on the basis of the inversion number during the engine operation (i.e. the positive or negative or total inversion number during the engine operation). That is, the active element solid solution degree is calculated using the inversion number during the engine operation which is a parameter changing depending on the active element solid solution degree.

Therefore, according to this invention, the effect that the active element solid solution degree can be calculated accurately, can be obtained. In addition, according to this invention, the effect that the active element solid solution degree can be calculated accurately without using the catalyst temperature, can be obtained.

Further, according to the further another invention, in the aforementioned invention, during an engine start time period which is a time period until a predetermined time has elapsed from the time of the start of the operation of the engine after the stop of the operation of the engine, the active element solid solution degree is calculated on the basis of the temperature of the catalyst.

On the other hand, according to this invention, during a normal operation time period which is a time period from when the engine start time period has elapsed to when the operation of the engine is stopped, the active element solid solution degree is calculated on the basis of the temperature of the catalyst and the air-fuel ratio of the exhaust gas flowing into the catalyst when the temperature of the catalyst is higher than or equal to the predetermined solid solution temperature and the air-fuel ratio of the exhaust gas flowing into the catalyst is leaner than the stoichiometric air-fuel ratio and the temperature of the catalyst and the air-fuel ratio of the exhaust gas flowing into the catalyst when the temperature of the catalyst is higher than or equal to the predetermined precipitation temperature and the air-fuel ratio of the exhaust gas flowing into the catalyst is richer than the stoichiometric air-fuel ratio or the active element solid solution degree is calculated on the basis of an output value trace length during the engine operation, which length being the length of the trace of the output value of the air-fuel ratio output means in the predetermined time period during the operation of the engine in the case that the air-fuel ratio output means for outputting the output value corresponding to the air-fuel ratio of the exhaust gas is arranged in the exhaust passage downstream of the catalyst, or the active element solid solution degree is calculated on the basis of one of the positive direction inversion number during the engine operation, which number being the number of the inversion of the change rate of the output value of the air-fuel ratio output means in a predetermined time period during the operation of the engine from the negative value to the positive value, the negative direction inversion number during the engine operation, which number being the number of the inversion of the change rate of the output value of the air-fuel ratio output means in a predetermined time period during the operation of the engine from the positive value to the negative value, and the total inversion number during the engine operation, which number being the number of the sum of the positive and negative direction inversion numbers during the engine operation in the case that the air-fuel ratio output means for outputting the output value corresponding to the air-fuel ratio of the exhaust gas is arranged in the exhaust passage downstream of the catalyst.

Further, in this invention, when the last active element solid solution degree acquired during the engine start time period is larger than or equal to the last active element solid solution degree acquired during the normal operation time period immediately before the engine start time period, the last active element solid solution degree acquired during the engine start time period is employed as the active element solid solution degree at the engine start time period having elapsed.

On the other hand, when the last active element solid solution degree acquired during the engine start time period is smaller than the last active element solid solution degree acquired during the normal operation time period immediately before the engine start time period, the last active element solid solution degree acquired during the normal operation time period immediately before the engine start time period is employed as the active element solid solution degree at the time when the engine start time period having elapsed.

According to this invention, the following effect can be obtained. That is, the change of the catalyst temperature due to the change of the active element solid solution degree is large when the catalyst temperature increases, compared with when the catalyst temperature is constant or generally constant. Therefore, in order to acquire the active element solid solution degree accurately, it is advantageous that the active element solid solution degree is acquired on the basis of the catalyst temperature during the engine start time period in which the catalyst temperature increases.

Further, in the case that the active element solid solution degree is acquired on the basis of the catalyst temperature and the catalyst inflow exhaust air-fuel ratio when the catalyst temperature is higher than or equal to the predetermined solid solution temperature and the catalyst inflow exhaust air-fuel ratio is leaner than the stoichiometric air-fuel ratio and the catalyst temperature and the catalyst inflow exhaust air-fuel ratio when the catalyst temperature is higher than or equal to the predetermined precipitation temperature and the catalyst inflow exhaust air-fuel ratio is richer than the stoichiometric air-fuel ratio, in order to acquire the active element solid solution degree, the catalyst temperature must be at least higher than or equal to the predetermined solid solution temperature or the predetermined precipitation temperature.

Therefore, in order to acquire the active element solid solution degree accurately, it is advantageous that the active element solid solution degree is acquired on the basis of the catalyst temperature and the catalyst inflow exhaust air-fuel ratio when the catalyst temperature is higher than or equal to the predetermined solid solution temperature and the catalyst inflow exhaust air-fuel ratio is leaner than the stoichiometric air-fuel ratio and the catalyst temperature and the catalyst inflow exhaust air-fuel ratio when the catalyst temperature is higher than or equal to the predetermined precipitation temperature and the catalyst inflow exhaust air-fuel ratio is richer than the stoichiometric air-fuel ratio during the normal operation time period in which there is a high possibility that the catalyst temperature becomes higher than or equal to the predetermined solid solution temperature or the predetermined precipitation temperature.

Further, the output value trace length and the inversion number during the engine operation are acquired on the basis of the output value of the air-fuel ratio output means corresponding to the catalyst outflow exhaust air-fuel ratio. Thus, when the catalyst temperature is higher than or equal to the activation temperature of the catalyst and therefore, the purification ability of the catalyst is demonstrated sufficiently, the change corresponding to the change of the active element solid solution degree occurs in the output value trace length and the inversion number during the engine operation.

Therefore, in order to acquire the active element solid solution degree accurately, it is advantageous that the active element solid solution degree is acquired on the basis of the output value trace length or the inversion number during the engine operation during the normal operation time period in which there is a high possibility that the catalyst temperature becomes higher than or equal to the activation temperature of the catalyst.

According to this invention, basically, during the engine start time period, the active element solid solution degree is acquired on the basis of the catalyst temperature and during the normal operation time period, the active element solid solution degree is acquired on the basis of the catalyst temperature and the catalyst inflow exhaust air-fuel ratio when the catalyst temperature is higher than or equal to the predetermined solid solution temperature and the catalyst inflow exhaust air-fuel ratio is leaner than the stoichiometric air-fuel ratio and the catalyst temperature and the catalyst inflow exhaust air-fuel ratio when the catalyst temperature is higher than or equal to the predetermined precipitation temperature and the catalyst inflow exhaust air-fuel ratio is richer than the stoichiometric air-fuel ratio, or on the basis of the output value trace length during the engine operation, or on the basis of the inversion number during the engine operation.

Therefore, according to this invention, the effect that the active element solid solution degree can be acquired accurately during the engine start time period and during the normal operation time period, can be obtained.

In addition, according to this invention, the following effect can be obtained. That is, in the case that the active element solid solution degrees acquired according to two different method are different from each other, it is preferred that the larger active element solid solution degree is employed as the active element solid solution degree used for the control, etc. of the engine. This is because if the smaller active element solid solution degree is employed as the active element solid solution degree used for the control, etc. of the engine, even when the amount of the actual precipitated active element is small, the control, etc. of the engine may be performed assuming that the amount of the precipitated active element is large and therefore, the purification ability of the catalyst is high and in this case, the exhaust emission property relating to the exhaust gas flowing out of the catalyst may decrease.

In this regard, according to this invention, if the last active element solid solution degree acquired during the engine start time period is larger than or equal to the last active element solid solution degree acquired during the normal operation time period immediately before the engine start time period, the last active element solid solution degree acquired during the engine start time period is directly employed as the conclusive active element solid solution degree during the engine start time period and on the other hand, if the last active element solid solution degree acquired during the engine start time period is smaller than the last active element solid solution degree acquired during the normal operation time period immediately before the engine start time period, the last active element solid solution degree acquired during the normal operation time period is employed as the conclusive active element solid solution degree during the engine start time period. That is, the larger active element solid solution degree is employed as the conclusive active element solid solution degree during the engine start time period. Therefore, according to this invention, the effect that the high exhaust emission property can be ensured immediately after the engine start time period, can be obtained.

In the aforementioned invention, various methods may be employed as a concrete calculation method of the active element solid solution degree on the basis of the catalyst temperature and the air-fuel ratio of the exhaust gas flowing into the catalyst. For example, according to the further another invention of this application, in the aforementioned invention, a parameter is prepared, the parameter being increased gradually while the temperature of the catalyst is higher than or equal to the predetermined solid solution temperature and the air-fuel ratio of the exhaust gas flowing into the catalyst is leaner than the stoichiometric air-fuel ratio during the operation of the engine and on the other hand, the parameter being decreased gradually while the temperature of the catalyst is higher than or equal to the predetermined precipitation temperature and the air-fuel ratio of the exhaust gas flowing into the catalyst is richer than the stoichiometric air-fuel ratio during the operation of the engine, and the calculation of the active element solid solution degree on the basis of the temperature of the catalyst and the air-fuel ratio of the exhaust gas flowing into the catalyst is performed by calculating the active element solid solution degree on the basis of the parameter.

Further, in the aforementioned invention, various methods may be employed as a concrete calculation method of the active element solid solution degree on the basis of the catalyst temperature during the operation of the engine. For example, according to the further another invention of this application, in the aforementioned invention, the calculation of the active element solid solution degree on the basis of the temperature of the catalyst is performed by calculating the active element solid solution degree on the basis of a base catalyst temperature which is the temperature of the catalyst when the active element solid solution degree is a predetermined solid solution degree and the temperature of the catalyst during the operation of the engine.

In this invention, various methods may be employed as a concrete calculation method of the active element solid solution degree on the basis of the base catalyst temperature and the catalyst temperature during the operation of the engine. For example, according to the further another invention of this application, in the aforementioned invention, the calculation of the active element solid solution degree on the basis of the base catalyst temperature and the temperature of the catalyst during the operation of the engine is performed by calculating the active element solid solution degree on the basis of a catalyst temperature difference which is a difference between the base catalyst temperature and the temperature of the catalyst during the operation of the engine.

In this invention, various methods may be employed as a concrete calculation method of the active element solid solution degree on the basis of the catalyst temperature. For example, according to the further invention of this application, in the aforementioned invention, the calculation of the active element solid solution degree on the basis of the catalyst temperature difference is performed by subtracting the base catalyst temperature from the temperature of the catalyst during the operation of the engine to acquire the catalyst temperature difference and then, calculating the active element solid solution degree on the basis of the value obtained by dividing the catalyst temperature difference by the base catalyst temperature. In this case, as the catalyst temperature difference increases, the calculated active element solid solution degree tends to decrease.

Further, according to the further another invention of this application, the calculation of the active element solid solution degree on the basis of the catalyst temperature during the operation of the engine is performed as follows. That is, according to this invention, in the aforementioned invention, the calculation of the active element solid solution degree on the basis of the temperature of the catalyst is performed by calculating the active element solid solution degree on the basis of a temperature solid solution degree relationship which is a relationship between the temperature of the catalyst and the active element solid solution degree and the temperature of the catalyst during the operation of the engine.

Further, according to the further another invention of this application, the calculation of the active element solid solution degree on the basis of the catalyst temperature during the operation of the engine is performed as follows. That is, according to this invention, in the aforementioned invention, the calculation of the active element solid solution degree on the basis of the temperature of the catalyst is performed by calculating the active element solid solution degree on the basis of a catalyst temperature integration value during the engine operation, which value being an integration value of the temperature of the catalyst in a predetermined time period during the operation of the engine. In this case, as the catalyst temperature integration value during the engine operation increases, the calculated active element solid solution degree tends to decreases.

Further, in this invention, various methods may be employed as a concrete calculation method of the active element solid solution degree on the basis of the catalyst temperature integration value during the engine operation. For example, according to the further another invention of this application, in the aforementioned invention, the calculation of the active element solid solution degree on the basis of the catalyst temperature integration value during the engine operation is performed by calculating the active element solid solution degree on the basis of a base catalyst temperature integration value which is an integration value of the temperature of the catalyst in the predetermined time period when the active element solid solution degree is a predetermined solid solution degree and the catalyst temperature integration value during the engine operation.

Further, in this invention, various methods may be employed as a concrete calculation method of the active element solid solution degree on the basis of the base catalyst temperature integration value and the catalyst temperature integration value during the engine operation. For example, according to the further another invention of this application, in the aforementioned invention, the calculation of the active element solid solution degree on the basis of the base catalyst temperature integration value and the catalyst temperature integration value during the engine operation is performed by calculating the active element solid solution degree on the basis of a catalyst temperature integration value difference which is a difference between the base catalyst temperature integration value and the catalyst temperature integration value during the engine operation.

Further, in this invention, various methods may be employed as a concrete calculation method of the active element solid solution degree on the basis of the catalyst temperature integration value difference. For example, according to the further another invention of this application, in the aforementioned invention, the calculation of the active element solid solution degree on the basis of the catalyst temperature integration value difference is performed by subtracting the base catalyst temperature integration value from the catalyst temperature integration value during the engine operation to acquire the catalyst temperature integration value difference and calculating the active element solid solution degree on the basis of a value obtained by dividing the catalyst temperature integration value difference by the base catalyst temperature integration value. In this case, as the catalyst temperature integration value difference increases, the calculated active element solid solution degree tends to decrease.

Further, according to the further another invention of this application, the calculation of the active element solid solution degree on the basis of the catalyst temperature during the operation of the engine is performed as follows. That is, according to this invention, in the aforementioned invention, the calculation of the active element solid solution degree on the basis of the temperature of the catalyst is performed by calculating the active element solid solution degree on the basis of a temperature integration value solid solution degree relationship which is a relationship between the integration value of the temperature of the catalyst in a predetermined time period and the active element solid solution degree and the catalyst temperature integration value during the engine operation which is an integration value of the temperature of the catalyst in the predetermined time period during the operation of the engine.

In the aforementioned invention, various methods may be employed as a concrete calculation method of the active element solid solution degree on the basis of the output value trace length during the engine operation. For example, according to the further another invention of this application, in the aforementioned invention, the calculation of the active element solid solution degree on the basis of the output value trace length during the engine operation is performed by calculating the active element solid solution degree on the basis of a base output value trace length which is a length of the trace of the output value of the air-fuel ratio output means in the predetermined time period when the active element solid solution degree is a predetermined solid solution degree and the output value trace length during the engine operation.

In this invention, various methods may be employed as a concrete calculation method of the active element solid solution degree on the basis of the base output value trace length and the output value trace length during the engine operation. For example, according to the further another invention of this application, in the aforementioned invention, the calculation of the active element solid solution degree on the basis of the base output value trace length and the output value trace length during the engine operation is performed by calculating the active element solid solution degree on the basis of an output value trace length difference which is a difference between the base output value trace length and the output value trace length during the engine operation.

In this invention, various methods may be employed as a concrete calculation method of the active element solid solution degree on the basis of the output value trace length difference. For example, according to the further another invention of this application, in the aforementioned invention, the calculation of the active element solid solution degree on the basis of the output value trace length difference is performed by subtracting the base output value trace length from the output value trace length during the engine operation to acquire the output value trace length difference and calculating the active element solid solution degree on the basis of a value obtained by dividing the output value trace length difference by the base output value trace length. In this case, as the output value trace length difference increases, the calculated active element solid solution degree tends to increase.

Further, according to the further another invention of this application, the calculation of the active element solid solution degree on the basis of the output value trace length during the engine operation is performed as follows. That is, according to this invention, in the aforementioned invention, the calculation of the active element solid solution degree on the basis of the output value trace length during the engine operation is performed by calculating the active element solid solution degree on the basis of a trace length solid solution degree relationship which is a relationship between the length of the trace of the output value of the air-fuel ratio output means in a predetermined time period and the active element solid solution degree and the output value trace length during the engine operation.

In the aforementioned invention, various methods may be employed as a concrete calculation method of the active element solid solution degree on the basis of the inversion number during the engine operation. For example, according to the further another invention of this application, in the aforementioned invention, in the case that the active element solid solution degree is calculated on the basis of the positive direction inversion number during the engine operation, the calculation of the active element solid solution degree on the basis of the positive direction inversion number during the engine operation is performed by calculating the active element solid solution degree on the basis of a base positive direction inversion number which is the number of the inversion of the change rate of the output value of the air-fuel ratio output means from the negative value to the positive value in the predetermined time period when the active element solid solution degree is a predetermined solid solution degree and the positive direction inversion number during the engine operation, in the case that the active element solid solution degree is calculated on the basis of the negative direction inversion number during the engine operation, the calculation of the active element solid solution degree on the basis of the negative direction inversion number during the engine operation is performed by calculating the active element solid solution degree on the basis of a base negative direction inversion number which is the number of the inversion of the change rate of the output value of the air-fuel ratio output means from the positive value to the negative value in the predetermined time period when the active element solid solution degree is a predetermined solid solution degree and the negative direction inversion number during the engine operation, and in the case that the active element solid solution degree is calculated on the basis of the total inversion number during the engine operation, the calculation of the active element solid solution degree on the basis of the total inversion number during the engine operation is performed by calculating the active element solid solution degree on the basis of the base total inversion number which is the total number of the base positive and negative direction inversion numbers and the total inversion number during the engine operation.

In this invention, various methods may be employed as a concrete calculation method of the active element solid solution degree on the basis of the base positive direction inversion number and the positive direction inversion number during the engine operation, a concrete calculation method of the active element solid solution degree on the basis of the base negative direction inversion number and the negative direction inversion number during the engine operation, and a concrete calculation method of the active element solid solution degree on the basis of the base total inversion number and the total inversion number during the engine operation.

For example, according to the further another invention of this application, in the aforementioned invention, in the case that the active element solid solution degree is calculated on the basis of the base positive direction inversion number and the positive direction inversion number during the engine operation, the calculation of the active element solid solution degree on the basis of the base positive direction inversion number and the positive direction inversion number during the engine operation is performed by calculating the active element solid solution degree on the basis of a positive direction inversion number difference which is a difference between the base positive direction inversion number and the positive direction inversion number during the engine operation, in the case that the active element solid solution degree is calculated on the basis of the base negative direction inversion number and the negative direction inversion number during the engine operation, the calculation of the active element solid solution degree on the basis of the base negative direction inversion number and the negative direction inversion number during the engine operation is performed by calculating the active element solid solution degree on the basis of a negative direction inversion number difference which is a difference between the base negative direction inversion number and the negative direction inversion number during the engine operation, and in the case that the active element solid solution degree is calculated on the basis of the base total inversion number and the total inversion number during the engine operation, the calculation of the active element solid solution degree on the basis of the base total inversion number and the total inversion number during the engine operation is performed by calculating the active element solid solution degree on the basis of a total inversion number difference which is a difference between the base total inversion number and the total inversion number during the engine operation.

In this invention, various methods may be employed as a concrete calculation method of the active element solid solution degree on the basis of the positive direction inversion number difference or the negative direction inversion number difference or the total inversion number difference. For example, according to the further another invention of this application, in the aforementioned invention, in the case that the active element solid solution degree is calculated on the basis of the positive direction inversion number difference, the calculation of the active element solid solution degree on the basis of the positive direction inversion number difference is performed by subtracting the base positive direction inversion number from the positive direction inversion number during the engine operation to acquire the positive direction inversion number difference and calculating the active element solid solution degree on the basis of a value obtained by dividing the positive direction inversion number difference by the base positive direction inversion number, in the case that the active element solid solution degree is calculated on the basis of the negative direction inversion number difference, the calculation of the active element solid solution degree on the basis of the negative direction inversion number difference is performed by subtracting the base negative direction inversion number from the negative direction inversion number during the engine operation to acquire the negative direction inversion number difference and calculating the active element solid solution degree on the basis of a value obtained by dividing the negative direction inversion number difference by the base negative direction inversion number, and in the case that the active element solid solution degree is calculated on the basis of the total inversion number difference, the calculation of the active element solid solution degree on the basis of the total inversion number difference is performed by subtracting the base total inversion number from the total inversion number during the engine operation to acquire the total inversion number difference and calculating the active element solid solution degree on the basis of a value obtained by dividing the total inversion number difference by the base total inversion number.

Further, according to the further another invention of this application, the calculation of the active element solid solution degree on the basis of the inversion number during the engine operation is performed as follows. That is, according to this invention, in the aforementioned invention, in the case that the active element solid solution degree is calculated on the basis of the positive direction inversion number during the engine operation, the calculation of the active element solid solution degree on the basis of the positive direction inversion number during the engine operation is performed by calculating the active element solid solution degree on the basis of an inversion number solid solution degree relationship which is a relationship between the number of the inversion of the change rate of the output value of the air-fuel ratio output means from the negative value to the positive value in the predetermined time period and the positive direction inversion number during the engine operation, in the case that the active element solid solution degree is calculated on the basis of the negative direction inversion number during the engine operation, the calculation of the active element solid solution degree on the basis of the negative direction inversion number during the engine operation is performed by calculating the active element solid solution degree on the basis of an inversion number solid solution degree relationship which is a relationship between the number of the inversion of the change rate of the output value of the air-fuel ratio output means from the positive value to the negative value in the predetermined time period and the negative direction inversion number during the engine operation, and in the case that the active element solid solution degree is calculated on the basis of the total inversion number during the engine operation, the calculation of the active element solid solution degree on the basis of the total inversion number during the engine operation is performed by calculating the active element solid solution degree on the basis of an inversion number solid solution degree relationship which is a relationship between the total number of the inversion of the change rate of the output value of the air-fuel ratio output means from the negative value to the positive value in the predetermined time period and the inversion of the change rate of the output value of the air-fuel ratio output means from the positive value to the negative value in the predetermined time period and the total inversion number during the engine operation.

The air-fuel ratio output means is not limited to any particular means and as this means, for example, an air-fuel ratio sensor for detecting the air-fuel ratio of the exhaust gas may be employed.

MODE FOR CARRYING OUT THE INVENTION

Figure 1:
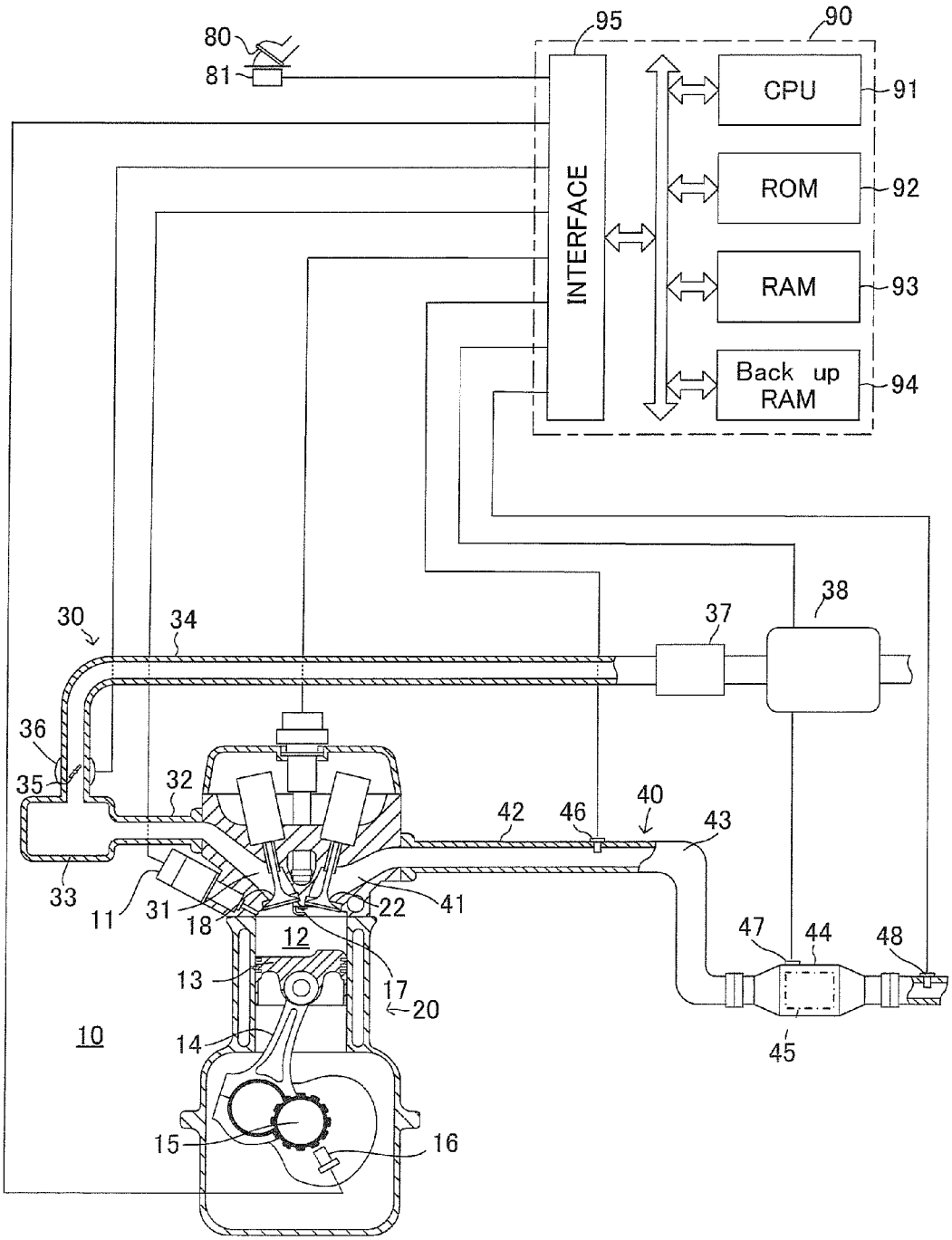
FIG. 1 is a view showing an internal combustion engine provided with an exhaust gas purification device of a first embodiment of the invention.

Below, embodiments of the invention will be described. An internal combustion engine provided with an exhaust gas purification device of a first embodiment of the invention is shown in FIG. 1. The engine shown in FIG. 1 is a spark ignition type internal combustion engine (so-called gasoline engine). In FIG. 1, 11 denotes a fuel injector, 12 denotes a combustion chamber, 13 denotes a piston, 14 denotes a connecting rod, 15 denotes a crank shaft, 16 denotes a crank position sensor, 17 denotes a spark plug, 18 denotes an intake valve, 20 denotes a body of the engine, 22 denotes an exhaust valve, 80 denotes an acceleration pedal and 81 denotes an acceleration pedal depression amount sensor. In FIG. 1, only one combustion chamber 12 is shown, however, the engine 10 comprises a plurality of the combustion chambers (for example, four or six or eight combustion chambers) and the aforementioned elements respectively corresponding thereto.

Further, in FIG. 1, 30 denotes an intake passage, 31 denotes an intake port, 32 denotes an intake manifold, 33 denotes a surge tank, 34 denotes an intake pipe, 35 denotes a throttle valve, 36 denotes an actuator for driving the throttle valve 35, 37 denotes an air flow meter, 38 denotes an air cleaner, 40 denotes an exhaust passage, 41 denotes an exhaust port, 42 denotes an exhaust manifold, 43 denotes an exhaust pipe, 44 denotes a catalyst converter, 46 denotes an air-fuel ratio sensor, 47 denotes a temperature sensor and 48 denotes an air-fuel ratio sensor. The intake passage 30 is constituted by the intake port 31, the intake manifold 32, the surge tank 33 and the intake pipe 34. On the other hand, the exhaust passage 40 is constituted by the exhaust port 41, the exhaust manifold 42 and the exhaust pipe 43.

An electronic control unit 90 comprises a microcomputer. Further, the unit 90 has a CPU (a microprocessor) 91, a ROM (a read only memory) 92, a RAM (a random access memory) 93, a backup RAM 94 and an interface 95. These CPU 91, ROM 92, RAM 93, backup RAM 94 and interface 95 are connected to each other by a bidirectional bus.

Next, the details of the aforementioned elements of the engine will be described. In the following description, "a target fuel injection timing" means—a target timing as a timing to inject a fuel from the fuel injector—, "a target fuel injection amount" means—a target amount as an amount of the fuel injected from the fuel injector—, "a mixture gas" means—a gas formed in the combustion chamber by the combination of the air and the fuel—, "a target ignition timing" means—a target timing as a timing to ignite the fuel in the mixture gas by the spark plug—, "an engine speed" means—a speed of the engine—, "a throttle valve opening degree" means—an opening degree of the throttle valve—, "a target throttle valve opening degree" means—a target opening degree of the throttle valve—, "an intake air amount" means—an amount of the air suctioned into the combustion chamber—, "an acceleration pedal depression amount" means—a depression amount of the acceleration pedal—and "a required engine torque" means—a torque required as a torque to be output from the engine—.

The fuel injector 11 is arranged on the body 20 of the engine such that a fuel injection hole thereof exposes to the interior of the combustion chamber 12. Further, the fuel injector 11 is electrically connected to the interface 95 of the electronic control unit 90. The unit 90 supplies to the fuel injector 11, a command signal to inject a fuel of a target fuel injection amount from the fuel injector 11 at a target fuel injection timing. When the command signal is supplied from the unit 90 to the fuel injector 11, the fuel injector 11 injects the fuel directly into the combustion chamber 12.

The spark plug 17 is arranged on the body 20 of the engine such that a discharge electrode thereof exposes to the interior of the combustion chamber 12. Further, the spark plug 17 is electrically connected to the interface 95 of the electronic control unit 90. The unit 90 supplies to the spark plug 17, a command signal for generating a spark by the spark plug 17 at a target ignition timing. When the command signal is supplied from the unit 90 to the spark plug 17, the spark plug 17 ignites the fuel in the combustion chamber 12. When the fuel in the combustion chamber 12 is ignited by the spark plug 17, the fuel in the combustion chamber 12 burns and therefore, a torque is output to the crank shaft 15 via the piston 13 and the connecting rod 14.

The crank position sensor 16 is arranged around an output shaft of the engine, that is, around the crank shaft 15. Further, the crank position sensor 16 is electrically connected to the interface 95 of the electronic control unit 90. The crank position sensor outputs an output value corresponding to the rotation phase of the crank shaft 15. This output value is input into the unit 90. The unit 90 calculates an engine speed on the basis of this output value.

The intake manifold 32 divides at its one end into a plurality of pipes and each pipe is connected to the corresponding intake port 31. Further, the intake manifold 32 is connected to one end of the surge tank 33 at its other end. The surge tank 33 is connected to one end of the intake pipe 34 at its other end.

The throttle valve 35 is arranged in the intake pipe 34. The actuator 36 for changing the opening degree of the throttle valve 35 (hereinafter, this actuator may be referred to as—throttle valve actuator—) is connected to the throttle valve 35. The throttle valve actuator 36 is electrically connected to the interface 95 of the electronic control unit 90. The unit 90 supplies to the throttle valve actuator 36, a control signal to drive the actuator 36 so as to control the throttle valve opening degree to a target throttle valve opening degree. When the throttle valve opening degree is changed, a flow area in the intake pipe 34 at an area where the throttle valve 35 is arranged changes. Thereby, an amount of an air flowing through the throttle valve 35 changes and therefore, an amount of an air suctioned into the combustion chamber changes.

The air flow meter 37 is arranged on the intake pipe 34 upstream of the throttle valve 35. Further, the air flow meter 37 is electrically connected to the interface 95 of the electronic control unit 90. The air flow meter 37 outputs an output value corresponding to an amount of an air passing therethrough. This output value is input into the unit 90. The unit 90 calculates the amount of the air passing through the air flow meter 37, thus, an intake air amount on the basis of this output value.

The air cleaner 38 is arranged in the intake pipe 34 upstream of the air flow meter 37.

The exhaust manifold 42 divides at its one end into a plurality of pipes and each pipe is connected to the corresponding exhaust port 41. Further, the exhaust manifold 42 is connected to one end of the exhaust pipe 43 at its other end. The exhaust pipe 43 opens to the outside air at its other end.

The catalyst converter 44 is arranged in the exhaust passage 40 (in particular, in the exhaust pipe 43). Further, the catalyst converter 44 houses a catalyst 45 therein. This catalyst 45 can purify particular components in the exhaust gas flowing into the catalyst at a predetermined purification rate when a temperature of the catalyst 45 is higher than or equal to a particular temperature (so-called activation temperature). In particular, the catalyst 45 has an active element and a carrier. The carrier carries the active element. Further, the active element has a property which activates at least one or both of the oxidation and reduction reactions of the particular components in the exhaust gas flowing into the catalyst.

Further, the active element transforms as a solid solution into the carrier when a temperature of the catalyst (hereinafter, this temperature may be referred to as—catalyst temperature—) is higher than and equal to a certain temperature (hereinafter, this temperature may be referred to as—predetermined solid solution temperature—) and an atmosphere in the catalyst is an oxidation atmosphere and precipitates from the carrier when the catalyst temperature is higher than or equal to a certain temperature (hereinafter, this temperature may be referred to as—catalyst precipitation temperature—) and the atmosphere in the catalyst is a reduction atmosphere.

Further, the carrier is comprised of a material having a property which the active element transforms thereinto as a solid solution when the catalyst temperature is the predetermined solid solution temperature and the atmosphere in the catalyst is the oxidation atmosphere and the active element precipitates therefrom when the catalyst temperature is higher than or equal to the catalyst precipitation temperature and the atmosphere in the catalyst is the reduction atmosphere.

Therefore, in the catalyst of the first embodiment, the active element which has precipitated from the carrier transforms as a solid solution into the carrier when the catalyst temperature is higher than or equal to the predetermined solid solution temperature and an air-fuel ratio of the exhaust gas flowing into the catalyst is leaner than the stoichiometric air-fuel ratio and the active element which has transformed as a solid solution in the carrier precipitates from the carrier when the catalyst temperature is higher than or equal to the predetermined precipitation temperature and the air-fuel ratio of the exhaust gas flowing into the catalyst is richer than the stoichiometric air-fuel ratio.

The catalyst 45 is a three way catalyst which can purify a nitrogen oxide (NOx), a carbon monoxide (CO) and an unburned hydrocarbon (HC) in the exhaust gas at a high purification rate when the air-fuel ratio of the exhaust gas flowing into the catalyst is the stoichiometric air-fuel ratio. The air-fuel ratio of the exhaust gas means a ratio of the amount of the air suctioned into the combustion chamber 12 relative to the amount of the fuel supplied into the combustion chamber 12.

Any element which transforms as a solid solution into the carrier as described above and precipitates from the carrier as described above may be employed as the active element and for example, the active element may be rhodium (Rh). Further, any material which has a property which the active element transforms as a solid solution thereinto as described above and precipitates therefrom as described above may be employed as the material constituting the carrier and for example, the material may be a composite oxide such as $MgAlO_4$ having a spinel structure, $MAl_2O_3$ (M is a metal) having a perovskite structure, etc.

The air-fuel ratio sensor 46 (hereinafter, this sensor may be referred to as—upstream air-fuel ratio sensor—) is arranged in the exhaust passage 40 upstream of the catalyst 45. Further, the air-fuel ratio sensor 46 is electrically connected to the interface 95 of the electronic control unit 90. The air-fuel ratio sensor 46 outputs an output value corresponding to the exhaust gas reaching the sensor. This output value is input into the unit 90. The unit 90 calculates the air-fuel ratio of the exhaust gas reaching the air-fuel ratio sensor 46 on the basis of this output value. Therefore, the air-fuel ratio sensor 46 is a sensor for detecting the air-fuel ratio of the exhaust gas reaching the sensor.

Figure 2:
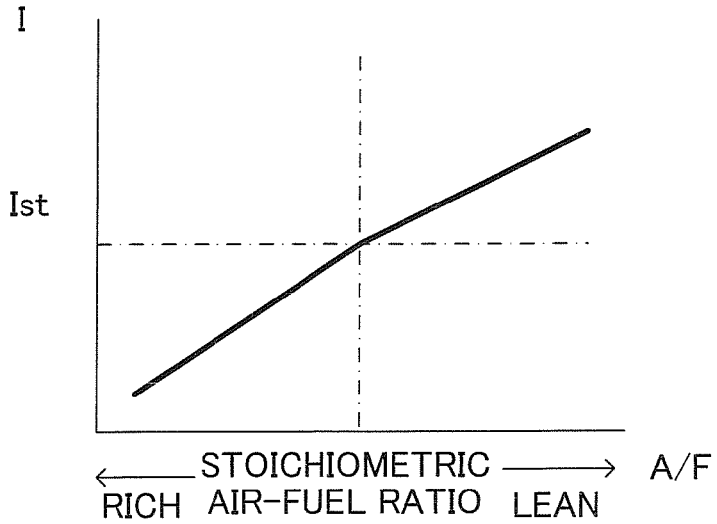
FIG. 2(A) is a view showing an output property of an upstream air-fuel ratio sensor and FIG. 2(B) is a view showing an output property of a downstream air-fuel ratio sensor.
Figure 2:
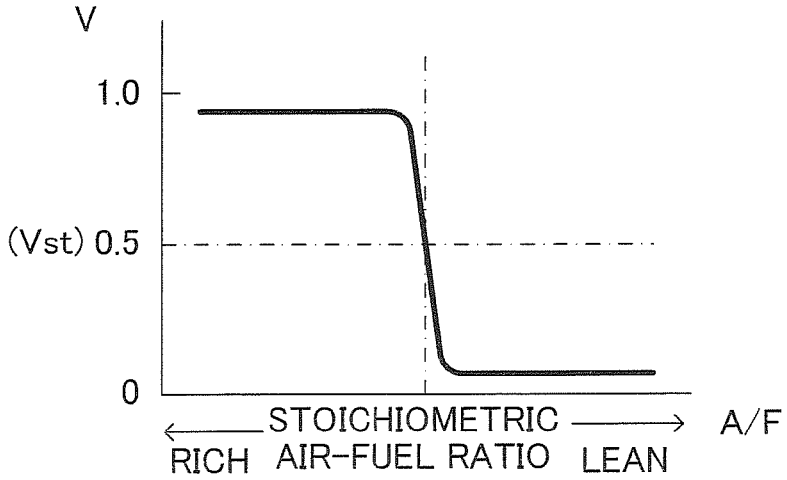

Any sensor which detects the air-fuel ratio of the exhaust gas reaching the sensor may be employed as the air-fuel ratio sensor 46 and for example, as the air-fuel ratio sensor 46, a limiting current type oxygen concentration sensor which has an output property shown in FIG. 2(A). As shown in FIG. 2(A), this oxygen concentration sensor outputs as an output value, a current value which increases as the air-fuel ratio of the exhaust gas reaching the sensor increases.

The air-fuel ratio sensor 48 (hereinafter, this sensor may be referred to as—downstream air-fuel ratio sensor—) is arranged in the exhaust passage 40 downstream of the catalyst 45. Further, the air-fuel ratio sensor 48 is electrically connected to the interface 95 of the electronic control unit 90. The air-fuel ratio sensor 48 outputs an output value corresponding to the exhaust gas reaching the sensor. This output value is input into the unit 90. The unit 90 calculates the air-fuel ratio of the exhaust gas reaching the air-fuel ratio sensor 48 on the basis of this output value. Therefore, the air-fuel ratio sensor 48 is a sensor for detecting the air-fuel ratio of the exhaust gas reaching the sensor.

Any sensor which detects the air-fuel ratio of the exhaust gas reaching the sensor may be employed as the air-fuel ratio sensor 48 and for example, as the air-fuel ratio sensor 48, an electromotive force type oxygen concentration sensor which has an output property shown in FIG. 2(B). As shown in FIG. 2(B), this oxygen concentration sensor outputs as an output value, a relatively large constant voltage value when the air-fuel ratio of the exhaust gas reaching the sensor is richer than the stoichiometric air-fuel ratio and outputs as an output value, a relatively small constant voltage value when the air-fuel ratio of the exhaust gas reaching the sensor is leaner than the stoichiometric air-fuel ratio.

Further, this oxygen concentration sensor outputs as an output value, a voltage value intermediate between the relatively large and small constant voltage values when the air-fuel ratio of the exhaust gas reaching the sensor is the stoichiometric air-fuel ratio. Therefore, the output value of this oxygen concentration sensor rapidly decreases from the relatively large constant voltage value to the relatively small constant voltage value through the intermediate voltage value when the air-fuel ratio of the exhaust gas reaching the sensor changes from the air-fuel ratio richer than the stoichiometric air-fuel ratio to the air-fuel ratio leaner than the stoichiometric air-fuel ratio.

On the other hand, the output value of this oxygen concentration sensor rapidly increases from the relatively small constant voltage value to the relatively large constant voltage value through the intermediate voltage value when the air-fuel ratio of the exhaust gas reaching the sensor changes from the air-fuel ratio leaner than the stoichiometric air-fuel ratio to the air-fuel ratio richer than the stoichiometric air-fuel ratio.

The temperature sensor 47 is arranged in the catalyst converter 44. Further, the temperature sensor 47 is electrically connected to the interface 95 of the electronic control unit 90. The temperature sensor 47 outputs an output value corresponding to the temperature of the catalyst 45. This output value is input into the unit 90. The unit 90 calculates the temperature of the catalyst 45 on the basis of this output value. Therefore, the temperature sensor 47 is a sensor for detecting the temperature of the catalyst 45.

The acceleration pedal depression amount sensor 81 is connected to the acceleration pedal 80. Further, acceleration pedal depression amount sensor 81 is electrically connected to the interface 95 of the electronic control unit 90. The acceleration pedal depression amount sensor 81 outputs an output value corresponding to the depression amount of the acceleration pedal 80. This output value is input into the electronic control unit 90. The unit 90 calculates the depression amount of the acceleration pedal 80, thus, the required engine torque on the basis of this output value.

Next, a control of the air-fuel ratio of the engine according to the first embodiment will be described. In the following description, "an active element solid solution degree" means—a proportion of the active element which has transformed as a solid solution into the carrier relative to the total active element of the catalyst—, "a target solid solution degree" means—a target degree of the active element solid solution degree—and "a fuel injection amount" means—an amount of the fuel injected from the fuel injector—.

According to the first embodiment, a stoichiometric air-fuel ratio control, a lean air-fuel ratio control and a rich air-fuel ratio control can be selectively performed. In this regard, the stoichiometric air-fuel ratio control is a control for controlling the fuel injection amount such that the air-fuel ratio of the mixture gas formed in the combustion chamber (hereinafter, this air-fuel ratio may be simply referred to as—air-fuel ratio of the mixture gas—) is controlled to the stoichiometric air-fuel ratio and therefore, the air-fuel ratio of the exhaust gas flowing into the catalyst (hereinafter, this air-fuel ratio may be referred to as—catalyst inflow exhaust air-fuel ratio—) is controlled to the stoichiometric air-fuel ratio.

Further, the lean air-fuel ratio control is a control for decreasing the fuel injection amount such that the air-fuel ratio of the mixture gas is controlled to an air-fuel ratio larger than the stoichiometric air-fuel ratio (i.e. leaner than the stoichiometric air-fuel ratio) and therefore, the catalyst inflow exhaust air-fuel ratio is controlled to an air-fuel ratio larger than the stoichiometric air-fuel ratio.

Further, the rich air-fuel ratio control is a control for increasing the fuel injection amount such that the air-fuel ratio of the mixture gas is controlled to an air-fuel ratio smaller than the stoichiometric air-fuel ratio (i.e. richer than the stoichiometric air-fuel ratio) and therefore, the catalyst inflow exhaust air-fuel ratio is controlled to an air-fuel ratio smaller than the stoichiometric air-fuel ratio.

According to the first embodiment, when the active element solid solution degree is smaller than the target solid solution degree and the catalyst temperature is higher than or equal to the predetermined solid solution temperature, the lean air-fuel ratio control is performed.

Further, when the active element solid solution degree is larger than the target solid solution degree and the catalyst temperature is higher than or equal to the predetermined precipitation temperature, the rich air-fuel ratio control is performed.

Further, when the active element solid solution degree corresponds to the target solid solution degree or when the active element solid solution degree is smaller than the target solid solution degree and the catalyst temperature is lower than the predetermined solid solution temperature or when the active element solid solution degree is larger than the target solid solution degree and the catalyst temperature is lower than the predetermined precipitation temperature, the stoichiometric air-fuel ratio control is performed.

Next, the stoichiometric air-fuel ratio control according to the first embodiment will be described. In the following description, "an engine operation condition" means—an operation condition of the engine—, "a fuel injection amount" means—an amount of the fuel injected from the fuel injector—, "a target air-fuel ratio" means—a target air-fuel ratio of the mixture gas—, "an upstream detected air-fuel ratio" means—an air-fuel ratio of the exhaust gas detected by the upstream air-fuel ratio sensor—and "a downstream detected air-fuel ratio" means—an air-fuel ratio of the exhaust gas detected by the downstream air-fuel ratio sensor—.

Figure 3:
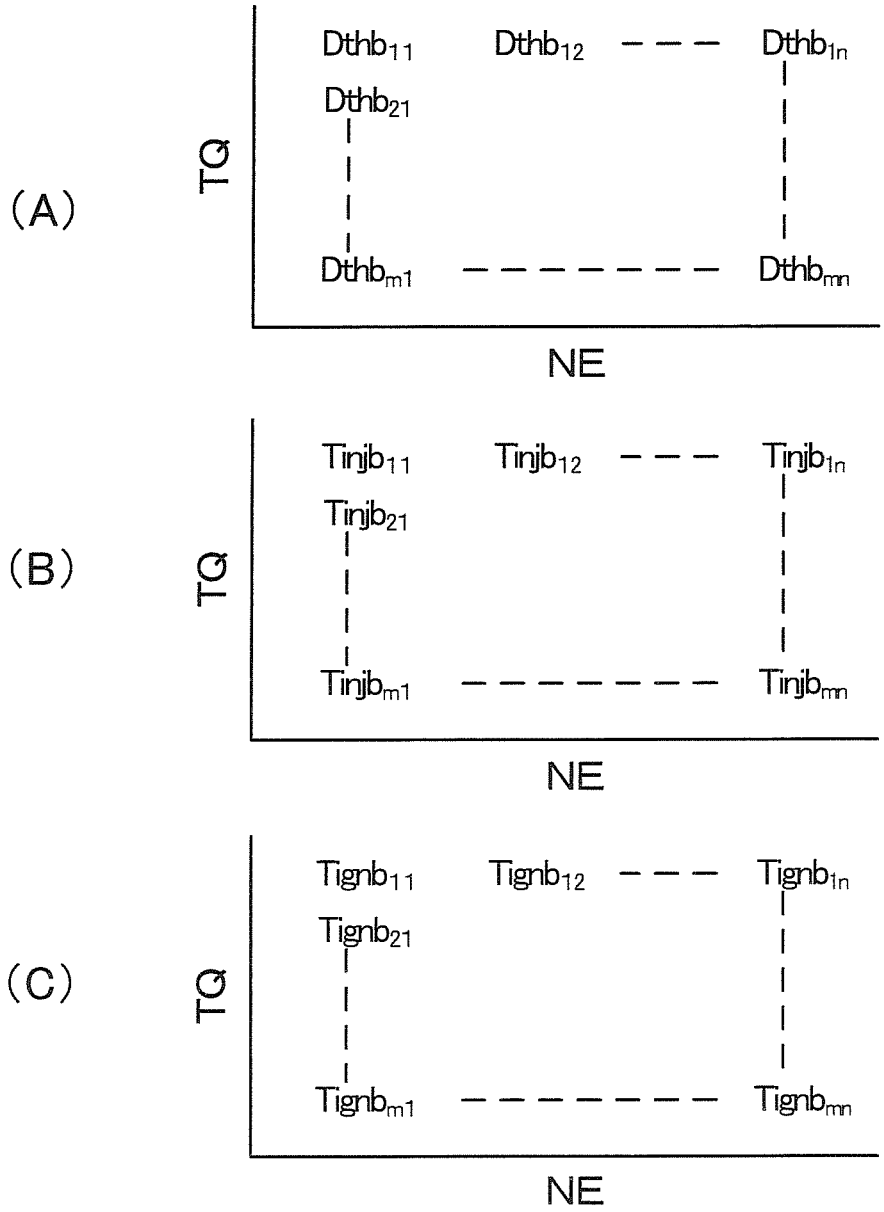
FIG. 3(A) is a view showing a map used for acquiring a base throttle valve opening degree during an engine operation according to the first embodiment.
FIG. 3(B) is a view showing a map used for acquiring a base fuel injection timing during the engine operation according to the first embodiment.
FIG. 3(C) is a view showing a map used for acquiring a base ignition timing during the engine operation according to the first embodiment.

According to the stoichiometric air-fuel ratio control, optimal throttle valve opening degrees depending on an engine operation conditions are previously obtained by an experiment, etc. Then, these obtained throttle valve opening degrees are memorized in the electronic control unit as base throttle valve opening degrees Dthb in the form of a map as a function of the engine speed NE and the required engine torque TQ as shown in FIG. 3(A). Then, during the engine operation, a base throttle valve opening degree Dthb corresponding to the current engine speed NE and the current required engine torque TQ is acquired from the map of FIG. 3(A). Then, the thus acquired base throttle valve opening degree Dthb is set as a target throttle valve opening degree.

Further, according to the stoichiometric air-fuel ratio control, a base fuel injection amount Qb is calculated according to the following formula 1, then, a target fuel injection amount Qt is calculated according to the following formula 2 and then, the thus calculated target fuel injection amount is set as a target fuel injection amount. In the following formula 1, "Ga" is—intake air amount—, "NE" is—engine speed—and "AFt" is—target air-fuel ratio—and in the following formula 2, "Qb" is—base fuel injection amount calculated according to the formula 1—and "Kf" is—correction coefficient—. According to the stoichiometric air-fuel ratio control, the stoichiometric air-fuel ratio is set as the target air-fuel ratio.

$$Qb=(Ga/NE)*(1/AFt) \quad (1)$$

$$Qt=Qb*Kf \quad (2)$$

The correction coefficient Kf in the formula 2 used in the stoichiometric air-fuel ratio control is set as follows. That is, while the upstream detected air-fuel ratio is larger than the stoichiometric air-fuel ratio (=target air-fuel ratio) (i.e. while the upstream detected air-fuel ratio is leaner than the stoichiometric air-fuel ratio and therefore, the air-fuel ratio of the mixture gas is leaner than the stoichiometric air-fuel ratio), the correction coefficient Kf is gradually increased by a relatively small constant value (hereinafter, this value may be referred to as—constant increase value—). Thereby, the target fuel injection amount is gradually increased and therefore, the air-fuel ratio of the mixture gas gradually decreases to approach the stoichiometric air-fuel ratio.

On the other hand, while the upstream detected air-fuel ratio is smaller than the stoichiometric air-fuel ratio (=target air-fuel ratio) (i.e. while the upstream detected air-fuel ratio is richer than the stoichiometric air-fuel ratio and therefore, the air-fuel ratio of the mixture gas is richer than the stoichiometric air-fuel ratio), the correction coefficient Kf is gradually decreased by a relatively small constant value (hereinafter, this value may be referred to as—constant decrease value—). Thereby, the target fuel injection amount is gradually decreased and therefore, the air-fuel ratio of the mixture gas gradually increases to approach the stoichiometric air-fuel ratio.

Further, when the upstream detected air-fuel ratio changes from an air-fuel ratio larger than the stoichiometric air-fuel ratio (=target air-fuel ratio) to an air-fuel ratio smaller than the stoichiometric air-fuel ratio (i.e. when the upstream detected air-fuel ratio changes from an air-fuel ratio leaner than the stoichiometric air-fuel ratio to an air-fuel ratio richer than the stoichiometric air-fuel ratio and therefore, the air-fuel ratio of the mixture gas changes from an air-fuel ratio leaner than the stoichiometric air-fuel ratio to an air-fuel ratio richer than the stoichiometric air-fuel ratio), the correction coefficient Kf is decreased by a relatively large value (hereinafter, this value may be referred to as—skip decrease value—). Thereby, the target fuel injection amount is decreased at once and therefore, the air-fuel ratio of the mixture gas increases at once to approach the stoichiometric air-fuel ratio (=target air-fuel ratio) at once.

On the other hand, when the upstream detected air-fuel ratio changes from an air-fuel ratio smaller than the stoichiometric air-fuel ratio (=target air-fuel ratio) to an air-fuel ratio larger than the stoichiometric air-fuel ratio (i.e. when the upstream detected air-fuel ratio changes from an air-fuel ratio richer than the stoichiometric air-fuel ratio to an air-fuel ratio leaner than the stoichiometric air-fuel ratio and therefore, the air-fuel ratio of the mixture gas changes from an air-fuel ratio richer than the stoichiometric air-fuel ratio to an air-fuel ratio leaner than the stoichiometric air-fuel ratio), the correction coefficient Kf is increased by a relatively large value (hereinafter, this value may be referred to as—skip increase value—). Thereby, the target fuel injection amount is increased at once and therefore, the air-fuel ratio of the mixture gas decreases at once to approach the stoichiometric air-fuel ratio (=target air-fuel ratio) at once.

The skip decrease and increase values used in the stoichiometric air-fuel ratio control are set as follows. That is, while the downstream detected air-fuel ratio is larger than the stoichiometric air-fuel ratio (=target air-fuel ratio) (i.e. while the downstream detected air-fuel ratio is leaner than the stoichiometric air-fuel ratio), the skip increase value is gradually increased by a relatively small constant value (hereinafter, this value may be referred to as—predetermined correction value—). On the other hand, while the downstream detected air-fuel ratio is smaller than the stoichiometric air-fuel ratio (=target air-fuel ratio) (i.e. while the downstream detected air-fuel ratio is richer than the stoichiometric air-fuel ratio), the skip increase value is gradually decreased by the predetermined correction value. Then, the skip decrease value is calculated by subtracting the aforementioned calculated skip increase value from a predetermined value which is at least larger than or equal to zero (hereinafter, this value may be referred to as—reference value—). When the aforementioned calculated skip increase value is smaller than the reference value, the reference value is set as the skip increase value (i.e. the skip increase value is limited to the reference value).

In the stoichiometric air-fuel ratio control according to the first embodiment, while the upstream detected air-fuel ratio is larger than the stoichiometric air-fuel ratio (=target air-fuel ratio), the correction coefficient is gradually increased by the constant increase value and on the other hand, while the upstream detected air-fuel ratio is smaller than the stoichiometric air-fuel ratio, the correction coefficient is gradually decreased by the constant decrease value.

In this regard, in place of this, while the upstream detected air-fuel ratio is larger than or equal to the stoichiometric air-fuel ratio (=target air-fuel ratio), the correction coefficient may be gradually increased by the constant increase value and on the other hand, while the upstream detected air-fuel ratio is smaller than the stoichiometric air-fuel ratio, the correction coefficient may be gradually decreased by the constant decrease value or while the upstream detected air-fuel ratio is larger than the stoichiometric air-fuel ratio (=target air-fuel ratio), the correction coefficient may be gradually increased by the constant increase value and on the other hand, while the upstream detected air-fuel ratio is smaller than or equal to the stoichiometric air-fuel ratio, the correction coefficient may be gradually decreased by the constant decrease value.

In the stoichiometric air-fuel ratio control according to the first embodiment, when the upstream detected air-fuel ratio changes from an air-fuel ratio larger than the stoichiometric air-fuel ratio (=target air-fuel ratio) to an air-fuel ratio smaller than the stoichiometric air-fuel ratio, the correction coefficient is decreased by the skip decrease value and on the other hand, when the upstream detected air-fuel ratio changes from an air-fuel ratio smaller than the stoichiometric air-fuel ratio to an air-fuel ratio larger than the stoichiometric air-fuel ratio, the correction coefficient is increased by the constant increase value.

In this regard, in place of this, when the upstream detected air-fuel ratio changes from an air-fuel ratio larger than or equal to the stoichiometric air-fuel ratio (=target air-fuel ratio) to an air-fuel ratio smaller than the stoichiometric air-fuel ratio, the correction coefficient may be decreased by the skip decrease value and on the other hand, when the upstream detected air-fuel ratio changes from an air-fuel ratio smaller than the stoichiometric air-fuel ratio to an air-fuel ratio larger than or equal to the stoichiometric air-fuel ratio, the correction coefficient may be increased by the constant increase value or when the upstream detected air-fuel ratio changes from an air-fuel ratio larger than the stoichiometric air-fuel ratio (=target air-fuel ratio) to an air-fuel ratio smaller than or equal to the stoichiometric air-fuel ratio, the correction coefficient may be decreased by the skip decrease value and on the other hand, when the upstream detected air-fuel ratio changes from an air-fuel ratio smaller than or equal to the stoichiometric air-fuel ratio to an air-fuel ratio larger than the stoichiometric air-fuel ratio, the correction coefficient may be increased by the constant increase value.

Further, in the stoichiometric air-fuel ratio control according to the first embodiment, while the downstream detected air-fuel ratio is larger than the stoichiometric air-fuel ratio (=target air-fuel ratio), the skip increase value is gradually increased by the predetermined correction value and on the other hand, while the downstream detected air-fuel ratio is smaller than the stoichiometric air-fuel ratio, the skip increase value is gradually decreased by the predetermined correction value.

In this regard, in place of this, while the downstream detected air-fuel ratio is larger than or equal to the stoichiometric air-fuel ratio (=target air-fuel ratio), the skip increase value may be gradually increased by the predetermined correction value and on the other hand, while the downstream detected air-fuel ratio is smaller than the stoichiometric air-fuel ratio, the skip increase value may be gradually decreased by the predetermined correction value or while the downstream detected air-fuel ratio is larger than the stoichiometric air-fuel ratio (=target air-fuel ratio), the skip increase value may be gradually increased by the predetermined correction value and on the other hand, while the downstream detected air-fuel ratio is smaller than or equal to the stoichiometric air-fuel ratio, the skip increase value may be gradually decreased by the predetermined correction value.

Next, the lean air-fuel ratio control according to the first embodiment will be described. In the following description, "a lean air-fuel ratio" means—an air-fuel ratio leaner than the stoichiometric air-fuel ratio—.

According to the lean air-fuel ratio control, similar to the stoichiometric air-fuel ratio control, the target throttle valve opening degree is set and the target fuel injection amount is set according to the formulas 1 and 2. In the lean air-fuel ratio control, a predefined lean air-fuel ratio (hereinafter, this air-fuel ratio may be referred to as—predetermined lean air-fuel ratio—) is set as the target air-fuel ratio AFt in the formula 1.

Then, contract to the stoichiometric air-fuel ratio control, according to the lean air-fuel ratio control, the correction coefficient Kf in the formula 2 is set as follows. That is, while the upstream detected air-fuel ratio is larger than the predetermined lean air-fuel ratio (=target air-fuel ratio) (i.e. while the upstream detected air-fuel ratio is leaner than the predetermined lean air-fuel ratio and therefore, the air-fuel ratio of the mixture gas is leaner than the stoichiometric air-fuel ratio), the correction coefficient Kf is gradually increased by a relatively small constant value (hereinafter, this value may be referred to as—constant increase value—). Thereby, the target fuel injection amount is gradually increased and therefore, the air-fuel ratio of the mixture gas gradually decreases to approach the predetermined lean air-fuel ratio.

On the other hand, while the upstream detected air-fuel ratio is smaller than the predetermined lean air-fuel ratio (=target air-fuel ratio) (i.e. while the upstream detected air-fuel ratio is richer than the predetermined lean air-fuel ratio and therefore, the air-fuel ratio of the mixture gas is richer than the predetermined lean air-fuel ratio), the correction coefficient Kf is gradually decreased by a relatively small constant value (hereinafter, this value may be referred to as—constant decrease value—).

Thereby, the target fuel injection amount is gradually decreased and therefore, the air-fuel ratio of the mixture gas gradually increases to approach the predetermined lean air-fuel ratio.

Further, while the upstream detected air-fuel ratio changes from an air-fuel ratio larger than the predetermined lean air-fuel ratio (=target air-fuel ratio) to an air-fuel ratio smaller than the predetermined lean air-fuel ratio (i.e. while the upstream detected air-fuel ratio changes from an air-fuel ratio leaner than the predetermined lean air-fuel ratio to an air-fuel ratio richer than the predetermined lean air-fuel ratio and therefore, the air-fuel ratio of the mixture gas changes from an air-fuel ratio leaner than the predetermined lean air-fuel ratio to an air-fuel ratio richer than the predetermined lean air-fuel ratio), the correction coefficient Kf is decreased by a relatively large value (hereinafter, this value may be referred to as—skip decrease value—). Thereby, the target fuel injection amount is decreased at once and therefore, the air-fuel ratio of the mixture gas increases at once to approach the predetermined lean air-fuel ratio (=target air-fuel ratio) at once.

On the other hand, while the upstream detected air-fuel ratio changes from an air-fuel ratio smaller than the predetermined lean air-fuel ratio (=target air-fuel ratio) to an air-fuel ratio larger than the predetermined lean air-fuel ratio (i.e. while the upstream detected air-fuel ratio changes from an air-fuel ratio richer than the predetermined lean air-fuel ratio to an air-fuel ratio leaner than the predetermined lean air-fuel ratio and therefore, the air-fuel ratio of the mixture gas changes from an air-fuel ratio richer than the predetermined lean air-fuel ratio to an air-fuel ratio leaner than the predetermined lean air-fuel ratio), the correction coefficient Kf is increased by a relatively large value (hereinafter, this value may be referred to as—skip increase value—). Thereby, the target fuel injection amount is increased at once and therefore, the air-fuel ratio of the mixture gas decreases at once to approach the predetermined lean air-fuel ratio (=target air-fuel ratio) at once.

The skip decrease and increase values used in the lean air-fuel ratio control are set as follows. That is, while the downstream detected air-fuel ratio is larger than the predetermined lean air-fuel ratio (=target air-fuel ratio) (i.e. while the downstream detected air-fuel ratio is leaner than the predetermined lean air-fuel ratio), the skip increase value is gradually increased by a relatively small constant value (hereinafter, this value may be referred to as—predetermined correction value—).

On the other hand, while the downstream detected air-fuel ratio is smaller than the predetermined lean air-fuel ratio (=target air-fuel ratio) (i.e. while the downstream detected air-fuel ratio is richer than the predetermined lean air-fuel ratio), the skip increase value is gradually decreased by the predetermined correction value.

Then, the skip decrease value is calculated by subtracting the aforementioned calculated skip increase value from a predetermined value which is at least larger than or equal to zero (hereinafter, this value may be referred to as—reference skip value—).

When the aforementioned calculated skip increase value is smaller than the reference skip value, the reference skip value is set as the skip increase value (i.e. the skip increase value is limited to the reference skip value).

In the lean air-fuel ratio control according to the first embodiment, while the upstream detected air-fuel ratio is larger than the predetermined lean air-fuel ratio (=target air-fuel ratio), the correction coefficient is gradually increased by the constant increase value and on the other hand, while the upstream detected air-fuel ratio is smaller than the predetermined lean air-fuel ratio, the correction coefficient is gradually decreased by the constant decrease value.

In this regard, in place of this, while the upstream detected air-fuel ratio is larger than or equal to the predetermined lean air-fuel ratio (=target air-fuel ratio), the correction coefficient may be gradually increased by the constant increase value and on the other hand, while the upstream detected air-fuel ratio is smaller than the predetermined lean air-fuel ratio, the correction coefficient may be gradually decreased by the constant decrease value or while the upstream detected air-fuel ratio is larger than the predetermined lean air-fuel ratio (=target air-fuel ratio), the correction coefficient may be gradually increased by the constant increase value and on the other hand, while the upstream detected air-fuel ratio is smaller than or equal to the predetermined lean air-fuel ratio, the correction coefficient may be gradually decreased by the constant decrease value.

In the lean air-fuel ratio control according to the first embodiment, when the upstream detected air-fuel ratio changes from an air-fuel ratio larger than the predetermined lean air-fuel ratio (=target air-fuel ratio) to an air-fuel ratio smaller than the predetermined lean air-fuel ratio, the correction coefficient is decreased by the skip decrease value and on the other hand, when the upstream detected air-fuel ratio changes from an air-fuel ratio smaller than the predetermined lean air-fuel ratio to an air-fuel ratio larger than the predetermined lean air-fuel ratio, the correction coefficient is increased by the skip increase value.

In this regard, in place of this, when the upstream detected air-fuel ratio changes from an air-fuel ratio larger than or equal to the predetermined lean air-fuel ratio (=target air-fuel ratio) to an air-fuel ratio smaller than the predetermined lean air-fuel ratio, the correction coefficient may be decreased by the skip decrease value and on the other hand, when the upstream detected air-fuel ratio changes from an air-fuel ratio smaller than the predetermined lean air-fuel ratio to an air-fuel ratio larger than or equal to the predetermined lean air-fuel ratio, the correction coefficient may be increased by the skip increase value or when the upstream detected air-fuel ratio changes from an air-fuel ratio larger than the predetermined lean air-fuel ratio (=target air-fuel ratio) to an air-fuel ratio smaller than or equal to the predetermined lean air-fuel ratio, the correction coefficient may be decreased by the skip decrease value and on the other hand, when the upstream detected air-fuel ratio changes from an air-fuel ratio smaller than or equal to the predetermined lean air-fuel ratio to an air-fuel ratio larger than the predetermined lean air-fuel ratio, the correction coefficient may be increased by the skip increase value.

Further, in the lean air-fuel ratio control according to the first embodiment, while the downstream detected air-fuel ratio is larger than the predetermined lean air-fuel ratio (=target air-fuel ratio), the skip increase value is gradually increased by the predetermined correction value and on the other hand, while the downstream detected air-fuel ratio is smaller than the predetermined lean air-fuel ratio, the skip increase value is gradually decreased by the predetermined correction value.

In this regard, in place of this, while the downstream detected air-fuel ratio is larger than or equal to the predetermined lean air-fuel ratio (=target air-fuel ratio), the skip increase value may be gradually increased by the predetermined correction value and on the other hand, while the downstream detected air-fuel ratio is smaller than the predetermined lean air-fuel ratio, the skip increase value may be gradually decreased by the predetermined correction value or while the downstream detected air-fuel ratio is larger than the predetermined lean air-fuel ratio (=target air-fuel ratio), the skip increase value may be gradually increased by the predetermined correction value and on the other hand, while the downstream detected air-fuel ratio is smaller than or equal to the predetermined lean air-fuel ratio, the skip increase value may be gradually decreased by the predetermined correction value.

The constant decrease value used in the lean air-fuel ratio control may be the same as or different from the constant decrease value used in the stoichiometric air-fuel ratio control. Further, the constant increase value used in the lean air-fuel ratio control may be the same as or different from the constant increase value used in the stoichiometric air-fuel ratio control. Further, the predetermined correction value used in the lean air-fuel ratio control may be the same as or different from the predetermined correction value used in the stoichiometric air-fuel ratio control. Further, the reference skip value used in the lean air-fuel ratio control may be the same as or different from the reference skip value used in the stoichiometric air-fuel ratio control.

Next, the rich air-fuel ratio control according to the first embodiment will be described. In the following description, "a rich air-fuel ratio" means—an air-fuel ratio richer than the stoichiometric air-fuel ratio—.

According to the rich air-fuel ratio control, similar to the stoichiometric air-fuel ratio control, the target throttle valve opening degree is set and the target fuel injection amount is set according to the formulas 1 and 2. In the rich air-fuel ratio control, a predefined rich air-fuel ratio (hereinafter, this air-fuel ratio may be referred to as—predetermined rich air-fuel ratio—) is set as the target air-fuel ratio AFt in the formula 1.

Then, contract to the stoichiometric air-fuel ratio control, according to the rich air-fuel ratio control, the correction coefficient Kf in the formula 2 is set as follows. That is, while the upstream detected air-fuel ratio is larger than the predetermined rich air-fuel ratio (=target air-fuel ratio) (i.e. while the upstream detected air-fuel ratio is leaner than the predetermined rich air-fuel ratio and therefore, the air-fuel ratio of the mixture gas is leaner than the predetermined rich air-fuel ratio), the correction coefficient Kf is gradually increased by a relatively small constant value (hereinafter, this value may be referred to as—constant increase value—). Thereby, the target fuel injection amount is gradually increased and therefore, the air-fuel ratio of the mixture gas gradually decreases to approach the predetermined rich air-fuel ratio.

On the other hand, while the upstream detected air-fuel ratio is smaller than the predetermined rich air-fuel ratio (=target air-fuel ratio) (i.e. while the upstream detected air-fuel ratio is richer than the predetermined rich air-fuel ratio and therefore, the air-fuel ratio of the mixture gas is richer than the predetermined rich air-fuel ratio), the correction coefficient Kf is gradually decreased by a relatively small constant value (hereinafter, this value may be referred to as—constant decrease value—). Thereby, the target fuel injection amount is gradually decreased and therefore, the air-fuel ratio of the mixture gas gradually increases to approach the predetermined rich air-fuel ratio.

Further, while the upstream detected air-fuel ratio changes from an air-fuel ratio larger than the predetermined rich air-fuel ratio (=target air-fuel ratio) to an air-fuel ratio smaller than the predetermined rich air-fuel ratio (i.e. while the upstream detected air-fuel ratio changes from an air-fuel ratio leaner than the predetermined rich air-fuel ratio to an air-fuel ratio richer than the predetermined rich air-fuel ratio and therefore, the air-fuel ratio of the mixture gas changes from an air-fuel ratio leaner than the predetermined rich air-fuel ratio to an air-fuel ratio richer than the predetermined rich air-fuel ratio), the correction coefficient Kf is decreased by a relatively large value (hereinafter, this value may be referred to as—skip decrease value—). Thereby, the target fuel injection amount is decreased at once and therefore, the air-fuel ratio of the mixture gas increases at once to approach the predetermined rich air-fuel ratio (=target air-fuel ratio) at once.

On the other hand, while the upstream detected air-fuel ratio changes from an air-fuel ratio smaller than the predetermined rich air-fuel ratio (=target air-fuel ratio) to an air-fuel ratio larger than the predetermined rich air-fuel ratio (i.e. while the upstream detected air-fuel ratio changes from an air-fuel ratio richer than the predetermined rich air-fuel ratio to an air-fuel ratio leaner than the predetermined rich air-fuel ratio and therefore, the air-fuel ratio of the mixture gas changes from an air-fuel ratio richer than the predetermined rich air-fuel ratio to an air-fuel ratio leaner than the predetermined rich air-fuel ratio), the correction coefficient Kf is increased by a relatively large value (hereinafter, this value may be referred to as—skip increase value—). Thereby, the target fuel injection amount is increased at once and therefore, the air-fuel ratio of the mixture gas decreases at once to approach the predetermined rich air-fuel ratio (=target air-fuel ratio) at once.

The skip decrease and increase values used in the rich air-fuel ratio control are set as follows. That is, while the downstream detected air-fuel ratio is larger than the predetermined rich air-fuel ratio (=target air-fuel ratio) (i.e. while the downstream detected air-fuel ratio is leaner than the predetermined rich air-fuel ratio), the skip increase value is gradually increased by a relatively small constant value (hereinafter, this value may be referred to as—predetermined correction value—). On the other hand, while the downstream detected air-fuel ratio is smaller than the predetermined rich air-fuel ratio (=target air-fuel ratio) (i.e. while the downstream detected air-fuel ratio is richer than the predetermined rich air-fuel ratio), the skip increase value is gradually decreased by the predetermined correction value. Then, the skip decrease value is calculated by subtracting the aforementioned calculated skip increase value from a predetermined value which is at least larger than or equal to zero (hereinafter, this value may be referred to as—reference skip value—). When the aforementioned calculated skip increase value is smaller than the reference skip value, the reference skip value is set as the skip increase value (i.e. the skip increase value is limited to the reference skip value).

In the rich air-fuel ratio control according to the first embodiment, while the upstream detected air-fuel ratio is larger than the predetermined rich air-fuel ratio (=target air-fuel ratio), the correction coefficient is gradually increased by the constant increase value and on the other hand, while the upstream detected air-fuel ratio is smaller than the predetermined rich air-fuel ratio, the correction coefficient is gradually decreased by the constant decrease value.

In this regard, in place of this, while the upstream detected air-fuel ratio is larger than or equal to the predetermined rich air-fuel ratio (=target air-fuel ratio), the correction coefficient may be gradually increased by the constant increase value and on the other hand, while the upstream detected air-fuel ratio is smaller than the predetermined rich air-fuel ratio, the correction coefficient may be gradually decreased by the constant decrease value or while the upstream detected air-fuel ratio is larger than the predetermined rich air-fuel ratio (=target air-fuel ratio), the correction coefficient may be gradually increased by the constant increase value and on the other hand, while the upstream detected air-fuel ratio is smaller than or equal to the predetermined rich air-fuel ratio, the correction coefficient may be gradually decreased by the constant decrease value.

In the rich air-fuel ratio control according to the first embodiment, when the upstream detected air-fuel ratio changes from an air-fuel ratio larger than the predetermined rich air-fuel ratio (=target air-fuel ratio) to an air-fuel ratio smaller than the predetermined rich air-fuel ratio, the correction coefficient is decreased by the skip decrease value and on the other hand, when the upstream detected air-fuel ratio changes from an air-fuel ratio smaller than the predetermined rich air-fuel ratio to an air-fuel ratio larger than the predetermined rich air-fuel ratio, the correction coefficient is increased by the skip increase value.

In this regard, in place of this, when the upstream detected air-fuel ratio changes from an air-fuel ratio larger than or equal to the predetermined rich air-fuel ratio (=target air-fuel ratio) to an air-fuel ratio smaller than the predetermined rich air-fuel ratio, the correction coefficient may be decreased by the skip decrease value and on the other hand, when the upstream detected air-fuel ratio changes from an air-fuel ratio smaller than the predetermined rich air-fuel ratio to an air-fuel ratio larger than or equal to the predetermined rich air-fuel ratio, the correction coefficient may be increased by the skip increase value or when the upstream detected air-fuel ratio changes from an air-fuel ratio larger than the predetermined rich air-fuel ratio (=target air-fuel ratio) to an air-fuel ratio smaller than or equal to the predetermined rich air-fuel ratio, the correction coefficient may be decreased by the skip decrease value and on the other hand, when the upstream detected air-fuel ratio changes from an air-fuel ratio smaller than or equal to the predetermined rich air-fuel ratio to an air-fuel ratio larger than the predetermined rich air-fuel ratio, the correction coefficient may be increased by the skip increase value.

Further, in the rich air-fuel ratio control according to the first embodiment, while the downstream detected air-fuel ratio is larger than the predetermined rich air-fuel ratio (=target air-fuel ratio), the skip increase value is gradually increased by the predetermined correction value and on the other hand, while the downstream detected air-fuel ratio is smaller than the predetermined rich air-fuel ratio, the skip increase value is gradually decreased by the predetermined correction value.

In this regard, in place of this, while the downstream detected air-fuel ratio is larger than or equal to the predetermined rich air-fuel ratio (=target air-fuel ratio), the skip increase value may be gradually increased by the predetermined correction value and on the other hand, while the downstream detected air-fuel ratio is smaller than the predetermined rich air-fuel ratio, the skip increase value may be gradually decreased by the predetermined correction value or while the downstream detected air-fuel ratio is larger than the predetermined rich air-fuel ratio (=target air-fuel ratio), the skip increase value may be gradually increased by the predetermined correction value and on the other hand, while the downstream detected air-fuel ratio is smaller than or equal to the predetermined rich air-fuel ratio, the skip increase value may be gradually decreased by the predetermined correction value.

The constant decrease value used in the rich air-fuel ratio control may be the same as or different from the constant decrease value used in the stoichiometric or lean air-fuel ratio control. Further, the constant increase value used in the rich air-fuel ratio control may be the same as or different from the constant increase value used in the stoichiometric or lean air-fuel ratio control. Further, the predetermined correction value used in the rich air-fuel ratio control may be the same as or different from the predetermined correction value used in the stoichiometric or lean air-fuel ratio control. Further, the reference skip value used in the rich air-fuel ratio control may be the same as or different from the reference skip value used in the stoichiometric or lean air-fuel ratio control.

Next, a control of the throttle valve according to the first embodiment will be described. The control of the throttle valve described below is common for the stoichiometric, lean and rich air-fuel ratio controls. According to the first embodiment, during the engine operation, a control signal to be supplied to the throttle valve actuator is calculated for opening the throttle valve by the aforementioned set target throttle valve opening degree. Then, the thus calculated control signal is supplied to the throttle valve actuator. Thereby, the throttle valve is opened by the target throttle valve opening degree.

Next, a control of the fuel injector according to the first embodiment will be described. The control of the fuel injector described below is common for the stoichiometric, lean and rich air-fuel ratio controls. According to the first embodiment, during the engine operation, a command signal to be supplied to the fuel injector is calculated for inject the fuel of the aforementioned set target fuel injection amount from the fuel injector and a target fuel injection timing is set (the setting of the target fuel injection timing will be described later). Then, the thus calculated command signal is supplied to the fuel injector at the aforementioned set target fuel injection timing. Thereby, the fuel of the target fuel injection amount is injected from the fuel injector at the target fuel injection timing.

Next, the setting of the target fuel injection timing according to the first embodiment will be described. The method for setting the target fuel injection timing described below is common for the stoichiometric, lean and rich air-fuel ratio controls. According to the first embodiment, optimal fuel injection timings depending on the engine operation conditions are previously obtained by an experiment, etc. Then, these obtained fuel injection timings are memorized in the electronic control unit as base fuel injection timings Tinjb in the form of a map as a function of the engine speed NE and the required engine torque TQ as shown in FIG. 3(B). Then, during the engine operation, a base fuel injection timing Tinjb corresponding to the current engine speed NE and the current required engine torque TQ is acquired from the map of FIG. 3(B). Then, the thus acquired base fuel injection timing Tinjb is set as a target fuel injection timing.

Next, a control of the spark plug according to the first embodiment will be described. The control of the spark plug described below is common for the stoichiometric, lean and rich air-fuel ratio controls. According to the first embodiment, during the engine operation, a target ignition timing is set (the setting of the target ignition timing will be described later). Then, a command signal for activating the spark plug is supplied to the spark plug at the aforementioned set target ignition timing. Thereby, the fuel in the combustion chamber is ignited at the target ignition timing.

Next, the setting of the target ignition timing according to the first embodiment will be described. The method for setting the target ignition timing described below is common for the stoichiometric, lean and rich air-fuel ratio controls. According to the first embodiment, optimal ignition timings depending on the engine operation conditions are previously obtained by an experiment, etc. Then, these obtained ignition timings are memorized in the electronic control unit as base ignition timings Tignb in the form of a map as a function of the engine speed NE and the required engine torque TQ as shown in FIG. 3(C). Then, during the engine operation, a base ignition timing Tignb corresponding to the current engine speed NE and the current required engine torque TQ is acquired from the map of FIG. 2(C). Then, the thus acquired base ignition timing Tignb is set as a target ignition timing.

According to the first embodiment, when the active element solid solution degree is smaller than the target solid solution degree and the catalyst temperature is higher than or equal to the predetermined solid solution temperature, the lean air-fuel ratio control is performed. In this regard, in place of this, assuming that a range of the target active element solid solution degree is set as a target solid solution degree range, when the active element solid solution degree is smaller than the lower limit of the target solid solution degree range and the catalyst temperature is higher than or equal to the predetermined solid solution temperature, the lean air-fuel ratio control may be performed. In this case, when the active element solid solution degree is within the target solid solution degree range or when the active element solid solution degree is smaller than the lower limit of the target solid solution degree range and the catalyst temperature is lower than the predetermined solid solution temperature, the stoichiometric air-fuel ratio control is performed.

Further, according to the first embodiment, when the active element solid solution degree is larger than the target solid solution degree and the catalyst temperature is higher than or equal to the predetermined precipitation temperature, the rich air-fuel ratio control is performed. In this regard, in place of this, assuming that a range of the target active element solid solution degree is set as a target solid solution degree range, when the active element solid solution degree is larger than the upper limit of the target solid solution degree range and the catalyst temperature is higher than or equal to the predetermined precipitation temperature, the rich air-fuel ratio control may be performed. In this case, when the active element solid solution degree is within the target solid solution degree range or when the active element solid solution degree is larger than the upper limit of the target solid solution degree range and the catalyst temperature is lower than the predetermined precipitation temperature, the stoichiometric air-fuel ratio control is performed.

According to the first embodiment, the following effect can be obtained. That is, during the engine operation, the catalyst temperature may become higher than or equal to the predetermined solid solution temperature or the predetermined precipitation temperature and the catalyst inflow exhaust air-fuel ratio (i.e. the air-fuel ratio of the exhaust gas flowing into the catalyst) may become leaner or richer than the stoichiometric air-fuel ratio and as a result, the atmosphere in the catalyst may become the oxidation atmosphere or the reduction atmosphere.

In this regard, the catalyst of the first embodiment has a property in which the active element transforms as a solid solution in the carrier when the catalyst temperature is higher than or equal to the predetermined solid solution temperature and the atmosphere in the catalyst is the oxidation atmosphere and the active element precipitates from the carrier when the catalyst temperature is higher than or equal to the predetermined precipitation temperature and the atmosphere in the catalyst is the reduction atmosphere.

Therefore, there is a possibility that the transformation of the active element as a solid solution in the carrier and the precipitation of the active element from the carrier occur repeatedly in the catalyst during the engine operation. That is, the amount of the precipitated active element (i.e. the active element having precipitated from the carrier) changes due to the change of the catalyst temperature and the catalyst inflow exhaust air-fuel ratio during the engine operation and therefore, the purification ability of the catalyst (i.e. the ability of the catalyst to purify the components in the exhaust gas) changes.

Further, when the active element usage degree (i.e. the degree of the usage of the active element in the activation of the components in the exhaust gas) increases, the active element may deteriorate and as a result, the activation ability of the active element (i.e. the ability of the active element to increase the oxidation reaction activation or the reduction reaction activation of the components in the exhaust gas) may decrease. In other words, when the catalyst usage degree (i.e. the degree of the usage of the catalyst in the purification of the components in the exhaust gas) increases, the purification ability of the catalyst may decrease. That is, the purification ability of the catalyst changes due to the change of the activation ability of the active element during the engine operation.

Therefore, in order to demonstrate the desired property of the engine, it is necessary to structure the control logic used for the engine control (i.e. the control of the engine) and perform the engine control so as to demonstrate the desired property of the engine in consideration of the change of the purification ability of the catalyst during the engine operation. In this regard, the change of the purification ability of the catalyst during the engine operation varies depending on the manner of the engine operation and the catalyst usage degree and therefore, the structuring of the control logic and the performance of the engine control as described above are cumbersome. On the other hand, if the change of the purification ability of the catalyst is within the assumed range, independently of the manner of the engine operation and the catalyst usage degree, the control logic can be structured relatively easily and the engine control can be performed relatively easily.

According to the first embodiment, when the active element solid solution degree is smaller than the target solid solution degree and the catalyst temperature is higher than or equal to the predetermined solid solution temperature, the catalyst inflow exhaust air-fuel ratio is controlled to an air-fuel ratio leaner than the stoichiometric air-fuel ratio. Thereby, when the catalyst temperature is higher than or equal to the predetermined solid solution temperature, the atmosphere in the catalyst becomes the oxidation atmosphere and therefore, the precipitated active element transforms as a solid solution in the carrier and as a result, the active element solid solution degree increases.

On the other hand, according to the first embodiment, when the active element solid solution degree is larger than the target solid solution degree and the catalyst temperature is higher than or equal to the predetermined precipitation temperature, the catalyst inflow exhaust air-fuel ratio is controlled to an air-fuel ratio richer than the stoichiometric air-fuel ratio. Thereby, when the catalyst temperature is higher than or equal to the predetermined precipitation temperature, the atmosphere in the catalyst becomes the reduction atmosphere and therefore, the solid solution active element precipitates from the carrier and as a result, the active element solid solution degree decreases.

Thus, the active element solid solution degree is controlled to the target solid solution degree. Thereby, the amount of the precipitated active element is maintained constant and therefore, the purification ability of the catalyst during the engine operation can be assumed easily. Thus, according to the first embodiment, the effect that the control logic used for the engine control can be structured relatively easily and the engine control can be performed relatively easily, can be obtained.

Further, the amount of the precipitated active element is maintained constant and then, the purification ability of the catalyst during the engine operation is maintained constant and therefore, a large gain relating to the air-fuel ratio control on the basis of the downstream detected air-fuel ratio, in particular, large skip decrease and increase values controlled on the basis of the downstream detected air-fuel ratio can be employed and thus, the effect that the robustness increases can be obtained.

Figure 4:
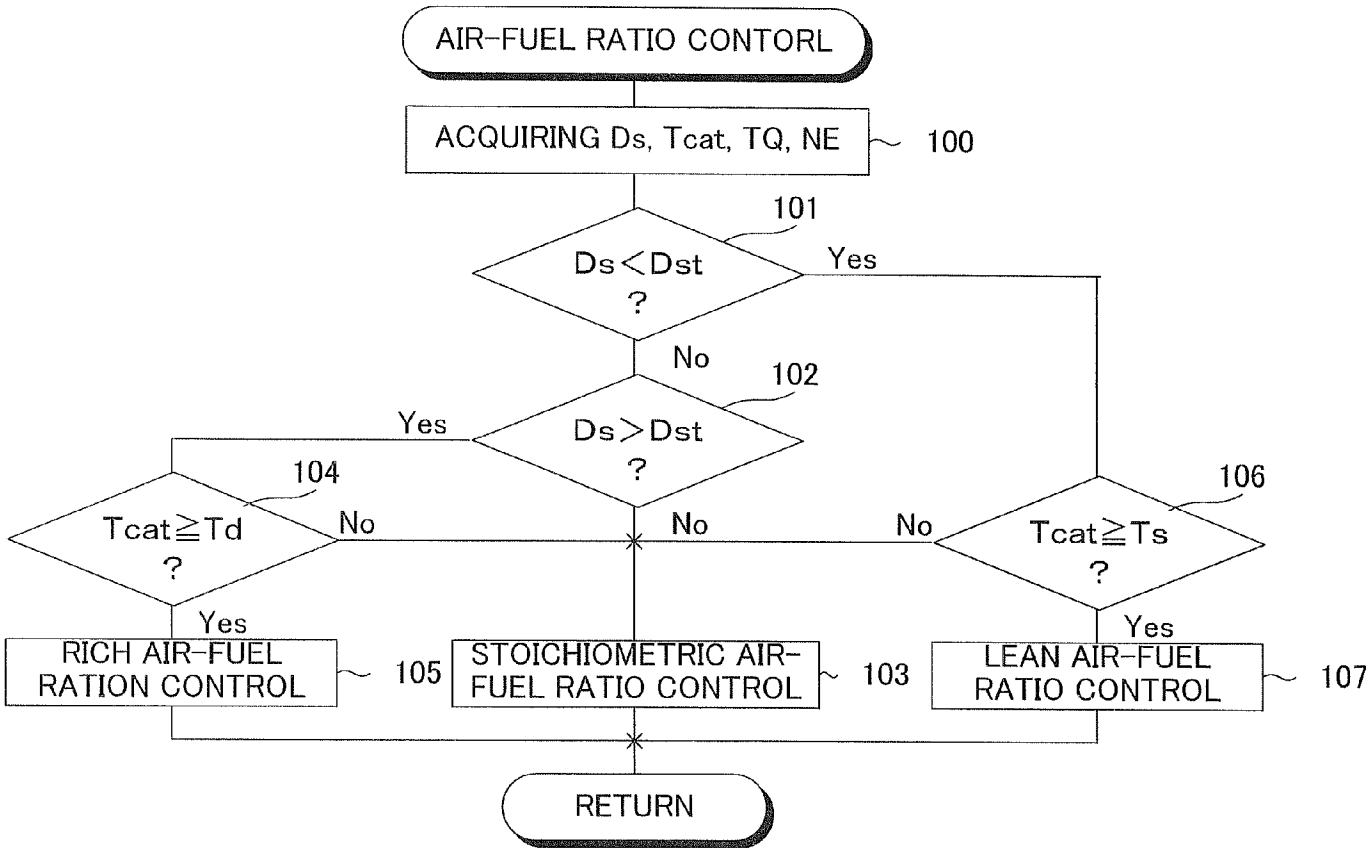
FIG. 4 is a view showing an example of a routine for performing an air-fuel ratio control according to the first embodiment.

Next, an example of a routine for performing the air-fuel ratio control according to the first embodiment will be described. This example of the routine is shown in FIG. 4. The routine of FIG. 4 starts every a predetermined time has elapsed.

When the routine of FIG. 4 starts, first, at the step 100, the current active element solid solution Ds, the current catalyst temperature Tcat, the current required engine torque TQ and the current engine speed NE are acquired. Next, at the step 101, it is judged if the active element solid solution degree Ds acquired at the step 100 is smaller than the target solid solution degree Dst (Ds<Dst). In this regard, when it is judged that Ds<Dst, the routine proceeds to the step 106. On the other hand, when it is not judged that Ds<Dst, the routine proceeds to the step 102.

When it is judged that Ds<Dst at the step 101 and then, the routine proceeds to the step 106, it is judged if the catalyst temperature Tcat acquired at the step 100 is higher than or equal to the predetermined solid solution temperature Ts (Tcat≥Ts). In this regard, when it is judged that Tcat≥Ts, the routine proceeds to the step 107 where the lean air-fuel ratio control is performed and then, the routine ends. On the other hand, when it is not judged that Tcat≥Ts, the routine proceeds to the step 103 where the stoichiometric air-fuel ratio control is performed and then, the routine ends.

When it is not judged that Ds<Dst at the step 101 and then, the routine proceeds to the step 102, it is judged if the active element solid solution degree Ds acquired at the step 100 is larger than the target solid solution degree Dst (Ds>Dst). In this regard, when it is judged that Ds>Dst, the routine proceeds to the step 104. On the other hand, when it is not judged that Ds>Dst, the routine proceeds to the step 103 where the stoichiometric air-fuel ratio control is performed and then, the routine ends.

When it is judged that Ds>Dst at the step 102 and then, the routine proceeds to the step 104, it is judged if the catalyst temperature Tcat acquired at the step 100 is higher than or equal to the predetermined precipitation temperature Td (Tcat≥Td). In this regard, when it is judged that Tcat≥Td, the routine proceeds to the step 105 where the rich air-fuel ratio control is performed and then, the routine ends. On the other hand, when it is not judged that Tcat≥Td, the routine proceeds to the step 103 where the stoichiometric air-fuel ratio control is performed and then, the routine ends.

Figure 5:
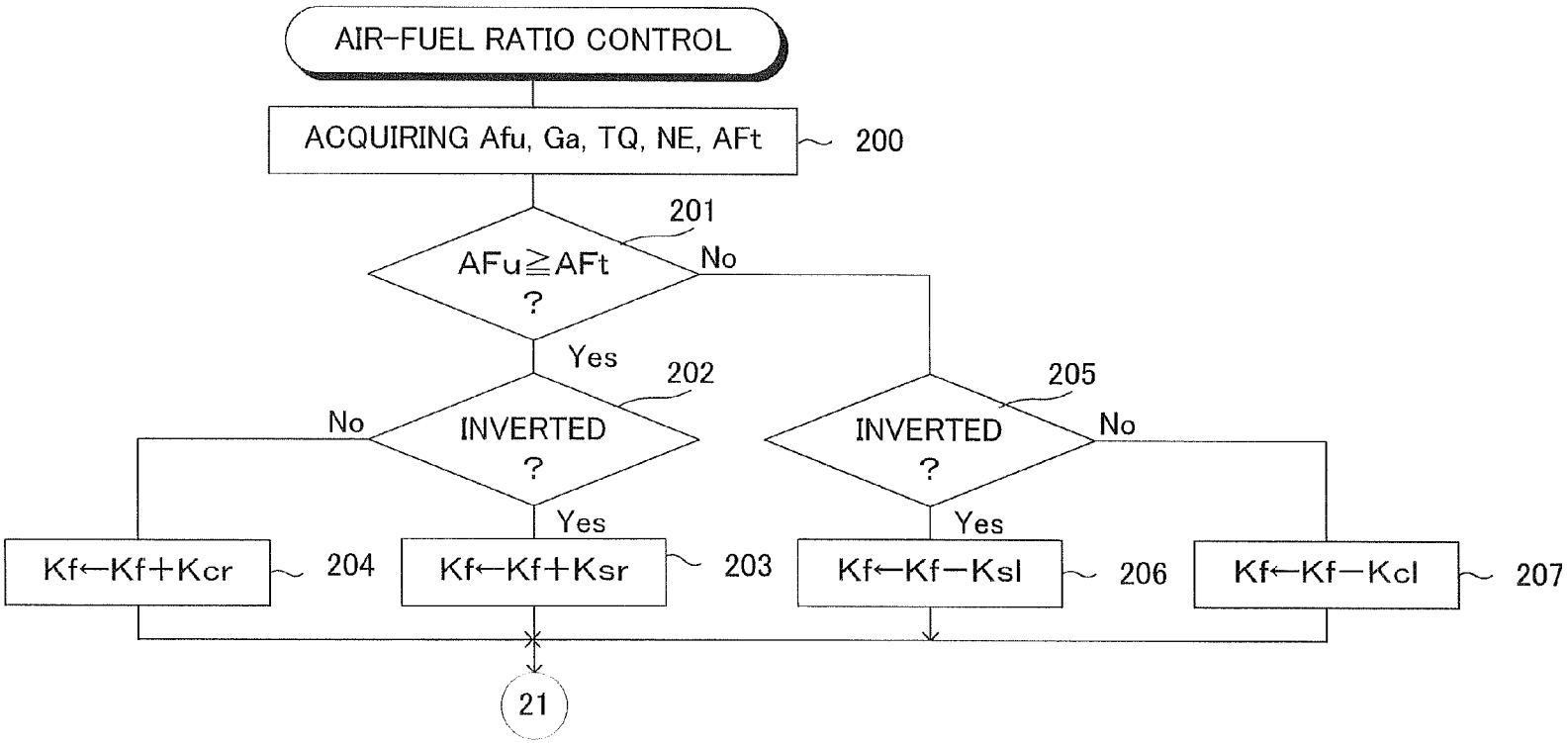
FIG. 5 is a view showing a part of an example of a routine for performing a stoichiometric air-fuel ratio control, a lean air-fuel ratio control and a rich air-fuel ratio control according to the first embodiment.
Figure 6:
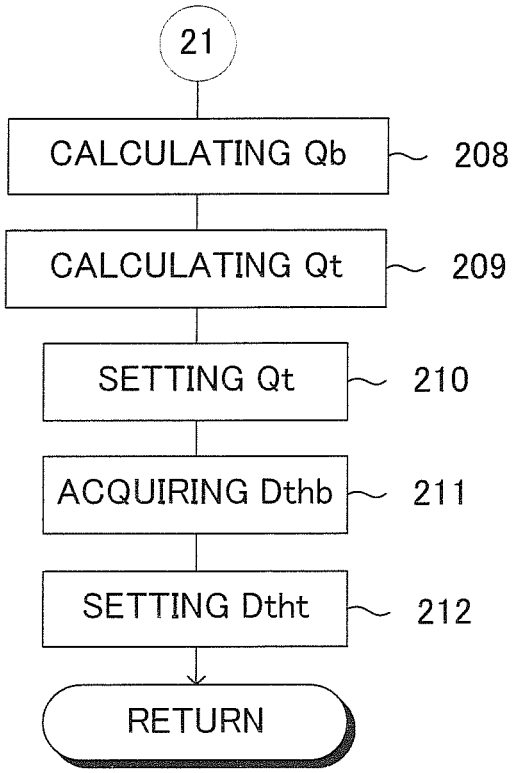
FIG. 6 is a view showing another part of the example of the routine for performing the stoichiometric air-fuel ratio control, the lean air-fuel ratio control and the rich air-fuel ratio control according to the first embodiment.

Next, an example of a routine for performing the stoichiometric, lean and rich air-fuel ratio controls according to the first embodiment will be described. This example of the routine is shown in FIGS. 5 and 6. The routine of FIGS. 5 and 6 is performed when the judgement if the active element solid solution degree is smaller than the target solid solution degree and the catalyst temperature is higher than or equal to the predetermined solid solution temperature is completed or when the judgement if the active element solid solution degree is larger than the target solid solution degree and the catalyst temperature is higher than or equal to the predetermined precipitation temperature is completed and for example, is performed at the step 103 or 105 or 107 of FIG. 4.

When the routine of FIGS. 5 and 6 starts, first, at the step 200, the current upstream detected air-fuel ratio AFu, the current intake air amount Ga, the current required engine torque TQ, the current engine speed NE and the current target air-fuel ratio AFt are acquired.

In this regard, the acquired target air-fuel ratio AFt is the stoichiometric air-fuel ratio when the stoichiometric air-fuel ratio control is performed (i.e. when the active element solid solution degree corresponds to the target solid solution degree or when the active element solid solution degree is smaller than the target solid solution degree and the catalyst temperature is lower than the predetermined solid solution temperature or when the active element solid solution degree is larger than the target solid solution degree and the catalyst temperature is lower than the predetermined precipitation temperature), the acquired target air-fuel ratio AFt is the predetermined lean air-fuel ratio when the lean air-fuel ratio control is performed (i.e. when the active element solid solution degree is smaller than the target solid solution degree and the catalyst temperature is higher than or equal to the predetermined solid solution temperature) and the acquired target air-fuel ratio AFt is the predetermined rich air-fuel ratio when the rich air-fuel ratio control is performed (i.e. when the active element solid solution degree is larger than the target solid solution degree and the catalyst temperature is higher than or equal to the predetermined precipitation temperature).

Next, at the step 201, it is judged if the upstream detected air-fuel ratio AFu acquired at the step 200 is larger than or equal to the target air-fuel ratio AFt acquired at the step 200 (AFu≥AFt). In this regard, when it is judged that AFu≥AFt, the routine proceeds to the step 202. On the other hand, when it is not judged that AFu≥AFt, the routine proceeds to the step 205.

When it is judged that AFu≥AFt at the step 201 and then, the routine proceeds to the step 202, it is judged if the present time is immediately after the upstream detected air-fuel ratio inverts (i.e. it is judged if the process of the step 202 at this time is first performed after the upstream detected air-fuel ratio changes from an air-fuel ratio smaller than the target air-fuel ratio to an air-fuel ratio larger than or equal to the target air-fuel ratio). In this regard, when it is judged that the present time is immediately after the upstream detected air-fuel ratio inverts, the routine proceeds to the step 203 where a new correction coefficient Kf is calculated by adding the step increase value Ksr to the present correction coefficient Kf and then, the routine proceeds to the step 208. On the other hand, when it is not judged that the present time is immediately after the upstream detected air-fuel ratio inverts, the routine proceeds to the step 204 where a new correction coefficient Kf is calculated by adding the constant increase value Kcr to the present correction coefficient Kf and then, the routine proceeds to the step 208.

When it is not judged that AFu≥AFt at the step 201 and then, the routine proceeds to the step 205, it is judged if the present time is immediately after the upstream detected air-fuel ratio inverts (i.e. it is judged if the process of the step 208 at this time is first performed after the upstream detected air-fuel ratio changes from an air-fuel ratio larger than or equal to the target air-fuel ratio to an air-fuel ratio smaller than the target air-fuel ratio). In this regard, when it is judged that the present time is immediately after the upstream detected air-fuel ratio inverts, the routine proceeds to the step 206 where a new correction coefficient Kf is calculated by subtracting the step decrease value Ksl from the present correction coefficient Kf and then, the routine proceeds to the step 208. On the other hand, when it is not judged that the present time is immediately after the upstream detected air-fuel ratio inverts, the routine proceeds to the step 207 where a new correction coefficient Kf is calculated by subtracting the constant decrease value Kcl from the present correction coefficient Kf and then, the routine proceeds to the step 208.

At the step 208, the base fuel injection amount Qb is calculated by applying the intake air amount Ga, the engine speed NE and the target air-fuel ratio AFt acquired at the step 200 to the formula 1.

Next, at the step 209, in the case that the routine proceeds to the step 209 via the step 203, the target fuel injection amount Qt is calculated by applying the new correction coefficient Kf calculated at the step 203 and the base fuel injection amount Qb calculated at the step 208 to the formula 2, in the case that the routine proceeds to the step 209 via the step 204, the target fuel injection amount Qt is calculated by applying the new correction coefficient Kf calculated at the step 204 and the base fuel injection amount Qb calculated at the step 208 to the formula 2, in the case that the routine proceeds to the step 209 via the step 206, the target fuel injection amount Qt is calculated by applying the new correction coefficient Kf calculated at the step 206 and the base fuel injection amount Qb calculated at the step 208 to the formula 2 and in the case that the routine proceeds to the step 209 via the step 207, the target fuel injection amount Qt is calculated by applying the new correction coefficient Kf calculated at the step 207 and the base fuel injection amount Qb calculated at the step 208 to the formula 2, Next, at the step 210, the target fuel injection amount Qt calculated at the step 209 is set as the target fuel injection amount Qt. Next, at the step 211, the base throttle valve opening degree Dthb is acquired from the map of FIG. 3(A), using the required engine torque TQ and the engine speed NE acquired at the step 200. Next, at the step 212, the base throttle vale opening degree Dthb acquired at the step 211 is set as the target throttle valve opening degree Dtht and then, the routine ends.

Figure 7:
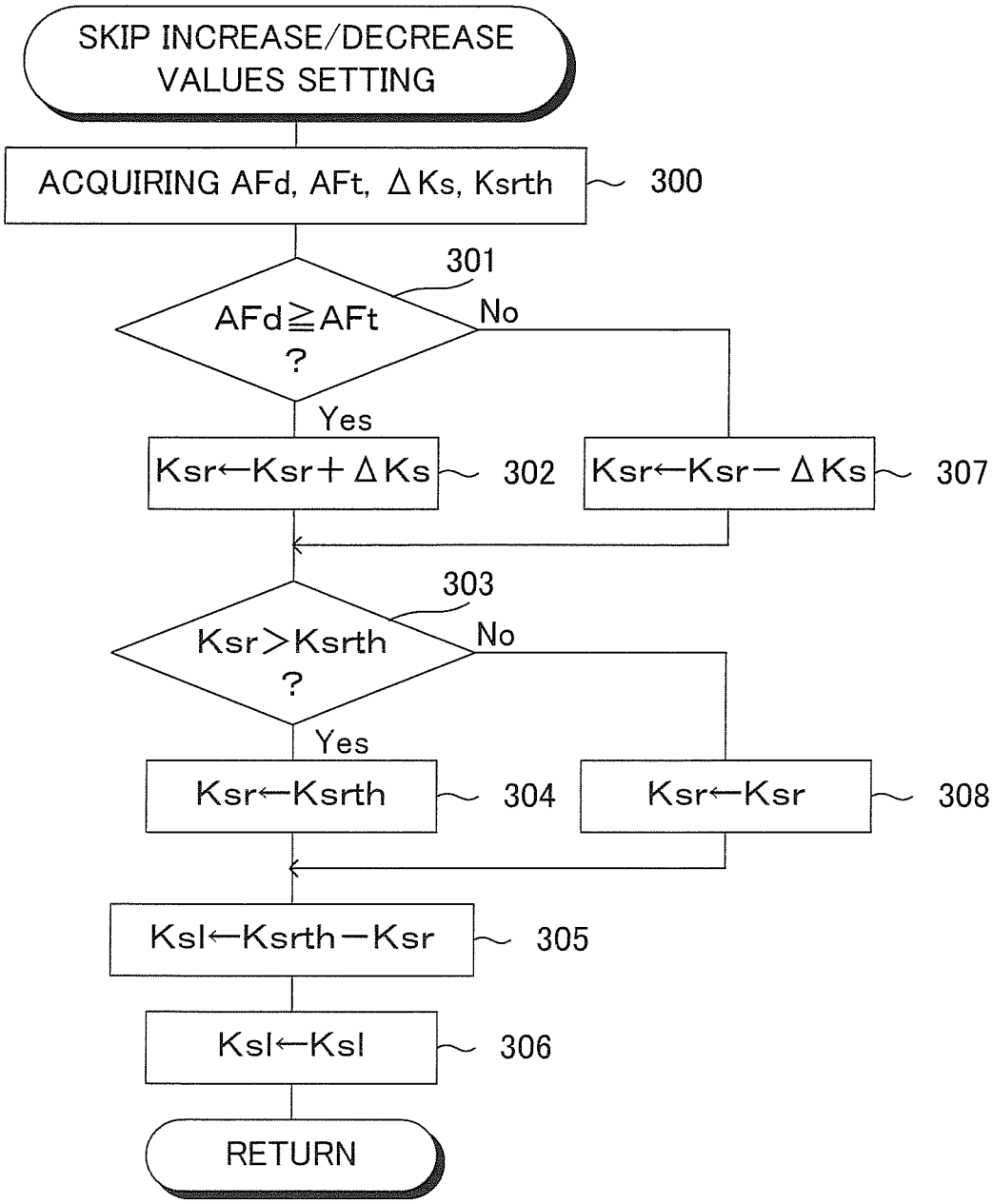
FIG. 7 is a view showing an example of a routine for performing a setting of a skip increase value and a skip decrease value according to the first embodiment.

Next, an example of a routine for performing the setting of the skip increase and decrease values according to the first embodiment will be described. This example of the routine is shown in FIG. 7. The routine of FIG. 7 starts every a predetermined time has elapsed.

When the routine of FIG. 7 starts, first, at the step 300, the current downstream detected air-fuel ratio AFd, the current target air-fuel ratio AFt, the current predetermined correction value ΔKs and the current reference step value Ksrth are acquired.

In this regard, the acquired target air-fuel ratio AFt is the stoichiometric air-fuel ratio when the stoichiometric air-fuel ratio control is performed (i.e. when the active element solid solution degree corresponds to the target solid solution degree or when the active element solid solution degree is smaller than the target solid solution degree and the catalyst temperature is lower than the predetermined solid solution temperature or when the active element solid solution degree is larger than the target solid solution degree and the catalyst temperature is lower than the predetermined precipitation temperature), the acquired target air-fuel ratio AFt is the predetermined lean air-fuel ratio when the lean air-fuel ratio control is performed (i.e. when the active element solid solution degree is smaller than the target solid solution degree and the catalyst temperature is higher than or equal to the predetermined solid solution temperature) and the acquired target air-fuel ratio AFt is the predetermined rich air-fuel ratio when the rich air-fuel ratio control is performed (i.e. when the active element solid solution degree is larger than the target solid solution degree and the catalyst temperature is higher than or equal to the predetermined precipitation temperature).

Further, the predetermined correction value ΔKs acquired at the step 300 is the predetermined correction value to be used in the stoichiometric air-fuel ratio when the stoichiometric air-fuel ratio control is performed, the predetermined correction value ΔKs acquired at the step 300 is the predetermined correction value to be used in the lean air-fuel ratio when the lean air-fuel ratio control is performed and the predetermined correction value ΔKs acquired at the step 300 is the predetermined correction value to be used in the rich air-fuel ratio when the rich air-fuel ratio control is performed.

Further, the reference skip value Ksrth acquired at the step 300 is the reference skip value to be used in the stoichiometric air-fuel ratio when the stoichiometric air-fuel ratio control is performed, the reference skip value Ksr acquired at the step 300 is the reference skip value to be used in the lean air-fuel ratio when the lean air-fuel ratio control is performed and the reference skip value Ksrth acquired at the step 300 is the reference skip value to be used in the rich air-fuel ratio when the rich air-fuel ratio control is performed.

Next, at the step 301, it is judged if the downstream detected air-fuel ratio AFd acquired at the step 300 is larger than or equal to the target air-fuel ratio AFt (AFd≥AFt). In this regard, when it is judged that AFd≥AFt, the routine proceeds to the step 302 where a new skip increase value Ksr is calculated by adding the predetermined correction value ΔKs to the current skip increase value Ksr and then, the routine proceeds to the step 303. On the other hand, when it is not judged that AFd≥AFt, the routine proceeds to the step 307 where a new skip increase value Ksr is calculated by subtracting the predetermined correction value ΔKs from the current skip increase value Ksr and then, the routine proceeds to the step 303.

At the step 303, in the case that the routine proceeds to the step 303 from the step 302, it is judged if the new skip increase value Ksr calculated at the step 302 is larger than the reference skip value Ksrth acquired at the step 300 (Ksr>Ksrth) and in the case that the routine proceeds to the step 303 from the step 307, it is judged if the new skip increase value Ksr calculated at the step 307 is larger than the reference skip value Ksrth acquired at the step 300 (Ksr>Ksrth). In this regard, when it is judged that Ksr>Ksrth, the routine proceeds to the step 304 where the reference skip value Ksrth is set as the skip increase value Ksr and then, the routine proceeds to the step 305. On the other hand, when it is not judged that Ksr>Ksrth, the routine proceeds to the step 308 and in the case that the routine proceeds to the step 308 via the step 302, the skip increase value Ksr calculated at the step 302 is set directly as the skip increase value Ksr and in the case that the routine proceeds to the step 308 via the step 307, the skip increase value Ksr calculated at the step 307 is set directly as the skip increase value Ksr and then, the routine proceeds to the step 305.

At the step 305, in the case that the routine proceeds to the step 305 from the step 304, the skip decrease value Ksl is calculated by subtracting the skip increase value Ksr set at the step 304 from the reference skip value Ksrth acquired at the step 300 and in the case that the routine proceeds to the step 305 from the step 308, the skip decrease value Ksl is calculated by subtracting the skip increase value Ksr set at the step 308 from the reference skip value Ksrth acquired at the step 300. Next, at the step 306, the skip decrease value Ksl calculated at the step 305 is set directly as the skip decrease value Ksl.

Figure 8:
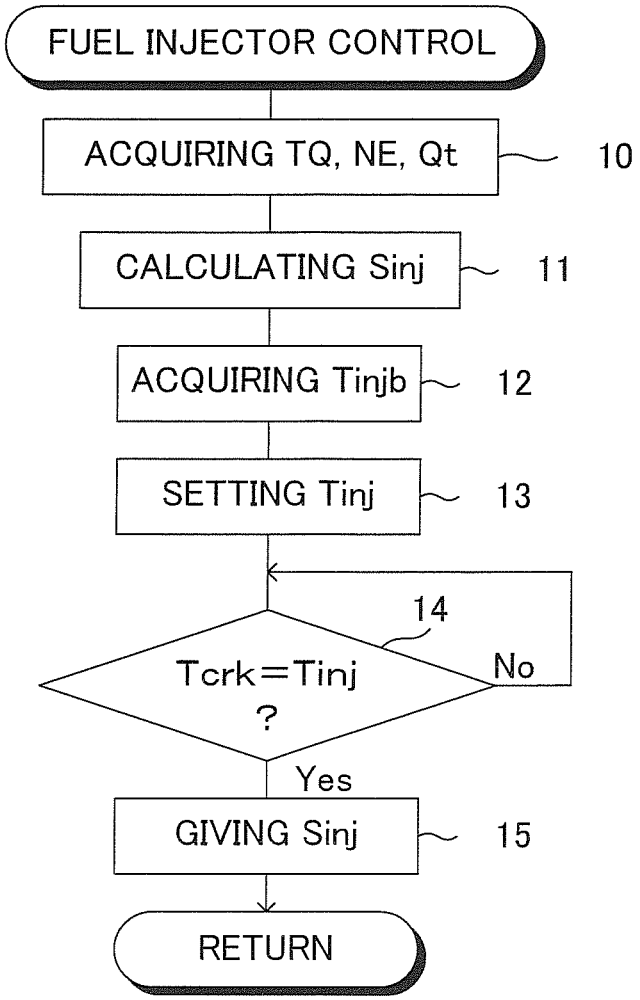
FIG. 8 is a view showing an example of a routine for performing a control of a fuel injector according to the first embodiment.

Next, an example of a routine for performing the control of the fuel injector according to the first embodiment will be described. This example of the routine is shown in FIG. 8. The routine of FIG. 8 starts every a predetermined time has elapsed.

When the routine of FIG. 8 starts, first, at the step 10, the current required engine torque TQ, the current engine speed NE and the current target fuel injection amount Qt are acquired. In this regard, the acquired target fuel injection amount Qt is, for example, the target fuel injection amount set at the step 210 of FIG. 6. Next, at the step 11, the control signal Sinj to be supplied to the fuel injector is calculated for injecting the fuel of the target fuel injection amount Qt acquired at the step 10 from the fuel injector. Next, at the step 12, the base fuel injection timing Tinjb is acquired from the map of FIG. 3(B) on the basis of the required engine torque TQ and the engine speed NE acquired at the step 10. Next, at the step 13, the base fuel injection timing Tinjb acquired at the step 12 is set as the target fuel injection timing Tinj.

Next, at the step 14, it is judged if the present time Tcrk is the target fuel injection timing Tinj set at the step 13 (Tcrk=Tinj). In this regard, when it is judged that Tcrk=Tinj, the routine proceeds to the step 15 where the control signal Sinj calculated at the step 11 is supplied to the fuel injector and then, the routine ends. On the other hand, when it is not judged that Tcrk=Tinj at the step 14, the process of the step 14 is performed again. That is, in this routine, the process of the step 14 is repeatedly performed until it is judged that Tcrk=Tinj at the step 14.

Figure 9:
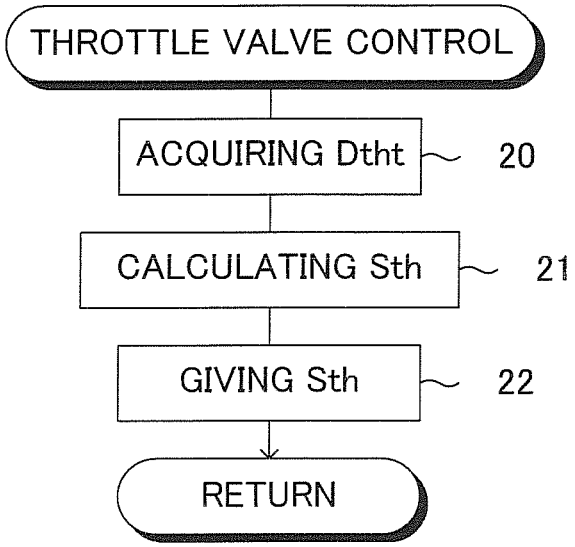
FIG. 9 is a view showing an example of a routine for performing a control of a throttle valve according to the first embodiment.

Next, an example of a routine for performing the control of the throttle valve according to the first embodiment will be described. This example of the routine is shown in FIG. 9. The routine of FIG. 9 starts every a predetermined time has elapsed.

When the routine of FIG. 9 starts, first, at the step 20, the current target throttle valve opening degree Dtht is acquired. In this regard, the acquired target throttle valve opening degree Dtht is, for example, the target throttle valve opening degree set at the step 212 of FIG. 6. Next, at the step 21, the control signal Sth to be supplied to the throttle valve actuator is calculated for accomplishing the target throttle valve opening degree acquired at the step 20. Next, at the step 22, the control signal Sth calculated at the step 21 is supplied to the throttle valve actuator and then, the routine ends.

Figure 10:
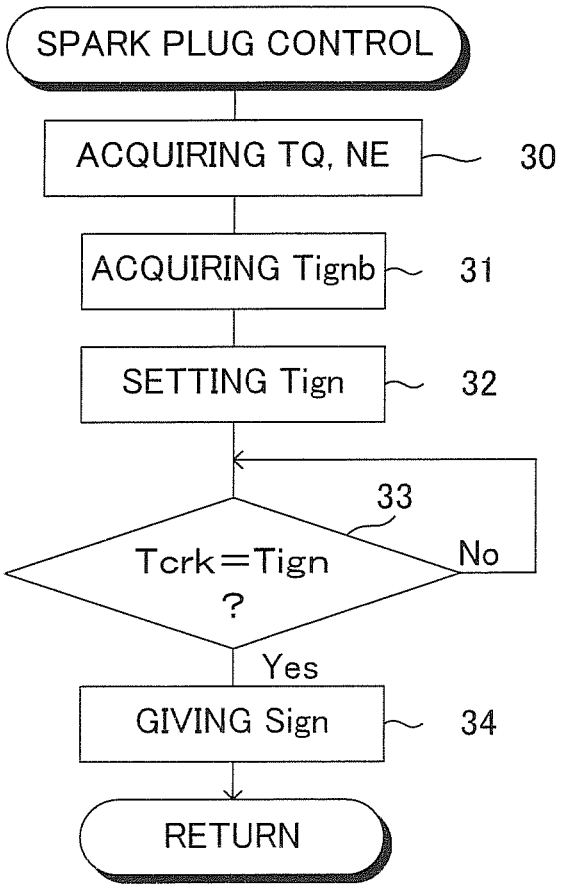
FIG. 10 is a view showing an example of a routine for performing a control of a spark plug according to the first embodiment.

Next, an example of a routine for performing the control of the spark plug according to the first embodiment will be described. This example of the routine is shown in FIG. 10. The routine of FIG. 10 starts every a predetermined time has elapsed.

When the routine of FIG. 10 starts, first, at the step 30, the current required engine torque TQ and the current engine speed NE are acquired. Next, at the step 31, the base ignition timing Tignb is acquired from the map of FIG. 3(C) on the basis of the required engine torque TQ and the engine speed NE acquired at the step 30. Next, at the step 32, the base ignition timing Tignb acquired at the step 31 is set as the target ignition timing Tign.

Next, at the step 33, it is judged if the present time Tcrk is the target ignition timing Tign set at the step 32 (Tcrk=Tign). In this regard, when it is judged that Tcrk=Tign, the routine proceeds to the step 34 where the command signal Sign for activating the spark plug is supplied to the spark plug and then, the routine ends. On the other hand, when it is not judged that Tcrk=Tign at the step 33, the process of the step 33 is performed again. That is, in this routine, the process of the step 33 is repeatedly performed until it is judged that Tcrk=Tign at the step 33.

Next, the second embodiment will be described. The constitution and controls of the second embodiment not described below are the same as those of the aforementioned embodiment or are those derived naturally from the technical concept of the invention embodied in the second embodiment. Further, as far as no contradiction occurs, the controls of the aforementioned embodiment may be combined with those of the second embodiment.

In the second embodiment, the stoichiometric air-fuel ratio control and a fuel cut control can be selectively performed. In this regard, the stoichiometric air-fuel ratio control is the same as that according to the first embodiment. Further, the fuel cut control is a control for setting zero as the target fuel injection amount such that the fuel injection amount becomes zero when the engine operation condition is within a particular engine operation condition range (hereinafter, this range may be referred to as—fuel cut permission range—).

Then, according to the second embodiment, when the active element solid solution degree corresponds to the target solid solution degree or when the active element solid solution degree is smaller than the target solid solution degree and the catalyst temperature is lower than the predetermined solid solution temperature or when the active element solid solution degree is larger than the target solid solution degree and the catalyst temperature is lower than the predetermined precipitation temperature, a base range of the engine operation condition (hereinafter, this range may be referred to as—base fuel cut permission range—) is set as the fuel cut permission range.

Further, when the active element solid solution degree is smaller than the target solid solution degree and the catalyst temperature is higher than or equal to the predetermined solid solution temperature, a range of the engine operation condition larger than the base fuel cut permission range (hereinafter, this range may be referred to as—enlarged fuel cut permission range—) is set as the fuel cut permission range.

Further, when the active element solid solution degree is larger than the target solid solution degree and the catalyst temperature is higher than or equal to the predetermined precipitation temperature, a range of the engine operation condition smaller than the base fuel cut permission range (hereinafter, this range may be referred to as—reduced fuel cut permission range—) is set as the fuel cut permission range.

Then, during the engine operation, when the engine operation condition is not within the aforementioned set fuel cut permission range, the stoichiometric air-fuel ratio control is performed. On the other hand, during the engine operation, when the engine operation condition is within the aforementioned set fuel cut permission range, the fuel cut control is performed.

According to the second embodiment, when the active element solid solution degree is larger than the target solid solution degree and the catalyst temperature is higher than or equal to the predetermined precipitation temperature, no fuel cut permission range is set. In this case, the performance of the fuel cut control is forbidden.

Further, the engine operation condition defining the fuel cut permission range of the second embodiment is, for example, defined by the combination of the required engine torque and the engine speed. In this case, a range defined by the engine operation conditions in which the required engine torque and the engine speed are relatively small and therefore, there is less need to supply the fuel into the combustion chamber is set as the base fuel cut permission range.

According to the second embodiment, the following effect can be obtained. That is, according to the second embodiment, when the active element solid solution degree is smaller than the target solid solution and the catalyst temperature is higher than or equal to the predetermined solid solution temperature, the enlarged fuel cut permission range larger than the base fuel cut permission range is set as the fuel cut permission range.

Thereby, compared with the case that the base fuel cut permission range is set as the fuel cut permission range, the frequency of the performance of the fuel cut control increases. In addition, in the fuel cut control, zero is set as the target fuel injection amount and as a result, the fuel injection amount becomes zero and therefore, the catalyst inflow exhaust air-fuel ratio becomes leaner than the stoichiometric air-fuel ratio.

Thereby, the atmosphere in the catalyst becomes the oxidation atmosphere and therefore, if the catalyst temperature becomes higher than or equal to the predetermined solid solution temperature at this time, the precipitated active element transforms as a solid solution into the carrier and as a result, the active element solid solution degree increases. That is, by setting the enlarged fuel cut permission range larger than the base fuel cut permission range as the fuel cut permission range, the opportunity of the precipitated active element transforming as a solid solution into the carrier increases and as a result, the opportunity of the increase of the active element solid solution degree increases.

Therefore, totally, when the active element solid solution degree is smaller than the target solid solution degree and the catalyst temperature is higher than or equal to the predetermined solid solution temperature, the catalyst inflow exhaust air-fuel ratio is controlled to an air-fuel ratio leaner than the stoichiometric air-fuel ratio and therefore, the active element solid solution degree increases.

On the other hand, according to the second embodiment, when the active element solid solution degree is larger than the target solid solution and the catalyst temperature is higher than or equal to the predetermined precipitation temperature, the reduced fuel cut permission range smaller than the base fuel cut permission range is set as the fuel cut permission range. Thereby, compared with the case that the base fuel cut permission range is set as the fuel cut permission range, the frequency of the performance of the fuel cut control decreases and therefore, the opportunity that the catalyst inflow exhaust air-fuel ratio becomes leaner than the stoichiometric air-fuel ratio decreases. In other words, the opportunity that the catalyst inflow exhaust air-fuel ratio becomes richer than the stoichiometric air-fuel ratio increases.

If the catalyst inflow exhaust air-fuel ratio becomes richer than the stoichiometric air-fuel ratio, the atmosphere in the catalyst becomes the reduction atmosphere and therefore, if the catalyst temperature becomes higher than or equal to the predetermined precipitation temperature at this time, the active element having transformed as a solid solution precipitates from the carrier and as a result, the active element solid solution degree decreases. That is, by setting the reduced fuel cut permission range smaller than the base fuel cut permission range as the fuel cut permission range, the opportunity that the active element having transformed as a solid solution precipitates from the carrier increases and as a result, the opportunity of the decrease of the active element solid solution degree increases.

Therefore, totally, when the active element solid solution degree is larger than the target solid solution degree and the catalyst temperature is higher than or equal to the predetermined precipitation temperature, the catalyst inflow exhaust air-fuel ratio is controlled to an air-fuel ratio richer than the stoichiometric air-fuel ratio and therefore, the active element solid solution degree decreases.

Thus, according to the second embodiment, the active element solid solution degree is controlled to the target solid solution degree. Thereby, the amount of the precipitated active element is maintained constant and therefore, the purification ability of the catalyst during the engine operation can be easily assumed. Thus, according to the second embodiment, the effect that the control logic used for the engine control can be relatively easily structured and the engine control can be relatively easily performed can be obtained.

In addition, the enlargement and reduction of the fuel cut permission range used for the control of the active element solid solution degree according to the second embodiment is a relatively simple control. Therefore, according to the second embodiment, the effect that the active element solid solution degree can be relatively easily controlled to the target solid solution degree can be obtained.

Figure 11:
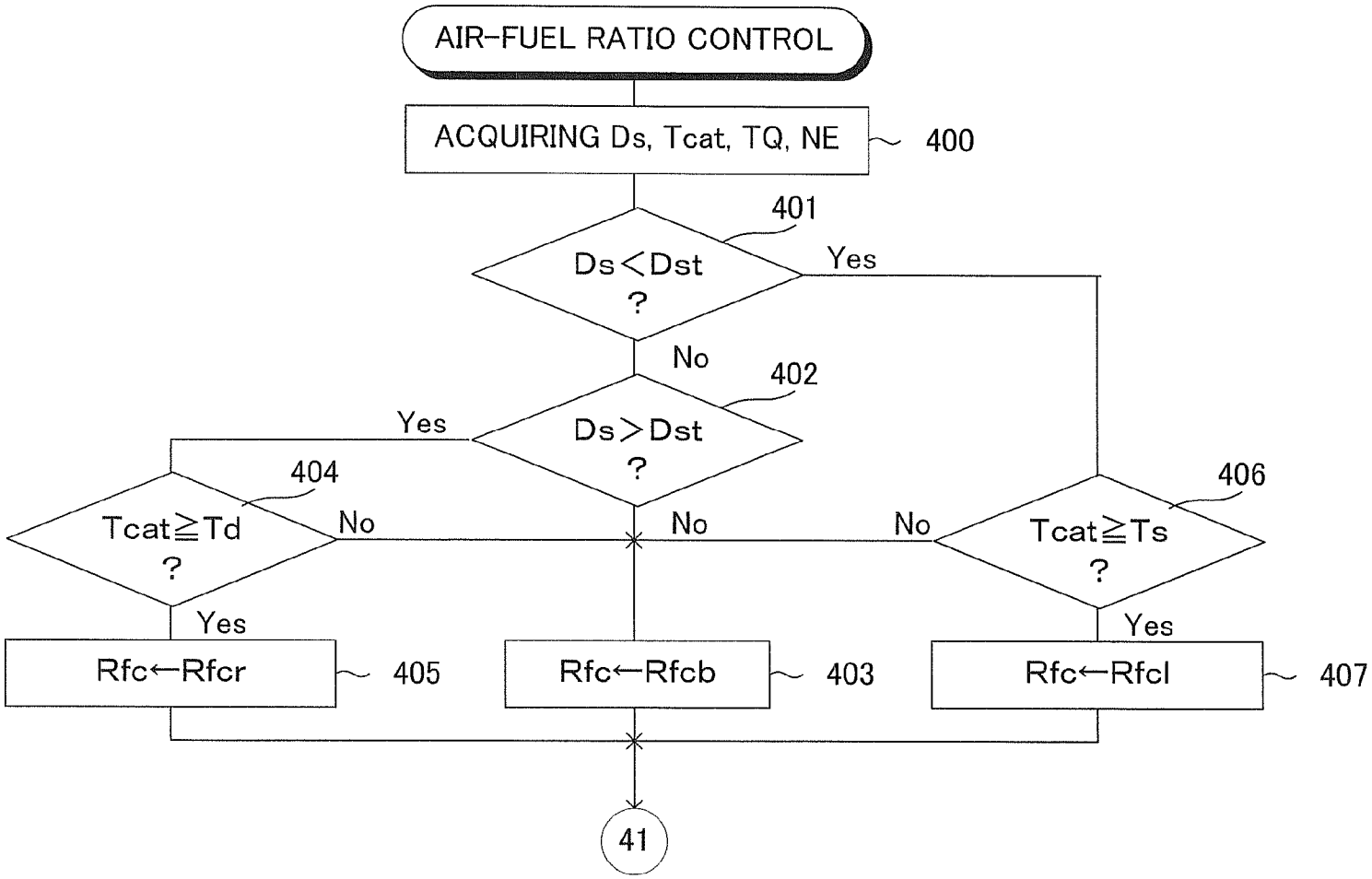
FIG. 11 is a view showing a part of an example of a routine for performing an air-fuel ratio control according to a second embodiment.
Figure 12:
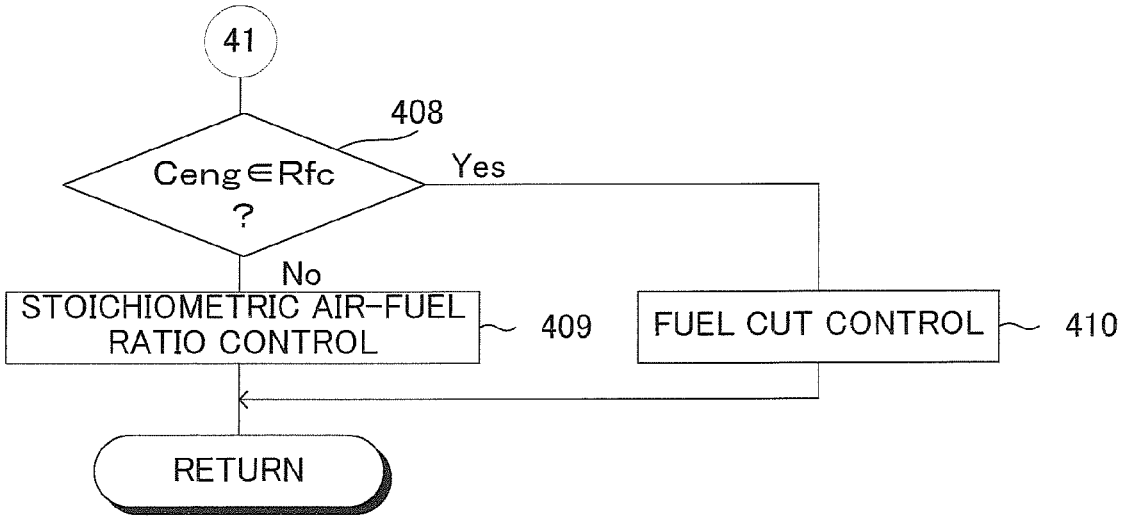
FIG. 12 is a view showing another of the example of the routine for performing the air-fuel ratio control according to the second embodiment.

Next, an example of a routine for performing the air-fuel ratio control according to the second embodiment will be described. This example of the routine is shown in FIGS. 11 and 12. The routine of FIGS. 11 and 12 starts every a predetermined time has elapsed.

When the routine of FIGS. 11 and 12 starts, first, at the step 400, the current active element solid solution Ds, the current catalyst temperature Tcat, the current required engine torque TQ and the current engine speed NE are acquired. Next, at the step 401, it is judged if the active element solid solution degree Ds acquired at the step 400 is smaller than the target solid solution degree Dst (Ds<Dst). In this regard, when it is judged that Ds<Dst, the routine proceeds to the step 406. On the other hand, when it is not judged that Ds<Dst, the routine proceeds to the step 402.

When it is judged that Ds<Dst at the step 401 and then, the routine proceeds to the step 406, it is judged if the catalyst temperature Tcat acquired at the step 400 is higher than or equal to the predetermined solid solution temperature Ts (Tcat≥Ts). In this regard, when it is judged that Tcat≥Ts, the routine proceeds to the step 407 where the enlarged fuel cut permission range Rfcl is set as the fuel cut permission range Rfc (Rfc←Rfcl) and then, the routine proceeds to the step 408. On the other hand, when it is not judged that Tcat≥Ts, the routine proceeds to the step 403 where the base fuel cut permission range Rfcb is set as the fuel cut permission range Rfc (Rfc←Rfcb) and then, the routine proceeds to the step 408.

When it is not judged that Ds<Dst at the step 401 and then, the routine proceeds to the step 402, it is judged if the active element solid solution degree Ds acquired at the step 400 is larger than the target solid solution degree Dst (Ds>Dst). In this regard, when it is judged that Ds>Dst, the routine proceeds to the step 404. On the other hand, when it is not judged that Ds>Dst, the routine proceeds to the step 403 where the base fuel cut permission range Rfcb is set as the fuel cut permission range Rfc (Rfc←Rfcb) and then, the routine proceeds to the step 408.

When it is judged that Ds>Dst at the step 402 and then, the routine proceeds to the step 404, it is judged if the catalyst temperature Tcat acquired at the step 400 is higher than or equal to the predetermined precipitation temperature Td (Tcat≥Td). In this regard, when it is judged that Tcat≥Td, the routine proceeds to the step 405 where the reduced fuel cut permission range Rfcr is set as the fuel cut permission range Rfc (Rfc←Rfcr) and then, the routine proceeds to the step 408. On the other hand, when it is not judged that Tcat≥Td, the routine proceeds to the step 403 where the base fuel cut permission range Rfcb is set as the fuel cut permission range Rfc (Rfc←Rfcb) and then, the routine proceeds to the step 408.

At the step 408, it is judged if the engine operation condition Ceng defined by the required engine torque TQ and the engine speed NE acquired at the step 400 is within the fuel cut permission range Rfc (Ceng∈Rfc). In the case that the routine proceeds to the step 408 from the step 403, the fuel cut permission range Rfc used at the step 408 is the base fuel cut permission range Rfcb, in the case that the routine proceeds to the step 408 from the step 405, the fuel cut permission range Rfc used at the step 408 is the reduced fuel cut permission range Rfcr and in the case that the routine proceeds to the step 408 from the step 407, the fuel cut permission range Rfc used at the step 408 is the enlarged fuel cut permission range Rfcl.

When it is judged that Ceng∈Rfc at the step 408, the routine proceeds to the step 410 where the fuel cut control is performed (i.e. zero is set as the target fuel injection amount) and then, the routine ends. On the other hand, when it is not judged that Ceng∈Rfc at the step 408, the routine proceeds to the step 409 where the stoichiometric air-fuel ratio control is performed and then, the routine ends.

As an example of the routine for performing the stoichiometric air-fuel ratio control according to the second embodiment and performed at the step 409 of FIG. 12, the routine of FIGS. 5 and 6 can be employed. In this case, the target air-fuel ratio AFt acquired at the step 200 is only the stoichiometric air-fuel ratio, independently of the active element solid solution degree and the catalyst temperature and therefore, the target air-fuel ratio AFt used at the step 201 is only the stoichiometric air-fuel ratio. Further, as an example of the routine for performing the setting of the skip increase and decrease values according to the second embodiment, the routine of FIG. 7 can be employed. In this case, the target air-fuel ratio AFt acquired at the step 300 is only the stoichiometric air-fuel ratio, independently of the active element solid solution degree and the catalyst temperature and therefore, the target air-fuel ratio AFt used at the step 301 is only the stoichiometric air-fuel ratio.

Next, the third embodiment will be described. The constitution and controls of the third embodiment not described below are the same as those of the aforementioned embodiments or are those derived naturally from the technical concept of the invention embodied in the third embodiment. Further, as far as no contradiction occurs, the controls of the aforementioned embodiments may be combined with those of the third embodiment described below.

In the third embodiment, the stoichiometric air-fuel ratio control and the fuel amount increase control can be selectively performed. In this regard, the stoichiometric air-fuel ratio control is the same as that according to the first embodiment. Further, the fuel amount increase control is a control for setting the target fuel injection amount such that the fuel injection amount is increased to control the air-fuel ratio of the mixture gas to an air-fuel ratio richer than the stoichiometric air-fuel ratio when the engine operation condition is within a particular range of the engine operation condition (hereinafter, this range may be referred to as—fuel injection permission range—).

Then, according to the third embodiment, when the active element solid solution degree corresponds to the target solid solution degree or when the active element solid solution degree is smaller than the target solid solution degree and the catalyst temperature is lower than the predetermined solid solution temperature or when the active element solid solution degree is larger than the target solid solution degree and the catalyst temperature is lower than the predetermined precipitation temperature, a base range of the engine operation condition (hereinafter, this range may be referred to as—base fuel amount increase permission range—) is set as the fuel amount increase permission range.

Further, when the active element solid solution degree is smaller than the target solid solution degree and the catalyst temperature is higher than or equal to the predetermined solid solution temperature, a range of the engine operation condition smaller than the base fuel amount increase permission range (hereinafter, this range may be referred to as—reduced fuel amount increase permission range—) is set as the fuel cut permission range.

Further, when the active element solid solution degree is larger than the target solid solution degree and the catalyst temperature is higher than or equal to the predetermined precipitation temperature, a range of the engine operation condition larger than the base fuel amount increase permission range (hereinafter, this range may be referred to as—enlarged fuel amount increase permission range—) is set as the fuel cut permission range.

Then, during the engine operation, when the engine operation condition is not within the aforementioned set fuel amount increase permission range, the stoichiometric air-fuel ratio control is performed. On the other hand, during the engine operation, when the engine operation condition is within the aforementioned set fuel amount increase permission range, the fuel amount increase control is performed.

According to the third embodiment, when the active element solid solution degree is smaller than the target solid solution degree and the catalyst temperature is higher than or equal to the predetermined solid solution temperature, no fuel amount increase permission range is set. In this case, the performance of the fuel amount increase control is forbidden.

Further, when the temperature of the catalyst excessively increases, the catalyst may deteriorates. In this regard, if the exhaust gas including the unburned fuel of the relatively large amount flows into the catalyst, the fuel flowing into the catalyst vaporizes in the catalyst to remove the heat from the catalyst. Thus, the heat-related deterioration of the catalyst is restricted. Therefore, as the engine operation condition for defining the fuel amount increase permission range in the third embodiment, the catalyst temperature may be employed. In this case, a range defined by the catalyst temperatures in which the catalyst temperature is excessively high and therefore, the heat-related deterioration of the catalyst may be led is set as the base fuel amount increase permission range.

In the case that the fuel injector is arranged on the engine so as to inject the fuel directly into the combustion chamber, in order to make the exhaust gas including the unburned fuel of the large amount flow into the catalyst, it is preferred that in the fuel mount increase control, the fuel of the normal fuel injection amount is injected from the fuel injector into the combustion chamber at an intake stroke where the air is suctioned into the combustion chamber or at a compression stroke where the air in the combustion chamber is compressed and thereafter, the fuel of a predetermined amount is injected from the fuel injector into the combustion chamber at an exhaust stroke where the burned gas is discharged from the combustion chamber.

Further, in order to make the engine output a power required as a power output from the engine (hereinafter, this power may be referred to as—required engine power—) when the required engine power is considerably large, it may be necessary to inject the fuel into the combustion chamber such that the air-fuel ratio becomes richer than the stoichiometric air-fuel ratio. Therefore, as the engine operation condition for defining the fuel amount increase permission range in the third embodiment, the required engine power may be employed.

In this case, a range defined by the required engine powers in which the required engine power is considerably large and therefore, it may be necessary to inject the fuel into the combustion chamber such that the air-fuel ratio becomes richer than the stoichiometric air-fuel ratio is set as the base fuel amount increase permission range.

In this regard, the required engine power is defined, for example, by the combination of the required engine torque and the engine speed. That is, when the required engine torque and the engine speed are relatively large, the required engine power is considerably large.

According to the third embodiment, the following effect can be obtained. That is, according to the third embodiment, when the active element solid solution degree is larger than the target solid solution and the catalyst temperature is higher than or equal to the predetermined percipitation temperature, the enlarged fuel amount increase permission range larger than the base fuel amount increase permission range is set as the fuel amount increase permission range. Thereby, compared with the case that the base fuel amount increase permission range is set as the fuel amount increase permission range, the frequency of the performance of the fuel amount increase control increases.

In addition, in the fuel amount increase control, the target fuel injection amount is set such that the air-fuel ratio of the mixture gas is richer than the stoichiometric air-fuel ratio and therefore, the catalyst inflow exhaust air-fuel ratio becomes richer than the stoichiometric air-fuel ratio.

Thereby, the atmosphere in the catalyst becomes the reduction atmosphere and therefore, if the catalyst temperature becomes higher than or equal to the predetermined precipitation temperature at this time, the active element having transformed as a solid solution precipitates from the carrier and as a result, the active element solid solution degree decreases. That is, by setting the enlarged fuel amount increase permission range larger than the base fuel amount increase permission range as the fuel amount increase permission range, the opportunity of the active element having transformed as a solid solution precipitating from the carrier increases and as a result, the opportunity of the decrease of the active element solid solution degree increases.

Therefore, totally, when the active element solid solution degree is larger than the target solid solution degree and the catalyst temperature is higher than or equal to the predetermined precipitation temperature, the catalyst inflow exhaust air-fuel ratio is controlled to an air-fuel ratio richer than the stoichiometric air-fuel ratio and therefore, the active element solid solution degree decreases.

On the other hand, according to the third embodiment, when the active element solid solution degree is smaller than the target solid solution and the catalyst temperature is higher than or equal to the predetermined solid solution temperature, the reduced fuel amount increase permission range smaller than the base fuel amount increase permission range is set as the fuel amount increase permission range. Thereby, compared with the case that the base fuel amount increase permission range is set as the fuel amount increase permission range, the frequency of the performance of the fuel amount increase control decreases and therefore, the opportunity that the catalyst inflow exhaust air-fuel ratio becomes richer than the stoichiometric air-fuel ratio decreases. In other words, the opportunity that the catalyst inflow exhaust air-fuel ratio becomes leaner than the stoichiometric air-fuel ratio increases.

If the catalyst inflow exhaust air-fuel ratio becomes leaner than the stoichiometric air-fuel ratio, the atmosphere in the catalyst becomes the oxidation atmosphere and therefore, if the catalyst temperature becomes higher than or equal to the predetermined solid solution temperature at this time, the precipitated active element transforms as a solid solution into the carrier and as a result, the active element solid solution degree increases. That is, by setting the enlarged fuel amount increase permission range larger than the base fuel amount increase permission range as the fuel amount increase permission range, the opportunity that the precipitated active element transforms as a solid solution into the carrier increases and as a result, the opportunity of the increase of the active element solid solution degree increases.

Therefore, totally, when the active element solid solution degree is smaller than the target solid solution degree and the catalyst temperature is higher than or equal to the predetermined precipitation temperature, the catalyst inflow exhaust air-fuel ratio is controlled to an air-fuel ratio leaner than the stoichiometric air-fuel ratio and therefore, the active element solid solution degree increases.

Thus, according to the third embodiment, the active element solid solution degree is controlled to the target solid solution degree. Thereby, the amount of the precipitated active element is maintained constant and therefore, the purification ability of the catalyst during the engine operation can be easily assumed. Thus, according to the third embodiment, the effect that the control logic used for the engine control can be relatively easily structured and the engine control can be relatively easily performed can be obtained.

In addition, the enlargement and reduction of the fuel amount increase permission range used for the control of the active element solid solution degree according to the third embodiment is a relatively simple control. Therefore, according to the third embodiment, the effect that the active element solid solution degree can be relatively easily controlled to the target solid solution degree can be obtained.

Figure 13:
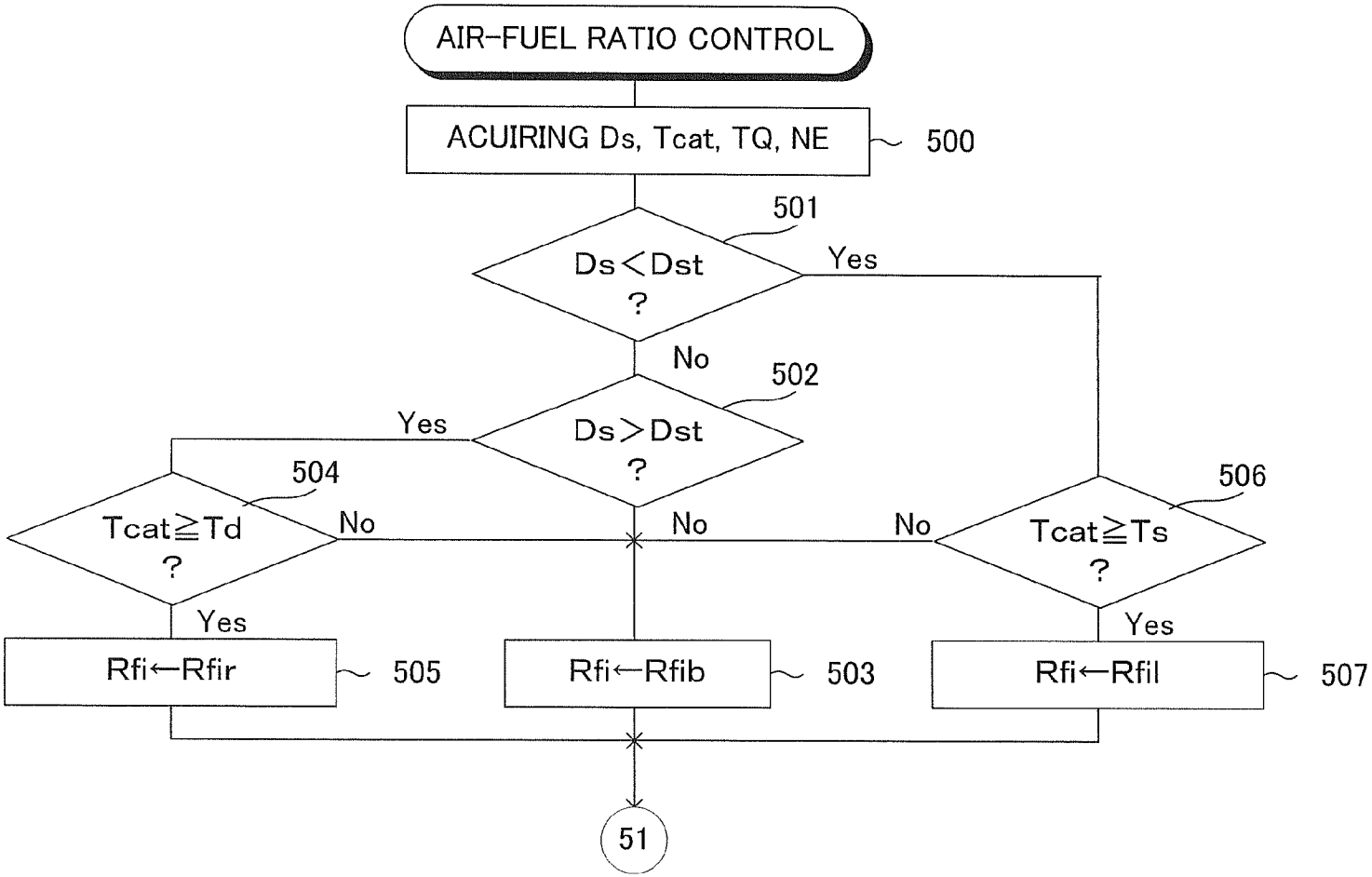
FIG. 13 is a view showing a part of an example of a routine for performing an air-fuel ratio control according to a third embodiment.
Figure 14:
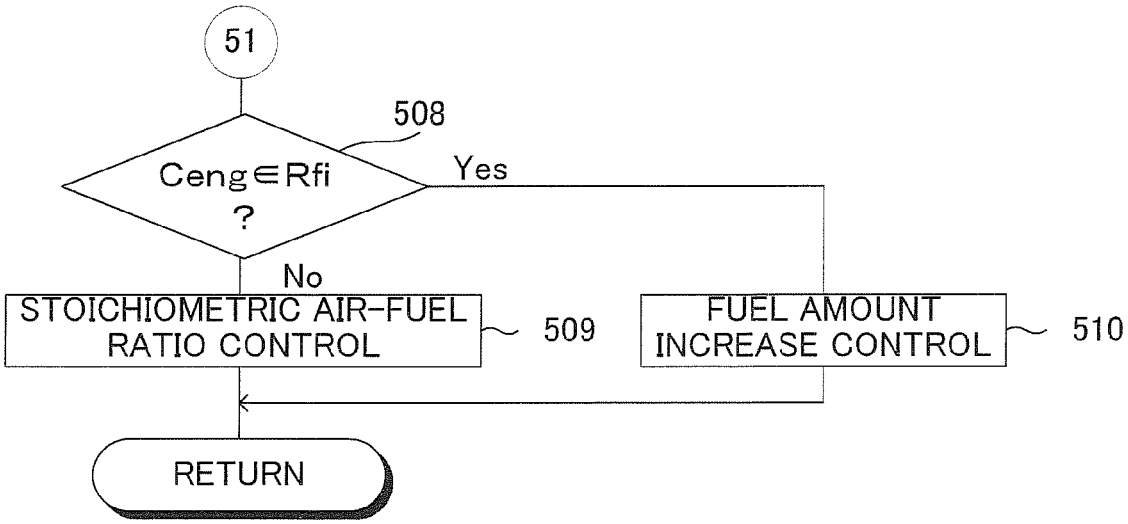
FIG. 14 is a view showing another of the example of the routine for performing the air-fuel ratio control according to the third embodiment.

Next, an example of a routine for performing the air-fuel ratio control according to the third embodiment will be described. This example of the routine is shown in FIGS. 13 and 14. The routine of FIGS. 13 and 14 starts every a predetermined time has elapsed.

When the routine of FIGS. 13 and 14 starts, first, at the step 500, the current active element solid solution Ds, the current catalyst temperature Tcat, the current required engine torque TQ and the current engine speed NE are acquired. Next, at the step 501, it is judged if the active element solid solution degree Ds acquired at the step 500 is smaller than the target solid solution degree Dst (Ds<Dst). In this regard, when it is judged that Ds<Dst, the routine proceeds to the step 506. On the other hand, when it is not judged that Ds<Dst, the routine proceeds to the step 502.

When it is judged that Ds<Dst at the step 501 and then, the routine proceeds to the step 506, it is judged if the catalyst temperature Tcat acquired at the step 500 is higher than or equal to the predetermined solid solution temperature Ts (Tcat≥Ts). In this regard, when it is judged that Tcat≥Ts, the routine proceeds to the step 507 where the enlarged fuel amount increase permission range Rfil is set as the fuel amount increase permission range Rfi (Rfk←Rfil) and then, the routine proceeds to the step 508. On the other hand, when it is not judged that Tcat≥Ts, the routine proceeds to the step 503 where the base fuel amount increase permission range Rfib is set as the fuel amount increase permission range Rfi (Rfi←Rfib) and then, the routine proceeds to the step 508.

When it is not judged that Ds<Dst at the step 501 and then, the routine proceeds to the step 502, it is judged if the active element solid solution degree Ds acquired at the step 500 is larger than the target solid solution degree Dst (Ds>Dst). In this regard, when it is judged that Ds>Dst, the routine proceeds to the step 504. On the other hand, when it is not judged that Ds>Dst, the routine proceeds to the step 503 where the base fuel amount increase permission range Rfib is set as the fuel amount increase permission range Rfi (Rfi←Rfib) and then, the routine proceeds to the step 508.

When it is judged that Ds>Dst at the step 502 and then, the routine proceeds to the step 504, it is judged if the catalyst temperature Tcat acquired at the step 500 is higher than or equal to the predetermined precipitation temperature Td (Tcat≥Td). In this regard, when it is judged that Tcat≥Td, the routine proceeds to the step 505 where the enlarged fuel amount increase permission range Rfir is set as the fuel amount increase permission range Rfi (Rfi←Rfir) and then, the routine proceeds to the step 508. On the other hand, when it is not judged that Tcat≥Td, the routine proceeds to the step 503 where the base fuel amount increase permission range Rfib is set as the fuel amount increase permission range Rfi (Rfi←Rfib) and then, the routine proceeds to the step 508.

At the step 508, it is judged if the engine operation condition Ceng defined by the required engine torque TQ and the engine speed NE acquired at the step 500 is within the fuel amount increase permission range Rfi (Ceng∈Rfi).

In the case that the routine proceeds to the step 508 from the step 503, the fuel amount increase permission range Rfi used at the step 508 is the base fuel amount increase permission range Rfib, in the case that the routine proceeds to the step 508 from the step 505, the fuel amount increase permission range Rfi used at the step 508 is the enlarged fuel amount increase permission range Rfir and in the case that the routine proceeds to the step 508 from the step 507, the fuel amount increase permission range Rfi used at the step 508 is the reduced fuel amount increase permission range Rfil.

When it is judged that Ceng∈Rfi at the step 508, the routine proceeds to the step 510 where the fuel amount increase control is performed (i.e. the target fuel injection amount is set such that the fuel injection amount is increased to control the air-fuel ratio of the mixture gas to an air-fuel ratio richer than the stoichiometric air-fuel ratio) and then, the routine ends. On the other hand, when it is not judged that Ceng∈Rfi at the step 508, the routine proceeds to the step 509 where the stoichiometric air-fuel ratio control is performed and then, the routine ends.

As an example of the routine for performing the stoichiometric air-fuel ratio control according to the third embodiment and performed at the step 509 of FIG. 14, the routine of FIGS. 5 and 6 can be employed. In this case, the target air-fuel ratio AFt acquired at the step 200 is only the stoichiometric air-fuel ratio, independently of the active element solid solution degree and the catalyst temperature and therefore, the target air-fuel ratio AFt used at the step 201 is only the stoichiometric air-fuel ratio.

Further, as an example of the routine for performing the setting of the skip increase and decrease values according to the third embodiment, the routine of FIG. 7 can be employed. In this case, the target air-fuel ratio AFt acquired at the step 300 is only the stoichiometric air-fuel ratio, independently of the active element solid solution degree and the catalyst temperature and therefore, the target air-fuel ratio AFt used at the step 301 is only the stoichiometric air-fuel ratio.

The target solid solution degree of the aforementioned embodiments may be a value changed depending on a particular condition or a constant value independently of the conditions. Next, an embodiment in the case that the target solid solution degree is changed depending on the particular condition (hereinafter, this embodiment may be referred to as—fourth embodiment—) will be described. The constitution and controls of the fourth embodiment not described below are the same as those of the aforementioned embodiments or are those derived naturally from the technical concept of the invention embodied in the fourth embodiment. Further, as far as no contradiction occurs, the controls of the aforementioned embodiments may be combined with those of the fourth embodiment described below.

According to the fourth embodiment, a degree of the usage of the catalyst in the purification of the particular components in the exhaust gas (hereinafter, this degree may be referred to as—catalyst usage degree—) is acquired. Then, as the catalyst usage degree increases, the set target solid solution degree decreases.

In the fourth embodiment, the acquisition method of the catalyst usage degree is not limited to any particular method and for example, as the acquisition method of the catalyst usage degree, a method for acquiring the catalyst usage degree on the basis of an integration value of the time of the usage of the catalyst in the purification of the particular components in the exhaust gas (in other words, an integration value of the time of the usage of the active element having precipitated from the carrier in the purification of the particular components in the exhaust gas) can be employed or in the case that the engine is installed on a vehicle, a method for acquiring the catalyst usage degree on the basis of an integration value of a running distance of the vehicle can be employed.

In this regard, in the case that the method for acquiring the catalyst usage degree on the basis of the integration value of the time of the usage of the catalyst in the purification of the particular components in the exhaust gas (hereinafter, this integration value may be referred to as—catalyst usage time integration time) is employed as the acquisition method of the catalyst usage degree, as the catalyst usage time integration value increases, the acquired catalyst usage degree increases.

Further, in the case that the method for acquiring the catalyst usage degree on the basis of the integration value of the running distance of the vehicle (hereinafter, this integration value may be referred to as—running distance integration value—) is employed as the acquisition method of the catalyst usage degree, as the running distance integration value increases, the acquired catalyst usage degree increases.

According to the fourth embodiment, the following effect can be obtained. That is, the activation ability of the active element decreases due to the deterioration of the active element as the active element usage degree, in other words, the catalyst usage degree increases. Thus, in the case that there is no change of the active element solid solution degree and therefore, there is no change of the amount of the precipitated active element, the purification ability of the catalyst decreases as the catalyst usage degree increases.

On the other hand, in the fourth embodiment, as the catalyst usage degree increases, the target solid solution degree is decreased and as a result, the amount of the precipitated active element increases. Therefore, even if the activation ability of the precipitated active element decreases due to the increase of the catalyst usage degree, the active element newly precipitates from the carrier and therefore, the purification ability of the catalyst is maintained at the original ability or is maintained at least at an ability near the original ability. Therefore, according to the fourth embodiment, independently of the catalyst usage degree, the purification ability of the catalyst can be maintained at the original ability or can be maintained at least at an ability near the original ability and therefore, the effect that the purification ability of the catalyst during the engine operation can be further easily assumed.

In the aforementioned embodiments, the method for acquiring the active element solid solution degree used in the air-fuel ratio control (hereafter, this degree may be referred to as—active element solid solution degree for the air-fuel ratio control—) is not limited to any particular method and for example, a method for acquiring the active element solid solution degree detected by a sensor for detecting the active element solid solution degree as the active element solid solution degree for the air-fuel ratio control can be employed or a method for acquiring the active element solid solution degree calculated on the basis of the various parameters relating to the engine as the active element solid solution degree for the air-fuel ratio control can be employed.

Next, one embodiment which employs a method for acquiring the active element solid solution degree calculated on the basis of various parameters relating to the engine as the active element solid solution for the air-fuel ratio control (hereinafter, this embodiment may be referred to as—fifth embodiment—) will be described. The constitution and controls of the fifth embodiment not described below are the same as those of the aforementioned embodiments or are those derived naturally from the technical concept of the invention embodied in the fifth embodiment. Further, as far as no contradiction occurs, the controls of the aforementioned embodiments may be combined with those of the fifth embodiment described below.

In the fifth embodiment, a solid solution degree counter is prepared as an active element solid solution degree value which indicates the active element solid solution degree. As an initial value of this solid solution degree counter, a value corresponding to the active element solid solution degree when the catalyst is first used is set.

Then, during the engine operation, while the catalyst temperature is higher than or equal to the predetermined solid solution temperature and the catalyst inflow exhaust air-fuel ratio is leaner than the stoichiometric air-fuel ratio (i.e. the air-fuel ratio of the mixture gas is leaner than the stoichiometric air-fuel ratio), the solid solution counter is gradually increased.

On the other hand, during the engine operation, while the catalyst temperature is higher than or equal to the predetermined precipitation temperature and the catalyst inflow exhaust air-fuel ratio is richer than the stoichiometric air-fuel ratio (i.e. the air-fuel ratio of the mixture gas is richer than the stoichiometric air-fuel ratio), the solid solution degree counter is gradually decreased. Then, the active element solid solution degree is calculated on the basis of the solid solution degree counter which is increased or decreased as described above and the thus calculated active element solid solution degree is acquired as the active element solid solution degree for the air-fuel ratio control.

According to the fifth embodiment, the following effect can be obtained. That is, when the catalyst temperature is higher than or equal to the predetermined solid solution temperature and the catalyst inflow exhaust air-fuel ratio is leaner than the stoichiometric air-fuel ratio (hereinafter, this may be referred to as—at the high temperature lean condition—), the active element transforms as a solid solution into the carrier. In this regard, as the catalyst temperature increases, the amount of the active element transforming as a solid solution into the carrier per unit time increases. That is, the amount of the active element transforming as a solid solution into the carrier per unit time depends on the catalyst temperature and the catalyst inflow exhaust air-fuel ratio.

In this regard, according to the fifth embodiment, at the high temperature lean condition, the active element solid solution degree is calculated on the basis of the catalyst temperature and the catalyst inflow exhaust air-fuel ratio. Therefore, according to the fifth embodiment, the effect that the active element solid solution degree is accurately calculated at the high temperature lean condition can be obtained.

On the other hand, when the catalyst temperature is higher than or equal to the predetermined precipitation temperature and the catalyst inflow exhaust air-fuel ratio is richer than the stoichiometric air-fuel ratio (hereinafter, this may be referred to as—at the high temperature rich condition—), the active element precipitates from the carrier. At this time, the amount of the active element precipitating from the carrier per unit time increases as the catalyst temperature increases and the rich degree of the catalyst inflow exhaust air-fuel ratio increases. That is, the amount of the active element precipitating from the carrier per unit time depends on the catalyst temperature and the catalyst inflow exhaust air-fuel ratio.

In this regard, according to the fifth embodiment, at the high temperature rich condition, the active element solid solution degree is calculated on the basis of the catalyst temperature and the catalyst inflow exhaust air-fuel ratio. Therefore, according to the fifth embodiment, the effect that the active element solid solution degree can be accurately calculated at the high temperature rich condition can be obtained.

Broadly, the fifth embodiment is an example of an embodiment which employs a method for acquiring the active element solid solution degree for the air-fuel ratio control on the basis of the catalyst inflow exhaust air-fuel ratio and the catalyst temperature. Therefore, any acquisition method of the active element solid solution degree for the air-fuel ratio control on the basis of the catalyst inflow exhaust air-fuel ratio and the catalyst temperature other than the method described relating to the fifth embodiment may be employed.

Further, in the fifth embodiment, when the solid solution degree counter becomes larger than a value which indicates the maximum solid solution degree (i.e. a value corresponding to the one hundred percent of the active element solid solution degree), it is preferred that the solid solution degree counter is limited to the value which indicates the maximum solid solution degree in order to avoid that the active element solid solution degree calculated on the basis of the solid solution degree counter does not becomes larger than the maximum solid solution degree.

Further, in the fifth embodiment, when the solid solution degree counter becomes smaller than a value which indicates the minimum solid solution degree (i.e. a value corresponding to the active solid solution degree when all active element is precipitated from the carrier and a value corresponding to the zero percent of the active element solid solution degree), it is preferred that the solid solution degree counter is limited to the value which indicates the minimum solid solution degree in order to avoid that the active element solid solution degree calculated on the basis of the solid solution degree counter does not become smaller than the maximum solid solution degree.

Further, in the fifth embodiment, an amount of the increase of the solid solution degree counter per unit time while the catalyst temperature is higher than or equal to the predetermined solid solution temperature and the catalyst inflow exhaust air-fuel ratio is leaner than the stoichiometric air-fuel ratio (hereinafter, this amount may be referred to as—counter increase amount—) may be, for example, a constant amount independently of the catalyst temperature and the catalyst inflow exhaust air-fuel ratio or an amount varied depending on the catalyst temperature independently of the catalyst inflow exhaust air-fuel ratio or an amount varied depending on the catalyst inflow exhaust air-fuel ratio independently of the catalyst temperature or an amount varied depending on the catalyst temperature and the catalyst inflow exhaust air-fuel ratio.

In this regard, in the case that the counter increase amount is the amount varied depending on the catalyst temperature, the counter increase amount may be an amount which increases as the catalyst temperature increases or may be an amount such that when the catalyst temperature is higher than a certain temperature, the amount is larger than the amount when the catalyst temperature is lower than or equal to the certain temperature. That is, in this case, the counter increase amount considering that the amount of the active element transforming as a solid solution into the carrier per unit time increases (i.e. the speed of the transform of the active element as a solid solution into the carrier is high) as the catalyst temperature increases is employed.

Further, in the case that the counter increase amount is the amount varied depending on the catalyst inflow exhaust air-fuel ratio, the counter increase amount may be an amount which increases as the catalyst inflow exhaust air-fuel ratio increases (i.e. as the lean degree of the catalyst inflow exhaust air-fuel ratio increases) or may be an amount such that when the catalyst inflow exhaust air-fuel ratio is larger than a certain air-fuel ratio, the amount is larger than the amount when the catalyst inflow exhaust air-fuel ratio is smaller than or equal to the certain air-fuel ratio. That is, in this case, the counter increase amount considering that the amount of the active element transforming as a solid solution into the carrier per unit time increases (i.e. the speed of the transform of the active element as a solid solution into the carrier is high) as the catalyst inflow exhaust air-fuel ratio increases is employed.

Further, in the fifth embodiment, an amount of the decrease of the solid solution degree counter per unit time while the catalyst temperature is higher than or equal to the predetermined precipitation temperature and the catalyst inflow exhaust air-fuel ratio is richer than the stoichiometric air-fuel ratio (hereinafter, this amount may be referred to as—counter decrease amount—) may be, for example, a constant amount independently of the catalyst temperature and the catalyst inflow exhaust air-fuel ratio or an amount varied depending on the catalyst temperature independently of the catalyst inflow exhaust air-fuel ratio or an amount varied depending on the catalyst inflow exhaust air-fuel ratio independently of the catalyst temperature or an amount varied depending on the catalyst temperature and the catalyst inflow exhaust air-fuel ratio.

In this regard, in the case that the counter decrease amount is the amount varied depending on the catalyst temperature, the counter decrease amount may be an amount which increases as the catalyst temperature increases or may be an amount such that when the catalyst temperature is higher than a certain temperature, the amount is larger than the amount when the catalyst temperature is lower than or equal to the certain temperature. That is, in this case, the counter decrease amount considering that the amount of the active element precipitating from the carrier per unit time increases (i.e. the speed of the precipitation of the active element from the carrier is high) as the catalyst temperature increases is employed.

Further, in the case that the counter decrease amount is the amount varied depending on the catalyst inflow exhaust air-fuel ratio, the counter decrease amount may be an amount which increases as the catalyst inflow exhaust air-fuel ratio decreases (i.e. as the rich degree of the catalyst inflow exhaust air-fuel ratio increases) or may be an amount such that when the catalyst inflow exhaust air-fuel ratio is smaller than a certain air-fuel ratio, the amount is larger than the amount when the catalyst inflow exhaust air-fuel ratio is larger than or equal to the certain air-fuel ratio. That is, in this case, the counter decrease amount considering that the amount of the active element precipitating from the carrier per unit time increases (i.e. the speed of the precipitation of the active element from the carrier is high) as the catalyst inflow exhaust air-fuel ratio decreases is employed.

Figure 15:
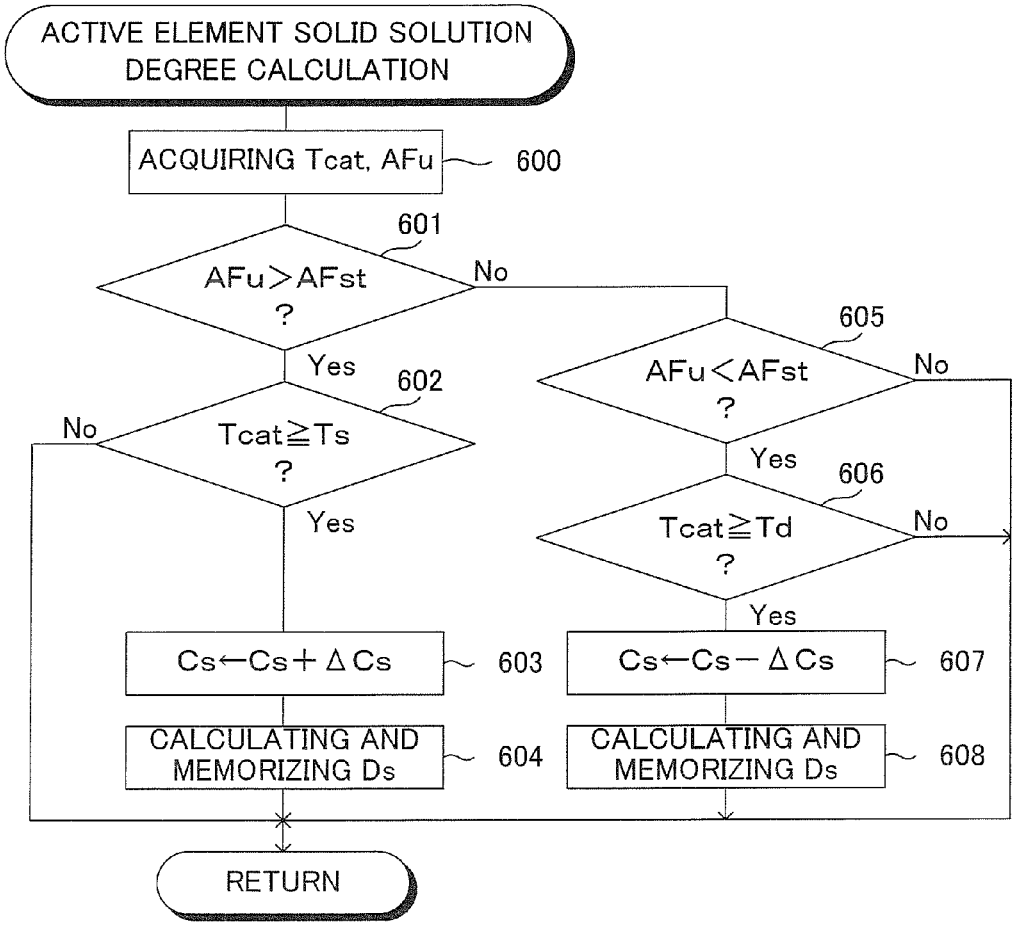
FIG. 15 is a view showing an example of a routine for performing a calculation of an active element solid solution degree according to a fifth embodiment.

Next, an example of a routine for performing the calculation of the solid solution degree counter according to the fifth embodiment will be described. This example of the routine is shown in FIG. 15. This routine starts every a predetermined time has elapsed.

When the routine of FIG. 15 starts, first, at the step 600, the current catalyst temperature Tcat and the current upstream detected air-fuel ratio AFu are acquired. Next, at the step 601, it is judged if the upstream detected air-fuel ratio AFu acquired at the step 600 is larger than the stoichiometric air-fuel ratio (AFu>AFst) (i.e. it is judged if the catalyst inflow exhaust air-fuel ratio is leaner than the stoichiometric air-fuel ratio). In this regard, when it is judged that AFu>AFst, the routine proceeds to the step 602. On the other hand, when it is not judged that AFu>AFst, the routine proceeds to the step 605.

When it is judged that AFu>AFst at the step 601 and then, the routine proceeds to the step 602, it is judged if the catalyst temperature Tcat acquired at the step 600 is higher than or equal to the predetermined solid solution temperature Ts (Tcat≥Ts). In this regard, when it is judged that Tcat≥Ts, the routine proceeds to the step 603. On the other hand, when it is not judged that Tcat≥Ts, the routine ends directly.

When it is judged that Tcat≥Ts at the step 602 and then, the routine proceeds to the step 603, the solid solution degree counter Cs is increased by a predetermined value ΔCs (Cs←Cs+ΔCs). Next, at the step 604, the active element solid solution degree Ds is calculated on the basis of the solid solution degree counter Cs updated at the step 603 and then, the calculated active element solid solution degree Ds is memorized in the electronic control unit and then, the routine ends.

When it is judged that AFu>AFst at the step 601 and then, the routine proceeds to the step 605, it is judged if the upstream detected air-fuel ratio AFu acquired at the step 600 is smaller than the stoichiometric air-fuel ratio AFst (AFu<AFst) (i.e. it is judged if the catalyst inflow exhaust air-fuel ratio is richer than the stoichiometric air-fuel ratio). In this regard, when it is judged that AFu<AFst, the routine proceeds to the step 606. On the other hand, when it is not judged that AFu<AFst, the routine ends directly.

When it is judged that AFu<AFst at the step 605 and then, the routine proceeds to the step 606, it is judged if the catalyst temperature Tcat acquired at the step 600 is higher than or equal to the predetermined precipitation temperature Td (Tcat≥Td). In this regard, when it is judged that Tcat≥Td, the routine proceeds to the step 607. On the other hand, when it is not judged that Tcat≥Td, the routine ends directly.

When it is judged that Tcat≥Td at the step 606 and then, the routine proceeds to the step 607, the solid solution degree counter Cs is decreased by the predetermined value ΔCs (Cs←Cs−ΔCs). Next, at the step 608, the active element solid solution degree Ds is calculated on the basis of the solid solution degree counter Cs updated at the step 607 and then, the calculated active element solid solution degree Ds is memorized in the electronic control unit and then, the routine ends.

Next, another embodiment which employs a method for acquiring the active element solid solution degree calculated on the basis of various parameters relating to the engine as the active element solid solution (hereinafter, this embodiment may be referred to as—sixth embodiment—) will be described. The constitution and controls of the sixth embodiment not described below are the same as those of the aforementioned embodiments or are those derived naturally from the technical concept of the invention embodied in the sixth embodiment. Further, as far as no contradiction occurs, the controls of the aforementioned embodiments may be combined with those of the sixth embodiment described below.

In the sixth embodiment, a catalyst temperature when the stoichiometric air-fuel ratio control is performed under the condition that the active element solid solution degree is a predetermined solid solution degree is previously obtained by an experiment, etc. Then, the thus obtained catalyst temperature is memorized in the electronic control unit as a base catalyst temperature and the aforementioned predetermined solid solution degree is memorized in the electronic control unit as a base solid solution degree.

Further, a ratio of the change amount of the active element solid solution degree relative to each change amount of the catalyst temperature, that is, the change amount of the active element solid solution degree per unit catalyst temperature change amount (hereinafter, this change amount may be referred to as—solid solution change rate—) is previously obtained by an experiment, etc. Then, the thus obtained solid solution degree change rates are memorized in the electronic control unit.

Then, while the stoichiometric air-fuel ratio control is performed during the engine operation, the actual catalyst temperature (hereinafter, this actual catalyst temperature may be referred to as—catalyst temperature during the engine operation—) is acquired and then, a difference of the catalyst temperature during the engine operation relative to the base catalyst temperature (hereinafter, this difference may be referred to as—catalyst temperature difference—) is calculated.

Then, a value, which is obtained by adding to the base solid solution degree, a value obtained by multiplying the aforementioned solid solution degree change rate by the thus calculated catalyst temperature difference, is acquired as the active element solid solution degree for the air-fuel ratio control. That is, according to the sixth embodiment, the active element solid solution degree for the air-fuel ratio control Ds is acquired according to the following formula 3. In the formula 3, "Dsb" is—base solid solution degree—, "Rds" is—solid solution degree change rate—, "Tcatb" is—base catalyst temperature—and "Tcat" is—catalyst temperature during the engine operation—.

$$Ds=Dsb+Rds*(Tcatb-Tcat) \quad (3)$$

According to the sixth embodiment, the following effect can be obtained. That is, as the precipitated active element is large, the exhaust components (i.e. the components in the exhaust gas) are actively activated by the active element and thus, the exhaust components are actively purified by the catalyst.

On the other hand, a heat is produced due to the purification of the exhaust components by the catalyst. Therefore, as the amount of the precipitated active element is large, the amount of the heat produced due to the purification of the exhaust components by the catalyst is large and thus, the catalyst temperature increases. That is, the amount of the precipitated active element influences the catalyst temperature and as the amount of the precipitated active element is large, the catalyst temperature tends to be high. Therefore, the amount of the precipitated active element can be estimated on the basis of the catalyst temperature and the amount of the active element having transformed as a solid solution, that is, the active element solid solution degree can be estimated.

In this regard, according to the sixth embodiment, the active element solid solution degree is calculated on the basis of the catalyst temperature during the engine operation. That is, the active element solid solution degree is calculated using the catalyst temperature which is a parameter which varies depending on the active element solid solution degree. Therefore, according to the sixth embodiment, the effect that the active element solid solution degree can be accurately calculated can be obtained.

Further, according to the sixth embodiment, the active element solid solution degree is calculated using the formula 3. Then, as apparent from the formula 3, the formula 3 is a considerably simple formula and thus, the burden of the calculation of the active element solid solution degree using the formula 3 is considerably small. Thus, according to the sixth embodiment, the effect that the active element solid solution degree can be calculated with the considerably small calculation burden can be obtained.

Next, further another embodiment which employs a method for acquiring the active element solid solution degree calculated on the basis of various parameters relating to the engine as the active element solid solution for the air-fuel ratio control (hereinafter, this embodiment may be referred to as—seventh embodiment—) will be described. The constitution and controls of the seventh embodiment not described below are the same as those of the aforementioned embodiments or are those derived naturally from the technical concept of the invention embodied in the seventh embodiment. Further, as far as no contradiction occurs, the controls of the aforementioned embodiments may be combined with those of the seventh embodiment described below.

In the seventh embodiment, a catalyst temperature when the stoichiometric air-fuel ratio control is performed under the condition that the active element solid solution degree is a predetermined solid solution degree is previously obtained by an experiment, etc. Then, the thus obtained catalyst temperature is memorized in the electronic control unit as a base catalyst temperature.

Further, the active element solid solution degree when all active element has transformed as a solid solution into the carrier (hereinafter, this degree may be referred to as—maximum solid solution degree—) is previously determined. The maximum solid solution degree is, for example, "100".

Then, while the stoichiometric air-fuel ratio control is performed during the engine operation, the actual catalyst temperature (i.e. the catalyst temperature during the engine operation) is acquired and then, a difference of the catalyst temperature during the engine operation relative to the base catalyst temperature (i.e. the catalyst temperature difference) is calculated. Then, a value, which is obtained by subtracting from "100" which is the maximum solid solution degree, a value obtained by dividing the thus calculated catalyst temperature difference by the base catalyst temperature, is acquired as the active element solid solution degree for the air-fuel ratio control. That is, according to the seventh embodiment, the active element solid solution degree for the air-fuel ratio control Ds is acquired according to the following formula 4. In the formula 4, "Tcatb" is—base catalyst temperature—and "That" is—catalyst temperature during the engine operation—.

$$Ds=(100-(Tcatb-Tcat)/Tcatb) \quad (4)$$

According to the seventh embodiment, the following effect can be obtained. That is, according to the seventh embodiment, similar to the sixth embodiment, the active element solid solution degree is calculated on the basis of the catalyst temperature which is a parameter which varies depending on the active element solid solution degree. Therefore, according to the seventh embodiment, the effect that the active element solid solution degree can be accurately calculated can be obtained.

Further, according to the seventh embodiment, the active element solid solution degree is calculated using the formula 4. Then, as apparent from the formula 4, the formula 4 is a considerably simple formula and thus, the burden of the calculation of the active element solid solution degree using the formula 4 is considerably small. Also, contrary to the sixth embodiment, the solid solution degree change rate is not needed and therefore, it is not necessary to previously prepare the solid solution degree change rate for calculating the active element solid solution degree. Further, the solid solution degree change rate may not be constant and in this case, if the active element solid solution degree is calculated using the solid solution degree change rate, the calculated active element solid solution degree is not an accurate value.

In this regard, according to the seventh embodiment, the active element solid solution degree is calculated without using the solid solution degree change rate. Thus, according to the seventh embodiment, the effect that the burden for previously obtaining the solid solution degree change rate can be omitted and the active element solid solution degree can be accurately calculated with the considerably small calculation burden can be obtained.

Next, further another embodiment which employs a method for acquiring the active element solid solution degree calculated on the basis of various parameters relating to the engine as the active element solid solution for the air-fuel ratio control (hereinafter, this embodiment may be referred to as—eighth embodiment—) will be described. The constitution and controls of the eighth embodiment not described below are the same as those of the aforementioned embodiments or are those derived naturally from the technical concept of the invention embodied in the eighth embodiment. Further, as far as no contradiction occurs, the controls of the aforementioned embodiments may be combined with those of the eighth embodiment described below.

In the eighth embodiment, a relationship between the active element solid solution degree and the catalyst temperature when the stoichiometric air-fuel ratio control is performed is previously obtained by an experiment, etc. Then, the thus obtained relationship is memorized in the electronic control unit as a temperature solid solution degree relationship. Then, while the stoichiometric air-fuel ratio control is performed during the engine operation, the actual catalyst temperature (i.e. the catalyst temperature during the engine operation) is acquired and then, the active element solid solution degree is calculated from the temperature solid solution degree relationship on the basis of this catalyst temperature during the engine operation. Then, the thus calculated active element solid solution degree is acquired as the active element solid solution degree for the air-fuel ratio control.

In the eighth embodiment, the catalyst temperatures every the active element solid solution degree when the stoichiometric air-fuel ratio control is performed are previously obtained by an experiment, etc. then, the active element solid solution degrees are memorized in the electronic control unit as a form of a map as a function of the catalyst temperature on the basis of the relationship between the obtained catalyst temperature and the corresponding active element solid solution degree, then, while the stoichiometric air-fuel ratio control is performed during the engine operation, the catalyst temperature (i.e. the catalyst temperature during the engine operation) is acquired, then, the active element solid solution degree corresponding to this catalyst temperature during the engine operation is acquired from the map, and then, the thus acquired active element solid solution degree may be acquired as the active element solid solution degree for the air-fuel ratio control and in this case, the aforementioned temperature solid solution degree relationship is the aforementioned map.

According to the eighth embodiment, the following effect can be obtained. That is, while a constant relationship exists between the catalyst temperature and the active element solid solution degree, it is not easy to express such a relationship by one relational expression and if the active element solid solution degree is calculated using a relational expression which generally expresses such a relationship, the calculated active element solid solution degree may not be an accurate value. On the other hand, according to the eighth embodiment, the relationship between the catalyst temperature and the active element solid solution degree previously obtained by an experiment, etc. is memorized in the electronic control unit and then, during the engine operation, the active element solid solution degree is acquired on the basis of this memorized relationship and the catalyst temperature. Thus, according to the eighth embodiment, the effect that the accurate active element solid solution degree can be calculated can be obtained.

Broadly, the sixth to eighth embodiments are examples of embodiment which employs the method for acquiring the active element solid solution degree for the air-fuel ratio control on the basis of the catalyst temperature. Therefore, an acquisition method of the active element solid solution degree for the air-fuel ratio control on the basis of the catalyst temperature other than the methods described relating to the sixth to eighth embodiments may be employed.

Next, further another embodiment which employs a method for acquiring the active element solid solution degree calculated on the basis of various parameters relating to the engine as the active element solid solution for the air-fuel ratio control (hereinafter, this embodiment may be referred to as—ninth embodiment—) will be described. The constitution and controls of the ninth embodiment not described below are the same as those of the aforementioned embodiments or are those derived naturally from the technical concept of the invention embodied in the ninth embodiment. Further, as far as no contradiction occurs, the controls of the aforementioned embodiments may be combined with those of the ninth embodiment described below. Further, in the following description, "a catalyst temperature integration value" means—an integration value of the catalyst temperature in a predetermined time period—.

In the ninth embodiment, an catalyst temperature integration value when the stoichiometric air-fuel ratio control is performed under the condition that the active element solid solution degree is a predetermined solid solution degree is previously obtained by an experiment, etc. Then, the thus obtained catalyst temperature integration value is memorized in the electronic control unit as a base catalyst temperature integration value and the aforementioned predetermined solid solution degree is memorized in the electronic control unit as a base solid solution degree.

Further, a ratio of the change amount of the active element solid solution degree relative to each change amount of the catalyst temperature integration value, that is, the change amount of the active element solid solution degree per unit catalyst temperature integration value change amount (hereinafter, this change amount may be referred to as—solid solution change rate—) is previously obtained by an experiment, etc. Then, the thus obtained solid solution degree change rates are memorized in the electronic control unit.

Then, while the stoichiometric air-fuel ratio control is performed during the engine operation, the actual catalyst temperature integration value (hereinafter, this actual catalyst temperature integration value may be referred to as—catalyst temperature integration value during the engine operation—) is calculated.

Then, a difference of the catalyst temperature integration value during the engine operation relative to the base catalyst temperature integration value (hereinafter, this difference may be referred to as—catalyst temperature integration value difference—) is calculated.

Then, a value, which is obtained by adding to the base solid solution degree, a value obtained by multiplying the aforementioned solid solution degree change rate by the thus calculated catalyst temperature integration value difference, is acquired as the active element solid solution degree for the air-fuel ratio control. That is, according to the ninth embodiment, the active element solid solution degree for the air-fuel ratio control Ds is acquired according to the following formula 5. In the formula 5, "Dsb" is—base solid solution degree—, "Rds" is—solid solution degree change rate—, "ΣTcatb" is—base catalyst temperature integration value—and "ΣTcat" is—catalyst temperature integration value during the engine operation—.

$$Ds=Dsb+Rds*(\Sigma Tcatb-\Sigma Tcat) \quad (5)$$

According to the ninth embodiment, the following effect can be obtained. That is, as described above, the amount of the precipitated active element influences the catalyst temperature and as the amount of the precipitated active element is large, the catalyst temperature tends to be high.

In this regard, according to the ninth embodiment, the active element solid solution degree is calculated on the basis of the integration value of the catalyst temperature in the predetermined time period during the engine operation. That is, the active element solid solution degree is calculated using the integration value of the catalyst temperature which is a parameter which varies depending on the active element solid solution degree. In addition, the change of the integration value of the catalyst temperature due to the change of the amount of the precipitated active element is larger than the change of the catalyst temperature due to the change of the amount of the precipitated active element. Therefore, according to the ninth embodiment, the effect that the active element solid solution degree can be further accurately calculated can be obtained.

Further, according to the ninth embodiment, the active element solid solution degree is calculated using the formula 5. Then, as apparent from the formula 5, the formula 5 is a considerably simple formula and thus, the burden of the calculation of the active element solid solution degree using the formula 5 is considerably small. Thus, according to the ninth embodiment, the effect that the active element solid solution degree can be calculated with the considerably small calculation burden can be obtained.

Next, further another embodiment which employs a method for acquiring the active element solid solution degree calculated on the basis of various parameters relating to the engine as the active element solid solution for the air-fuel ratio control (hereinafter, this embodiment may be referred to as—tenth embodiment—) will be described. The constitution and controls of the tenth embodiment not described below are the same as those of the aforementioned embodiments or are those derived naturally from the technical concept of the invention embodied in the tenth embodiment. Further, as far as no contradiction occurs, the controls of the aforementioned embodiments may be combined with those of the tenth embodiment described below.

In the tenth embodiment, an catalyst temperature integration value when the stoichiometric air-fuel ratio control is performed under the condition that the active element solid solution degree is a predetermined solid solution degree is previously obtained by an experiment, etc. Then, the thus obtained catalyst temperature integration value is memorized in the electronic control unit as a base catalyst temperature integration value.

Further, the active element solid solution degree when all active element has transformed as a solid solution into the carrier (hereinafter, this degree may be referred to as—maximum solid solution degree—) is previously determined. The maximum solid solution degree is, for example, "100". Then, while the stoichiometric air-fuel ratio control is performed during the engine operation, the actual catalyst temperature integration value (i.e. the catalyst temperature integration value during the engine operation) is calculated.

Then, a difference of the catalyst temperature integration value during the engine operation relative to the base catalyst temperature integration value (i.e. the catalyst temperature integration value difference) is calculated.

Then, a value, which is obtained by subtracting from "100" which is the maximum solid solution degree, a value obtained by dividing the thus calculated catalyst temperature integration value difference by the base catalyst temperature integration value, is acquired as the active element solid solution degree for the air-fuel ratio control. That is, according to the tenth embodiment, the active element solid solution degree for the air-fuel ratio control Ds is acquired according to the following formula 6. In the formula 6, "ΣTcatb" is—base catalyst temperature integration value—and "ΣTcat" is—catalyst temperature integration value during the engine operation—.

$$Ds=(100-(\Sigma Tcatb-\Sigma Tcat)/\Sigma Tcatb) \quad (6)$$

According to the tenth embodiment, the following effect can be obtained. That is, according to the tenth embodiment, similar to the ninth embodiment, the active element solid solution degree is calculated on the basis of the integration value of the catalyst temperature which is a parameter which varies depending on the active element solid solution degree. In addition, as described above, the change of the integration value of the catalyst temperature due to the change of the amount of the precipitated active element is larger than the change of the catalyst temperature due to the change of the amount of the precipitated active element. Therefore, according to the tenth embodiment, the effect that the active element solid solution degree can be further accurately calculated can be obtained.

Further, according to the tenth embodiment, the active element solid solution degree is calculated using the formula 6. Then, as apparent from the formula 6, the formula 6 is a considerably simple formula and thus, the burden of the calculation of the active element solid solution degree using the formula 6 is considerably small. Also, contrary to the ninth embodiment, the solid solution degree change rate is not needed and therefore, it is not necessary to previously prepare the solid solution degree change rate for calculating the active element solid solution degree. Further, the solid solution degree change rate may not be constant and in this case, if the active element solid solution degree is calculated using the solid solution degree change rate, the calculated active element solid solution degree is not an accurate value.

In this regard, according to the tenth embodiment, the active element solid solution degree is calculated without using the solid solution degree change rate. Thus, according to the tenth embodiment, the effect that the burden for previously obtaining the solid solution degree change rate can be omitted and the active element solid solution degree can be accurately calculated with the considerably small calculation burden can be obtained.

Next, further another embodiment which employs a method for acquiring the active element solid solution degree calculated on the basis of various parameters relating to the engine as the active element solid solution for the air-fuel ratio control (hereinafter, this embodiment may be referred to as—eleventh embodiment—) will be described. The constitution and controls of the eleventh embodiment not described below are the same as those of the aforementioned embodiments or are those derived naturally from the technical concept of the invention embodied in the eleventh embodiment. Further, as far as no contradiction occurs, the controls of the aforementioned embodiments may be combined with those of the eleventh embodiment described below.

In the eleventh embodiment, a relationship between the active element solid solution degree and the catalyst temperature integration value when the stoichiometric air-fuel ratio control is performed is previously obtained by an experiment, etc. Then, the thus obtained relationship is memorized in the electronic control unit as a temperature integration value solid solution degree relationship. Then, while the stoichiometric air-fuel ratio control is performed during the engine operation, the actual catalyst temperature integration value (i.e. the catalyst temperature integration value during the engine operation) is calculated. Then, the active element solid solution degree is calculated from the temperature integration value solid solution degree relationship on the basis of this catalyst temperature integration value during the engine operation. Then, the thus calculated active element solid solution degree is acquired as the active element solid solution degree for the air-fuel ratio control.

In the eleventh embodiment, the catalyst temperature integration values every the active element solid solution degree when the stoichiometric air-fuel ratio control is performed are previously obtained by an experiment, etc. then, the active element solid solution degrees are memorized in the electronic control unit as a form of a map as a function of the catalyst temperature integration value on the basis of the relationship between the obtained catalyst temperature integration value and the corresponding active element solid solution degree, then, while the stoichiometric air-fuel ratio control is performed during the engine operation, the catalyst temperature integration value (i.e. the catalyst temperature integration value during the engine operation) is calculated, then, the active element solid solution degree corresponding to this calculated catalyst temperature integration value during the engine operation is acquired from the map, and then, the thus acquired active element solid solution degree may be acquired as the active element solid solution degree for the air-fuel ratio control and in this case, the aforementioned temperature integration value solid solution degree relationship is the aforementioned map.

According to the eleventh embodiment, the following effect can be obtained. That is, while a constant relationship exists between the catalyst temperature integration value and the active element solid solution degree, it is not easy to express such a relationship by one relational expression and if the active element solid solution degree is calculated using a relational expression which generally expresses such a relationship, the calculated active element solid solution degree may not be an accurate value. On the other hand, according to the eleventh embodiment, the relationship between the catalyst temperature integration value and the active element solid solution degree previously obtained by an experiment, etc. is memorized in the electronic control unit and then, during the engine operation, the active element solid solution degree is acquired on the basis of this memorized relationship and the catalyst temperature integration value. Thus, according to the eleventh embodiment, the effect that the accurate active element solid solution degree can be calculated can be obtained.

In the ninth to eleventh embodiments, the predetermined time period, which is a time period where the catalyst temperature is integrated in order to acquire the catalyst temperature integration value, may be any period where the change of the catalyst temperature integration value occurs due to the change of the active element solid solution and for example, as the predetermined time period, a period where the catalyst temperature increases at a temperature increase rate larger than a predetermined temperature increase rate can be employed. In this regard, the period where the catalyst temperature increases at the temperature increase rate larger than the predetermined temperature increase rate is, for example, a constant period from the start of the engine operation after the stop of the engine operation for a relatively long period, that is, a so-called cold start period of the engine.

Further, broadly, the ninth to eleventh embodiments are examples of embodiment which employs the method for acquiring the active element solid solution degree for the air-fuel ratio control on the basis of the catalyst temperature integration value. Therefore, an acquisition method of the active element solid solution degree for the air-fuel ratio control on the basis of the catalyst temperature integration value other than the methods described relating to the ninth to eleventh embodiments may be employed.

Next, further another embodiment which employs a method for acquiring the active element solid solution degree calculated on the basis of various parameters relating to the engine as the active element solid solution for the air-fuel ratio control (hereinafter, this embodiment may be referred to as—twelfth embodiment—) will be described.

The constitution and controls of the twelfth embodiment not described below are the same as those of the aforementioned embodiments or are those derived naturally from the technical concept of the invention embodied in the twelfth embodiment. Further, as far as no contradiction occurs, the controls of the aforementioned embodiments may be combined with those of the twelfth embodiment described below.

Further, in the following description, "an output value trace length" means—a length of the trace of the output value of the downstream air-fuel ratio sensor in a predetermined time period—, in other words,—a length of the line connecting a plurality of the output values output from the downstream air-fuel ratio sensor in a predetermined time period in chronological order—.

In the twelfth embodiment, an output value trace length when the stoichiometric air-fuel ratio control is performed under the condition that the active element solid solution degree is a predetermined solid solution degree is previously obtained by an experiment, etc. Then, the thus obtained output value trace length is memorized in the electronic control unit as a base output value trace length.

Further, a ratio of the change amount of the active element solid solution degree relative to each change amount of the output value trace length, that is, the change amount of the active element solid solution degree per unit output value trace length change amount (hereinafter, this change amount may be referred to as—solid solution change rate—) is previously obtained by an experiment, etc. Then, the thus obtained solid solution degree change rates are memorized in the electronic control unit.

Then, while the stoichiometric air-fuel ratio control is performed during the engine operation, the actual output value trace length (hereinafter, this actual length may be referred to as—output value trace length during the engine operation—) is acquired and then, a difference of the output value trace length during the engine operation relative to the base output value trace length (hereinafter, this difference may be referred to as—trace length difference—) is calculated.

Then, a value, which is obtained by adding to the base solid solution degree, a value obtained by multiplying the aforementioned solid solution degree change rate by the thus calculated trace length difference, is acquired as the active element solid solution degree for the air-fuel ratio control. That is, according to the twelfth embodiment, the active element solid solution degree for the air-fuel ratio control Ds is acquired according to the following formula 7. In the formula 7, "Dsb" is—base solid solution degree—, "Rds" is—solid solution degree change rate—, "Lb" is—base output value trace length—and "L" is—output value trace length during the engine operation—.

$$Ds=Dsb+Rds*(Lb-L) \quad (7)$$

Figure 16:
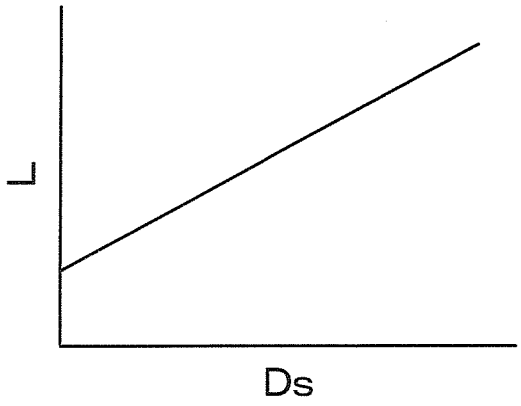
FIG. 16 is a view showing a relationship between an active element solid solution degree Ds and an output value trace length L.

According to the twelfth embodiment, the following effect can be obtained. That is, as shown in FIG. 16, by the study of the inventors of this application, it has been realized that as the amount of the precipitated active element decreases, that is, as the active element solid solution degree Ds increases, the output value trace length L increases. In this regard, according to the twelfth embodiment, the active element solid solution degree is calculated on the basis of the output value trace length during the engine operation. That is, the active element solid solution degree is calculated using the output value trace length which is a parameter which varies depending on the active element solid solution degree. Therefore, according to the twelfth embodiment, the effect that the active element solid solution degree can be accurately calculated can be obtained. Further, according to the twelfth embodiment, the effect that the active element solid solution degree can be accurately calculated without using the catalyst temperature can be obtained.

Further, according to the twelfth embodiment, the active element solid solution degree is calculated using the formula 7. Then, as apparent from the formula 7, the formula 7 is a considerably simple formula and thus, the burden of the calculation of the active element solid solution degree using the formula 7 is considerably small. Thus, according to the twelfth embodiment, the effect that the active element solid solution degree can be calculated with the considerably small calculation burden can be obtained.

Next, further another embodiment which employs a method for acquiring the active element solid solution degree calculated on the basis of various parameters relating to the engine as the active element solid solution for the air-fuel ratio control (hereinafter, this embodiment may be referred to as—thirteenth embodiment—) will be described. The constitution and controls of the thirteenth embodiment not described below are the same as those of the aforementioned embodiments or are those derived naturally from the technical concept of the invention embodied in the thirteenth embodiment. Further, as far as no contradiction occurs, the controls of the aforementioned embodiments may be combined with those of the thirteenth embodiment described below.

In the thirteenth embodiment, an output value trace length when the stoichiometric air-fuel ratio control is performed under the condition that the active element solid solution degree is a predetermined solid solution degree is previously obtained by an experiment, etc. Then, the thus obtained output value trace length is memorized in the electronic control unit as a base output value trace length.

Further, the maximum solid solution degree is previously determined. The maximum solid solution degree is, for example, "100". Then, while the stoichiometric air-fuel ratio control is performed during the engine operation, the actual output value trace length (i.e. the output value trace length during the engine operation) is acquired and then, a difference of the output value trace length during the engine operation relative to the base output value trace length (i.e. the output value trace length difference) is calculated.

Then, a value, which is obtained by subtracting from "100" which is the maximum solid solution degree, a value obtained by dividing the thus calculated output value trace length difference by the base output value trace length, is acquired as the active element solid solution degree for the air-fuel ratio control. That is, according to the thirteenth embodiment, the active element solid solution degree for the air-fuel ratio control Ds is acquired according to the following formula 8. In the formula 8, "Lb" is—base output value trace length—and "L" is—output value trace length during the engine operation—.

$$Ds=(100-(Lb-L)/Lb) \quad (8)$$

According to the thirteenth embodiment, the following effect can be obtained. That is, according to the thirteenth embodiment, similar to the twelfth embodiment, the active element solid solution degree is calculated on the basis of the output value trace length which is a parameter which varies depending on the active element solid solution degree. Therefore, according to the thirteenth embodiment, the effect that the active element solid solution degree can be accurately calculated can be obtained.

Further, according to the thirteenth embodiment, the active element solid solution degree is calculated using the formula 8. Then, as apparent from the formula 8, the formula 8 is a considerably simple formula and thus, the burden of the calculation of the active element solid solution degree using the formula 8 is considerably small. Also, contrary to the twelfth embodiment, the solid solution degree change rate is not needed and therefore, it is not necessary to previously prepare the solid solution degree change rate for calculating the active element solid solution degree.

Further, the solid solution degree change rate may not be constant and in this case, if the active element solid solution degree is calculated using the solid solution degree change rate, the calculated active element solid solution degree is not an accurate value. In this regard, according to the thirteenth embodiment, the active element solid solution degree is calculated without using the solid solution degree change rate.

Thus, according to the thirteenth embodiment, the effect that the burden for previously obtaining the solid solution degree change rate can be omitted and the active element solid solution degree can be accurately calculated with the considerably small calculation burden can be obtained.

Next, further another embodiment which employs a method for acquiring the active element solid solution degree calculated on the basis of various parameters relating to the engine as the active element solid solution for the air-fuel ratio control (hereinafter, this embodiment may be referred to as—fourteenth embodiment—) will be described. The constitution and controls of the fourteenth embodiment not described below are the same as those of the aforementioned embodiments or are those derived naturally from the technical concept of the invention embodied in the fourteenth embodiment. Further, as far as no contradiction occurs, the controls of the aforementioned embodiments may be combined with those of the fourteenth embodiment described below.

In the fourteenth embodiment, a relationship between the active element solid solution degree and the output value trace length when the stoichiometric air-fuel ratio control is performed is previously obtained by an experiment, etc. Then, the thus obtained relationship is memorized in the electronic control unit as a trace length solid solution degree relationship. Then, while the stoichiometric air-fuel ratio control is performed during the engine operation, the actual output value trace length (i.e. the output value trace length during the engine operation) is acquired and then, the active element solid solution degree is calculated from the trace length solid solution degree relationship on the basis of this output value trace length during the engine operation. Then, the thus calculated active element solid solution degree is acquired as the active element solid solution degree for the air-fuel ratio control.

In the fourteenth embodiment, the output value trace lengths every the active element solid solution degree when the stoichiometric air-fuel ratio control is performed are previously obtained by an experiment, etc. then, the active element solid solution degrees are memorized in the electronic control unit as a form of a map as a function of the output value trace length on the basis of the relationship between the obtained output value trace length and the corresponding active element solid solution degree, then, while the stoichiometric air-fuel ratio control is performed during the engine operation, the output value trace length during the engine operation is acquired, then, the active element solid solution degree corresponding to this output value trace length during the engine operation is acquired from the map, and then, the thus acquired active element solid solution degree may be acquired as the active element solid solution degree for the air-fuel ratio control and in this case, the aforementioned trace length solid solution degree relationship is the aforementioned map.

According to the fourteenth embodiment, the following effect can be obtained. That is, while a constant relationship exists between the output value trace length and the active element solid solution degree, it is not easy to express such a relationship by one relational expression and if the active element solid solution degree is calculated using a relational expression which generally expresses such a relationship, the calculated active element solid solution degree may not be an accurate value. On the other hand, according to the fourteenth embodiment, the relationship between the output value trace length and the active element solid solution degree previously obtained by an experiment, etc. is memorized in the electronic control unit and then, during the engine operation, the active element solid solution degree is acquired on the basis of this memorized relationship and the output value trace length during the engine operation. Thus, according to the fourteenth embodiment, the effect that the accurate active element solid solution degree can be calculated can be obtained.

Broadly, the twelfth to fourteenth embodiments are examples of embodiment which employs the method for acquiring the active element solid solution degree for the air-fuel ratio control on the basis of the output value trace length. Therefore, an acquisition method of the active element solid solution degree for the air-fuel ratio control on the basis of the output value trace length other than the methods described relating to the twelfth to fourteenth embodiments may be employed.

Further, in the twelfth to fourteenth embodiments, the predetermined time period for acquiring the output value trace length may be any period where the change of the output value trace length occurs due to the change of the active element solid solution and for example, as the predetermined time period, a period where the downstream air-fuel ratio sensor outputs the output value corresponding to an air-fuel ratio richer than the stoichiometric air-fuel ratio when the stoichiometric air-fuel ratio control is performed or a period where the downstream air-fuel ratio sensor outputs the output value corresponding to an air-fuel ratio leaner than the stoichiometric air-fuel ratio when the stoichiometric air-fuel ratio control is performed can be employed.

Otherwise, in the case that when the catalyst temperature is lower than the predetermined solid solution temperature and lower than the predetermined precipitation temperature, an air-fuel ratio active control is performed in the engine for controlling the air-fuel ratio of the exhaust gas such that the exhaust gas having the air-fuel ratio richer than the stoichiometric air-fuel ratio and the exhaust gas having the air-fuel ratio leaner than the stoichiometric air-fuel ratio alternatively flow into the catalyst, a period where the downstream air-fuel ratio sensor outputs the output value corresponding to an air-fuel ratio richer than the stoichiometric air-fuel ratio when the air-fuel ratio active control is performed or a period where the downstream air-fuel ratio sensor outputs the output value corresponding to an air-fuel ratio leaner than the stoichiometric air-fuel ratio when the air-fuel ratio active control is performed or a period selected from the period where when the air-fuel ratio active control is performed independently of whether the downstream air-fuel ratio sensor outputs the output value corresponding to an air-fuel ratio richer or leaner than the stoichiometric air-fuel ratio can be employed as the aforementioned predetermined period can be employed.

In the case that the air-fuel ratio active control is performed for acquiring the output value trace length independently of the catalyst temperature, if the exhaust gas having the air-fuel ratio considerably richer than the stoichiometric air-fuel ratio and the exhaust gas having the air-fuel ratio considerably leaner than the stoichiometric air-fuel ratio are alternatively supplied to the catalyst, the active element transforms as a solid solution into the carrier and precipitates from the carrier when the air-fuel ratio active control is performed and therefore, the accurate output value trace length may not be acquired. Therefore, in order to restrict the transform of the active element as a solid solution into the carrier and the precipitation of the active element from the carrier when the air-fuel ratio active control is performed, it is preferred that the exhaust gas having the air-fuel ratio slightly richer than the stoichiometric air-fuel ratio and the exhaust gas having the air-fuel ratio slightly leaner than the stoichiometric air-fuel ratio are alternatively supplied to the catalyst.

Next, further another embodiment which employs a method for acquiring the active element solid solution degree calculated on the basis of various parameters relating to the engine as the active element solid solution for the air-fuel ratio control (hereinafter, this embodiment may be referred to as—fifteenth embodiment—) will be described.

The constitution and controls of the fifteenth embodiment not described below are the same as those of the aforementioned embodiments or are those derived naturally from the technical concept of the invention embodied in the fifteenth embodiment. Further, as far as no contradiction occurs, the controls of the aforementioned embodiments may be combined with those of the fifteenth embodiment described below.

Further, in the following description, "the positive direction inversion number" means—the number of the inversion of the change rage of the output value of the downstream air-fuel ratio sensor in a predetermined time period from a negative value to a positive value—, "the negative direction inversion number" means—the number of the inversion of the change rage of the output value of the downstream air-fuel ratio sensor in a predetermined time period from a positive value to a negative value—and "the total inversion number" means—the total number of the positive and negative direction inversion numbers—.

In the fifteenth embodiment, the positive direction inversion number when the stoichiometric air-fuel ratio control is performed under the condition that the active element solid solution degree is a predetermined solid solution degree is previously obtained by an experiment, etc. Then, the thus obtained positive direction inversion number is memorized in the electronic control unit as a base positive direction inversion number and the aforementioned predetermined solid solution degree is memorized in the electronic control unit as a base solid solution degree.

Further, a ratio of the change amount of the active element solid solution degree relative to each change amount of the positive direction inversion number, that is, the change amount of the active element solid solution degree per unit positive direction inversion number change amount (hereinafter, this change amount may be referred to as—solid solution change rate—) is previously obtained by an experiment, etc. Then, the thus obtained solid solution degree change rates are memorized in the electronic control unit.

Then, while the stoichiometric air-fuel ratio control is performed during the engine operation, the actual positive direction inversion number (hereinafter, this actual positive direction inversion number may be referred to as—positive direction inversion number during the engine operation—) is acquired and then, a difference of the positive direction inversion number during the engine operation relative to the base positive direction inversion number (hereinafter, this difference may be referred to as—positive direction inversion number difference—) is calculated.

Then, a value, which is obtained by adding to the base solid solution degree, a value obtained by multiplying the aforementioned solid solution degree change rate by the thus calculated positive direction inversion number difference, is acquired as the active element solid solution degree for the air-fuel ratio control. That is, in this case, the active element solid solution degree for the air-fuel ratio control Ds is acquired according to the following formula 9. In the formula 9, "Dsb" is—base solid solution degree—, "Rds" is—solid solution degree change rate—, "Npb" is—base positive direction inversion number—and "Np" is—positive direction inversion number during the engine operation—.

$$Ds=Dsb+Rds*(Npb-Np) \quad (9)$$

Otherwise, in the fifteenth embodiment, the negative direction inversion number when the stoichiometric air-fuel ratio control is performed under the condition that the active element solid solution degree is a predetermined solid solution degree is previously obtained by an experiment, etc. Then, the thus obtained negative direction inversion number is memorized in the electronic control unit as a base negative direction inversion number and the aforementioned predetermined solid solution degree is memorized in the electronic control unit as a base solid solution degree.

Further, a ratio of the change amount of the active element solid solution degree relative to each change amount of the negative direction inversion number, that is, the change amount of the active element solid solution degree per unit negative direction inversion number change amount (hereinafter, this change amount may be referred to as—solid solution change rate—) is previously obtained by an experiment, etc. Then, the thus obtained solid solution degree change rates are memorized in the electronic control unit.

Then, while the stoichiometric air-fuel ratio control is performed during the engine operation, the actual negative direction inversion number (hereinafter, this actual negative direction inversion number may be referred to as—negative direction inversion number during the engine operation—) is acquired and then, a difference of the negative direction inversion number during the engine operation relative to the base negative direction inversion number (hereinafter, this difference may be referred to as—negative direction inversion number difference—) is calculated.

Then, a value, which is obtained by adding to the base solid solution degree, a value obtained by multiplying the aforementioned solid solution degree change rate by the thus calculated negative direction inversion number difference, is acquired as the active element solid solution degree for the air-fuel ratio control. That is, in this case, the active element solid solution degree for the air-fuel ratio control Ds is acquired according to the following formula 10. In the formula 10, "Dsb" is—base solid solution degree—, "Rds" is—solid solution degree change rate—, "Nnb" is—base negative direction inversion number—and "Nn" is—negative direction inversion number during the engine operation—.

$$Ds=Dsb+Rds*(Nnb-Nn) \quad (10)$$

Otherwise, in the fifteenth embodiment, the total inversion number when the stoichiometric air-fuel ratio control is performed under the condition that the active element solid solution degree is a predetermined solid solution degree is previously obtained by an experiment, etc. Then, the thus obtained total inversion number is memorized in the electronic control unit as a base total inversion number and the aforementioned predetermined solid solution degree is memorized in the electronic control unit as a base solid solution degree.

Further, a ratio of the change amount of the active element solid solution degree relative to each change amount of the total inversion number, that is, the change amount of the active element solid solution degree per unit total inversion number change amount (hereinafter, this change amount may be referred to as—solid solution change rate—) is previously obtained by an experiment, etc. Then, the thus obtained solid solution degree change rates are memorized in the electronic control unit.

Then, while the stoichiometric air-fuel ratio control is performed during the engine operation, the actual total inversion number (hereinafter, this actual total inversion number may be referred to as—total inversion number during the engine operation—) is acquired and then, a difference of the total inversion number during the engine operation relative to the base total inversion number (hereinafter, this difference may be referred to as—total inversion number difference—) is calculated.

Then, a value, which is obtained by adding to the base solid solution degree, a value obtained by multiplying the aforementioned solid solution degree change rate by the thus calculated total inversion number difference, is acquired as the active element solid solution degree for the air-fuel ratio control. That is, in this case, the active element solid solution degree for the air-fuel ratio control Ds is acquired according to the following formula 11. In the formula 10, "Dsb" is—base solid solution degree—, "Rds" is—solid solution degree change rate—, "Nsb" is—base total inversion number—and "Ns" is—total inversion number during the engine operation—.

$$Ds=Dsb+Rds*(Nsb-Ns) \quad (11)$$

Figure 17:
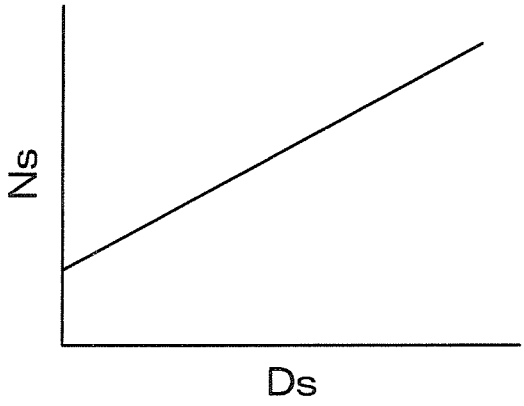
FIG. 17 is a view showing a relationship between the active element solid solution degree Ds and an inversion number Ns.

According to the fifteenth embodiment, the following effect can be obtained. That is, as shown in FIG. 17, by the study of the inventors of this application, it has been realized that as the amount of the precipitated active element decreases, that is, as the active element solid solution degree Ds increases, the positive, negative and total inversion numbers (hereinafter, these inversion numbers may be collectively referred to as—inversion number—) Ns increases.

In this regard, according to the fifteenth embodiment, the active element solid solution degree is calculated on the basis of the inversion number during the engine operation. That is, the active element solid solution degree is calculated using the inversion number which is a parameter which varies depending on the active element solid solution degree. Therefore, according to the fifteenth embodiment, the effect that the active element solid solution degree can be accurately calculated can be obtained.

Further, according to the fifteenth embodiment, the effect that the active element solid solution degree can be accurately calculated without using the catalyst temperature can be obtained.

Further, according to the fifteenth embodiment, the active element solid solution degree is calculated using the formulas 9 to 11. Then, as apparent from the formulas 9 to 11, these formulas are considerably simple formulas and thus, the burden of the calculation of the active element solid solution degree using these formulas is considerably small. Thus, according to the fifteenth embodiment, the effect that the active element solid solution degree can be calculated with the considerably small calculation burden can be obtained.

Next, further another embodiment which employs a method for acquiring the active element solid solution degree calculated on the basis of various parameters relating to the engine as the active element solid solution for the air-fuel ratio control (hereinafter, this embodiment may be referred to as—sixteenth embodiment—) will be described. The constitution and controls of the sixteenth embodiment not described below are the same as those of the aforementioned embodiments or are those derived naturally from the technical concept of the invention embodied in the sixteenth embodiment. Further, as far as no contradiction occurs, the controls of the aforementioned embodiments may be combined with those of the sixteenth embodiment described below.

In the sixteenth embodiment, the positive direction inversion number when the stoichiometric air-fuel ratio control is performed under the condition that the active element solid solution degree is a predetermined solid solution degree is previously obtained by an experiment, etc. Then, the thus obtained positive direction inversion number is memorized in the electronic control unit as a base positive direction inversion number.

Further, the maximum solid solution degree is previously determined. The maximum solid solution degree is, for example, "100". Then, while the stoichiometric air-fuel ratio control is performed during the engine operation, the actual positive direction inversion number (i.e. the positive direction inversion number during the engine operation) is acquired and then, a difference of the positive direction inversion number during the engine operation relative to the base positive direction inversion number (i.e. the positive direction inversion number difference) is calculated.

Then, a value, which is obtained by subtracting from "100" which is the maximum solid solution degree, a value obtained by dividing the thus calculated positive direction inversion number difference by the base positive direction inversion number, is acquired as the active element solid solution degree for the air-fuel ratio control. That is, in this case, the active element solid solution degree for the air-fuel ratio control Ds is acquired according to the following formula 12. In the formula 12, "Npb" is—base positive direction inversion number—and "Np" is—positive direction inversion number during the engine operation—.

$$Ds=(100-(Npb-Np)/Npb) \quad (12)$$

Otherwise, in the sixteenth embodiment, the negative direction inversion number when the stoichiometric air-fuel ratio control is performed under the condition that the active element solid solution degree is a predetermined solid solution degree is previously obtained by an experiment, etc. Then, the thus obtained negative direction inversion number is memorized in the electronic control unit as a base negative direction inversion number.

Further, the maximum solid solution degree is previously determined. The maximum solid solution degree is, for example, "100". Then, while the stoichiometric air-fuel ratio control is performed during the engine operation, the actual negative direction inversion number (i.e. the negative direction inversion number during the engine operation) is acquired and then, a difference of the negative direction inversion number during the engine operation relative to the base negative direction inversion number (i.e. the negative direction inversion number difference) is calculated.

Then, a value, which is obtained by subtracting from "100" which is the maximum solid solution degree, a value obtained by dividing the thus calculated negative direction inversion number difference by the base negative direction inversion number, is acquired as the active element solid solution degree for the air-fuel ratio control. That is, in this case, the active element solid solution degree for the air-fuel ratio control Ds is acquired according to the following formula 13. In the formula 13, "Nnb" is—base negative direction inversion number—and "Nn" is—negative direction inversion number during the engine operation—.

$$Ds=(100-(Nnb-Nn)/Nnb) \quad (13)$$

Otherwise, in the sixteenth embodiment, the total inversion number when the stoichiometric air-fuel ratio control is performed under the condition that the active element solid solution degree is a predetermined solid solution degree is previously obtained by an experiment, etc. Then, the thus obtained total inversion number is memorized in the electronic control unit as a base total inversion number.

Further, the maximum solid solution degree is previously determined. The maximum solid solution degree is, for example, "100". Then, while the stoichiometric air-fuel ratio control is performed during the engine operation, the actual total inversion number (i.e. the total inversion number during the engine operation) is acquired and then, a difference of the total inversion number during the engine operation relative to the base total inversion number (i.e. the total inversion number difference) is calculated.

Then, a value, which is obtained by subtracting from "100" which is the maximum solid solution degree, a value obtained by dividing the thus calculated total inversion number difference by the base total inversion number, is acquired as the active element solid solution degree for the air-fuel ratio control. That is, in this case, the active element solid solution degree for the air-fuel ratio control Ds is acquired according to the following formula 14. In the formula 14, "Nsb" is—base total inversion number—and "Ns" is—total inversion number during the engine operation—.

$$Ds=(100-(Nsb-Ns)/Nsb) \quad (14)$$

According to the sixteenth embodiment, the following effect can be obtained. That is, according to the sixteenth embodiment, similar to the fifteenth embodiment, the active element solid solution degree is calculated using the inversion number (i.e. the positive or negative or total inversion number) which is a parameter which varies depending on the active element solid solution degree. Therefore, according to the sixteenth embodiment, the effect that the active element solid solution degree can be accurately calculated can be obtained.

Further, according to the sixteenth embodiment, the active element solid solution degree is calculated using the formulas 12 to 14. Then, as apparent from the formulas 12 to 14, these formulas are considerably simple formulas and thus, the burden of the calculation of the active element solid solution degree using these formulas is considerably small. Also, contrary to the fifteenth embodiment, the solid solution degree change rate is not needed and therefore, it is not necessary to previously prepare the solid solution degree change rate for calculating the active element solid solution degree.

Further, the solid solution degree change rate may not be constant and in this case, if the active element solid solution degree is calculated using the solid solution degree change rate, the calculated active element solid solution degree is not an accurate value. In this regard, according to the sixteenth embodiment, the active element solid solution degree is calculated without using the solid solution degree change rate.

Thus, according to the sixteenth embodiment, the effect that the burden for previously obtaining the solid solution degree change rate can be omitted and the active element solid solution degree can be accurately calculated with the considerably small calculation burden can be obtained.

Next, further another embodiment which employs a method for acquiring the active element solid solution degree calculated on the basis of various parameters relating to the engine as the active element solid solution for the air-fuel ratio control (hereinafter, this embodiment may be referred to as—seventeenth embodiment—) will be described. The constitution and controls of the seventeenth embodiment not described below are the same as those of the aforementioned embodiments or are those derived naturally from the technical concept of the invention embodied in the seventeenth embodiment. Further, as far as no contradiction occurs, the controls of the aforementioned embodiments may be combined with those of the seventeenth embodiment described below.

In the seventeenth embodiment, a relationship between the active element solid solution degree and the positive direction inversion number when the stoichiometric air-fuel ratio control is performed is previously obtained by an experiment, etc. Then, the thus obtained relationship is memorized in the electronic control unit as a positive direction inversion number solid solution degree relationship. Then, while the stoichiometric air-fuel ratio control is performed during the engine operation, the actual positive direction inversion number (i.e. the positive direction inversion number during the engine operation) is acquired and then, the active element solid solution degree is calculated from the positive direction inversion number solid solution degree relationship on the basis of this positive direction inversion number during the engine operation. Then, the thus calculated active element solid solution degree is acquired as the active element solid solution degree for the air-fuel ratio control.

In this case, the positive direction inversion numbers every the active element solid solution degree when the stoichiometric air-fuel ratio control is performed are previously obtained by an experiment, etc. then, the active element solid solution degrees are memorized in the electronic control unit as a form of a map as a function of the positive direction inversion number on the basis of the relationship between the obtained positive direction inversion number and the corresponding active element solid solution degree, then, while the stoichiometric air-fuel ratio control is performed during the engine operation, the positive direction inversion number (i.e. the positive direction inversion number during the engine operation) is acquired, then, the active element solid solution degree corresponding to this positive direction inversion number during the engine operation is acquired from the map, and then, the thus acquired active element solid solution degree may be acquired as the active element solid solution degree for the air-fuel ratio control and in this case, the aforementioned positive direction inversion number solid solution degree relationship is the aforementioned map.

Otherwise, in the seventeenth embodiment, a relationship between the active element solid solution degree and the negative direction inversion number when the stoichiometric air-fuel ratio control is performed is previously obtained by an experiment, etc. Then, the thus obtained relationship is memorized in the electronic control unit as a negative direction inversion number solid solution degree relationship. Then, while the stoichiometric air-fuel ratio control is performed during the engine operation, the actual negative direction inversion number (i.e. the negative direction inversion number during the engine operation) is acquired and then, the active element solid solution degree is calculated from the negative direction inversion number solid solution degree relationship on the basis of this negative direction inversion number during the engine operation. Then, the thus calculated active element solid solution degree is acquired as the active element solid solution degree for the air-fuel ratio control.

In this case, the negative direction inversion numbers every the active element solid solution degree when the stoichiometric air-fuel ratio control is performed are previously obtained by an experiment, etc. then, the active element solid solution degrees are memorized in the electronic control unit as a form of a map as a function of the negative direction inversion number on the basis of the relationship between the obtained negative direction inversion number and the corresponding active element solid solution degree, then, while the stoichiometric air-fuel ratio control is performed during the engine operation, the negative direction inversion number (i.e. the negative direction inversion number during the engine operation) is acquired, then, the active element solid solution degree corresponding to this negative direction inversion number during the engine operation is acquired from the map, and then, the thus acquired active element solid solution degree may be acquired as the active element solid solution degree for the air-fuel ratio control and in this case, the aforementioned negative direction inversion number solid solution degree relationship is the aforementioned map.

Otherwise, in the seventeenth embodiment, a relationship between the active element solid solution degree and the total inversion number when the stoichiometric air-fuel ratio control is performed is previously obtained by an experiment, etc. Then, the thus obtained relationship is memorized in the electronic control unit as a total inversion number solid solution degree relationship. Then, while the stoichiometric air-fuel ratio control is performed during the engine operation, the actual total inversion number (i.e. the total inversion number during the engine operation) is acquired and then, the active element solid solution degree is calculated from the total inversion number solid solution degree relationship on the basis of this total inversion number during the engine operation. Then, the thus calculated active element solid solution degree is acquired as the active element solid solution degree for the air-fuel ratio control.

In this case, the total inversion numbers every the active element solid solution degree when the stoichiometric air-fuel ratio control is performed are previously obtained by an experiment, etc. then, the active element solid solution degrees are memorized in the electronic control unit as a form of a map as a function of the total inversion number on the basis of the relationship between the obtained total inversion number and the corresponding active element solid solution degree, then, while the stoichiometric air-fuel ratio control is performed during the engine operation, the total inversion number (i.e. the total inversion number during the engine operation) is acquired, then, the active element solid solution degree corresponding to this total inversion number during the engine operation is acquired from the map, and then, the thus acquired active element solid solution degree may be acquired as the active element solid solution degree for the air-fuel ratio control and in this case, the aforementioned total inversion number solid solution degree relationship is the aforementioned map.

According to the seventeenth embodiment, the following effect can be obtained. That is, while a constant relationship exists between the inversion number and the active element solid solution degree, it is not easy to express such a relationship by one relational expression and if the active element solid solution degree is calculated using a relational expression which generally expresses such a relationship, the calculated active element solid solution degree may not be an accurate value. On the other hand, according to the seventeenth embodiment, the relationship between the inversion number and the active element solid solution degree previously obtained by an experiment, etc. is memorized in the electronic control unit and then, during the engine operation, the active element solid solution degree is acquired on the basis of this memorized relationship and the inversion number during the engine operation. Thus, according to the seventeenth embodiment, the effect that the accurate active element solid solution degree can be calculated can be obtained.

Broadly, the fifteenth to seventeenth embodiments are examples of embodiment which employs the method for acquiring the active element solid solution degree for the air-fuel ratio control on the basis of the inversion number (i.e. the positive or negative or total inversion number). Therefore, an acquisition method of the active element solid solution degree for the air-fuel ratio control on the basis of the inversion number other than the methods described relating to the fifteenth to seventeenth embodiments may be employed.

In the fifteenth to seventeenth embodiments, the predetermined time period for acquiring the inversion number may be any period where the change of the inversion number occurs due to the change of the active element solid solution and for example, as the predetermined time period, a period where the downstream air-fuel ratio sensor outputs the output value corresponding to the air-fuel ratio richer than the stoichiometric air-fuel ratio when the stoichiometric air-fuel ratio control is performed or a period where the downstream air-fuel ratio sensor outputs the output value corresponding to the air-fuel ratio leaner than the stoichiometric air-fuel ratio when the stoichiometric air-fuel ratio control is performed can be employed.

Otherwise, in the case that when the catalyst temperature is lower than the predetermined solid solution temperature and lower than the predetermined precipitation temperature, an air-fuel ratio active control is performed in the engine for controlling the air-fuel ratio of the exhaust gas such that the exhaust gas having the air-fuel ratio richer than the stoichiometric air-fuel ratio and the exhaust gas having the air-fuel ratio leaner than the stoichiometric air-fuel ratio alternatively flow into the catalyst, a period where the downstream air-fuel ratio sensor outputs the output value corresponding to an air-fuel ratio richer than the stoichiometric air-fuel ratio when the air-fuel ratio active control is performed or a period where the downstream air-fuel ratio sensor outputs the output value corresponding to an air-fuel ratio leaner than the stoichiometric air-fuel ratio when the air-fuel ratio active control is performed or a period selected from the period where when the air-fuel ratio active control is performed independently of whether the downstream air-fuel ratio sensor outputs the output value corresponding to an air-fuel ratio richer or leaner than the stoichiometric air-fuel ratio can be employed as the aforementioned predetermined period can be employed.

In the case that the air-fuel ratio active control is performed for acquiring the inversion number independently of the catalyst temperature, if the exhaust gas having the air-fuel ratio considerably richer than the stoichiometric air-fuel ratio and the exhaust gas having the air-fuel ratio considerably leaner than the stoichiometric air-fuel ratio are alternatively supplied to the catalyst, the active element transforms as a solid solution into the carrier and precipitates from the carrier when the air-fuel ratio active control is performed and therefore, the accurate inversion number may not be acquired. Therefore, in order to restrict the transform of the active element as a solid solution into the carrier and the precipitation of the active element from the carrier when the air-fuel ratio active control is performed, it is preferred that the exhaust gas having the air-fuel ratio slightly richer than the stoichiometric air-fuel ratio and the exhaust gas having the air-fuel ratio slightly leaner than the stoichiometric air-fuel ratio are alternatively supplied to the catalyst.

Further, in the fifteenth to seventeenth embodiments, the total inversion number is the total number of the number of the inversion of the change rage of the output value of the downstream air-fuel ratio sensor in the predetermined time period from a negative value to a positive value (i.e. the positive direction inversion number) and the number of the inversion of the change rage of the output value of the downstream air-fuel ratio sensor in the predetermined time period from a positive value to a negative value (i.e. the negative direction inversion number). In this regard, the length of the predetermined time period relating to the positive direction inversion number which constitutes the total inversion number and the length of the predetermined time period relating to the negative direction inversion number which constitutes the total inversion number may be the same as or different from each other. In the case that the length of the predetermined time period relating to the positive direction inversion number which constitutes the total inversion number and the length of the predetermined time period relating to the negative direction inversion number which constitutes the total inversion number is the same as each other, these predetermined time periods may correspond to or be different from each other.

Next, further another embodiment which employs a method for acquiring the active element solid solution degree calculated on the basis of various parameters relating to the engine as the active element solid solution for the air-fuel ratio control (hereinafter, this embodiment may be referred to as—eighteenth embodiment—) will be described. The constitution and controls of the eighteenth embodiment not described below are the same as those of the aforementioned embodiments or are those derived naturally from the technical concept of the invention embodied in the eighteenth embodiment. Further, as far as no contradiction occurs, the controls of the aforementioned embodiments may be combined with those of the eighteenth embodiment described below. In the following description, "an oxygen discharge amount" means—an amount of an oxygen discharged from the catalyst—.

In the eighteenth embodiment, the stoichiometric air-fuel ratio control, the fuel cut control and a fuel amount increase control after the fuel cut control can be selectively performed. In this regard, the stoichiometric air-fuel ratio control is the same as that according to the first embodiment. Further, the fuel cut control is the same as that according to the second embodiment. Further, the fuel amount increase control after the fuel cut control is a control for setting the target fuel injection amount such that the fuel injection amount is increased to control the air-fuel ratio of the mixture gas to an air-fuel ratio richer than the stoichiometric air-fuel ratio and performed for a constant time period when the fuel cut control ends.

Further, the catalyst has an oxygen trap and discharge ability for trapping the oxygen in the exhaust gas by absorbing or storing the oxygen in the exhaust gas when the air-fuel ratio of the exhaust gas flowing thereinto is leaner than the stoichiometric air-fuel ratio and for discharging the trapped oxygen when the air-fuel ratio of the exhaust gas flowing thereinto is richer than the stoichiometric air-fuel ratio.

In the eighteenth embodiment, an oxygen discharge amount (an amount of the oxygen discharged from the catalyst by the oxygen trap and discharge ability of the catalyst) when the fuel amount increase control after the fuel cut control is performed under the condition that the active element solid solution degree is a predetermined solid solution degree is previously obtained by an experiment, etc. Then, the thus obtained oxygen discharge amount is memorized in the electronic control unit as a base oxygen discharge amount.

Further, a ratio of the change amount of the active element solid solution degree relative to each change amount of the oxygen discharge amount, that is, the change amount of the active element solid solution degree per unit oxygen discharge amount change amount (hereinafter, this change amount may be referred to as—solid solution change rate—) is previously obtained by an experiment, etc. Then, the thus obtained solid solution degree change rates are memorized in the electronic control unit.

Then, while the fuel amount increase control after the fuel cut control is performed during the engine operation, the actual oxygen discharge amount (hereinafter, this actual oxygen discharge amount may be referred to as—oxygen discharge amount during the engine operation—) is acquired and then, a difference of the oxygen discharge amount during the engine operation relative to the base oxygen discharge amount (hereinafter, this difference may be referred to as—oxygen discharge amount difference—) is calculated.

Then, a value, which is obtained by adding to the base solid solution degree, a value obtained by multiplying the aforementioned solid solution degree change rate by the thus calculated oxygen discharge amount difference, is acquired as the active element solid solution degree for the air-fuel ratio control.

That is, according to the eighteenth embodiment, the active element solid solution degree for the air-fuel ratio control Ds is acquired according to the following formula 15. In the formula 15, "Dsb" is—base solid solution degree—, "Rds" is—solid solution degree change rate—, "Aob" is—base oxygen discharge amount—and "Ao" is—oxygen discharge amount during the engine operation—.

$$Ds=Dsb+Rds*(Aob-Ao) \quad (15)$$

Figure 18:
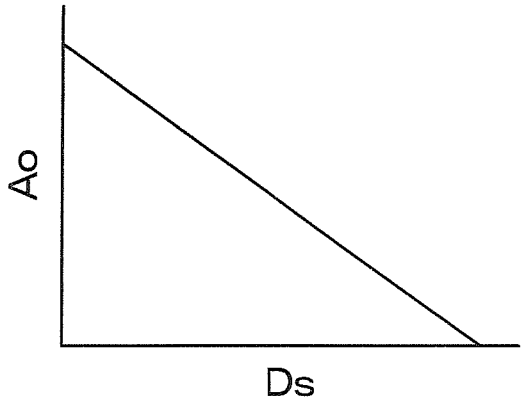
FIG. 18 is a view showing a relationship between the active element solid solution degree Ds and an oxygen discharge amount Ao.

According to the eighteenth embodiment, the following effect can be obtained. That is, as shown in FIG. 18, by the study of the inventors of this application, it has been realized that as the amount of the precipitated active element decreases, that is, as the active element solid solution degree Ds increases, the oxygen discharge amount decreases when the fuel amount increase control after the fuel cut control. In this regard, according to the eighteenth embodiment, the active element solid solution degree is calculated on the basis of the oxygen discharge amount during the engine operation when the fuel amount increase control after the fuel cut control. That is, the active element solid solution degree is calculated using the oxygen discharge amount which is a parameter which varies depending on the active element solid solution degree. Therefore, according to the eighteenth embodiment, the effect that the active element solid solution degree can be accurately calculated can be obtained. Further, according to the eighteenth embodiment, the effect that the active element solid solution degree can be accurately calculated without using the catalyst temperature can be obtained.

Further, according to the eighteenth embodiment, the active element solid solution degree is calculated using the formula 15. Then, as apparent from the formula 15, the formula 15 is a considerably simple formula and thus, the burden of the calculation of the active element solid solution degree using the formula 15 is considerably small. Thus, according to the eighteenth embodiment, the effect that the active element solid solution degree can be calculated with the considerably small calculation burden can be obtained.

The fuel amount increase control after the fuel cut control is, for example, a control for discharging from the catalyst, the oxygen which has been excessively trapped in the catalyst during the fuel cut control. That is, during the fuel cut control, the exhaust gas having the air-fuel ratio considerably leaner than the stoichiometric air-fuel ratio flows into the catalyst, therefore, the oxygen of the large amount continuously flows into the catalyst and therefore, the catalyst trap oxygen amount (i.e. the amount of the oxygen trapped by the catalyst) may reach its upper limit (i.e. the upper limit of the amount of the oxygen which can be trapped by the oxygen trap and discharge ability of the catalyst). On the other hand, during the stoichiometric air-fuel ratio control, the exhaust gas having the air-fuel ratio leaner than the stoichiometric air-fuel ratio may flow into the catalyst.

Therefore, if the stoichiometric air-fuel ratio control is performed immediately after the fuel cut control in the case that the catalyst trap oxygen amount reaches its upper limit, the catalyst cannot trap the oxygen in the exhaust gas when the exhaust gas having the air-fuel ratio leaner than the stoichiometric air-fuel ratio flows into the catalyst and therefore, the air-fuel ratio of the atmosphere in the catalyst cannot be maintained at the stoichiometric air-fuel ratio and as a result, the catalyst cannot demonstrate the sufficient purification ability.

For this reason, in order to maintain the air-fuel ratio of the atmosphere in the catalyst at the stoichiometric air-fuel ratio even when the exhaust gas having the air-fuel ratio leaner than the stoichiometric air-fuel ratio flows into the catalyst, the fuel amount increase control after the fuel cut control can be used for discharging from the catalyst, the oxygen which is excessively trapped by the catalyst during the fuel cut control.

In the case that the fuel amount increase control after the fuel cut control is used for discharging from the catalyst, the oxygen which is excessively trapped by the catalyst during the fuel cut control, it is preferred that a time period from the end of the fuel cut control to the time when the catalyst inflow exhaust air-fuel ratio becomes richer than the stoichiometric air-fuel ratio is set as the time period for performing the fuel amount increase control after the fuel cut control.

Further, in the eighteenth embodiment, any method can be employed as the concrete acquisition method of the oxygen discharge amount as far as the oxygen discharge amount can be acquired according to the method and for example, as this method, a method for acquiring the oxygen discharge amount by a sensor provided in the catalyst for detecting the oxygen discharge amount or a method for acquiring the oxygen discharge amount by the calculation on the basis of various parameters relating to the engine may be employed.

As an example of the acquisition method of the oxygen discharge amount by the calculation on the basis of the various parameters relating to the engine, there is a method for subtracting the stoichiometric air-fuel ratio from the catalyst inflow exhaust air-fuel ratio during the fuel amount increase control after the fuel cut control to obtain a value, multiplying this value by the intake air amount to obtain a value and integrating this value to acquire as the oxygen discharge amount, that is, a method for acquiring a value Ao calculated according to the formula 16 as the oxygen discharge amount. In the formula 16, "AFr" is—the catalyst inflow exhaust air-fuel ratio during the fuel amount increase control after the fuel cut control—, "AFst" is—the stoichiometric air-fuel ratio—and "Ga" is—the intake air amount—.

$$Ao=\Sigma((AFr-AFst)*Ga) \quad (16)$$

Next, further another embodiment which employs a method for acquiring the active element solid solution degree calculated on the basis of various parameters relating to the engine as the active element solid solution for the air-fuel ratio control (hereinafter, this embodiment may be referred to as—nineteenth embodiment—) will be described. The constitution and controls of the nineteenth embodiment not described below are the same as those of the aforementioned embodiments or are those derived naturally from the technical concept of the invention embodied in the nineteenth embodiment. Further, as far as no contradiction occurs, the controls of the aforementioned embodiments may be combined with those of the nineteenth embodiment described below.

In the nineteenth embodiment, similar to the eighteenth embodiment, the stoichiometric air-fuel ratio control, the fuel cut control and the fuel amount increase control after the fuel cut control can be selectively performed. In the nineteenth embodiment, an oxygen discharge amount when the fuel amount increase control after the fuel cut control is performed under the condition that the active element solid solution degree is a predetermined solid solution degree is previously obtained by an experiment, etc. Then, the thus obtained oxygen discharge amount is memorized in the electronic control unit as a base oxygen discharge amount.

Further, the active element solid solution degree when all active element has transformed as a solid solution into the carrier (hereinafter, this degree may be referred to as—maximum solid solution degree—) is previously determined. The maximum solid solution degree is, for example, "100".

Then, while the fuel amount increase control after the fuel cut control is performed during the engine operation, the actual oxygen discharge amount (i.e. the oxygen discharge amount during the engine operation) is acquired and then, a difference of the oxygen discharge amount during the engine operation relative to the base oxygen discharge amount (i.e. the oxygen discharge amount difference) is calculated.

Then, a value, which is obtained by subtracting from "100" which is the maximum solid solution degree, a value obtained by dividing the thus calculated oxygen discharge amount difference by the base oxygen discharge amount, is acquired as the active element solid solution degree for the air-fuel ratio control.

That is, according to the nineteenth embodiment, the active element solid solution degree for the air-fuel ratio control Ds is acquired according to the following formula 17. In the formula 17, "Aob" is—base oxygen discharge amount—and "Ao" is—oxygen discharge amount during the engine operation—.

$$Ds=(100-(Aob-Ao)/Aob) \quad (17)$$

According to the nineteenth embodiment, the following effect can be obtained. That is, according to the nineteenth embodiment, similar to the eighteenth embodiment, the active element solid solution degree is calculated on the basis of the oxygen discharge amount which is a parameter which varies depending on the active element solid solution degree. Therefore, according to the nineteenth embodiment, the effect that the active element solid solution degree can be accurately calculated can be obtained.

Further, according to the nineteenth embodiment, the active element solid solution degree is calculated using the formula 17. Then, as apparent from the formula 17, the formula 17 is a considerably simple formula and thus, the burden of the calculation of the active element solid solution degree using the formula 17 is considerably small. Also, contrary to the eighteenth embodiment, the solid solution degree change rate is not needed and therefore, it is not necessary to previously prepare the solid solution degree change rate for calculating the active element solid solution degree. Further, the solid solution degree change rate may not be constant and in this case, if the active element solid solution degree is calculated using the solid solution degree change rate, the calculated active element solid solution degree is not an accurate value.

In this regard, according to the nineteenth embodiment, the active element solid solution degree is calculated without using the solid solution degree change rate. Thus, according to the nineteenth embodiment, the effect that the burden for previously obtaining the solid solution degree change rate can be omitted and the active element solid solution degree can be accurately calculated with the considerably small calculation burden can be obtained.

Next, further another embodiment which employs a method for acquiring the active element solid solution degree calculated on the basis of various parameters relating to the engine as the active element solid solution for the air-fuel ratio control (hereinafter, this embodiment may be referred to as—twentieth embodiment—) will be described. The constitution and controls of the twentieth embodiment not described below are the same as those of the aforementioned embodiments or are those derived naturally from the technical concept of the invention embodied in the twentieth embodiment. Further, as far as no contradiction occurs, the controls of the aforementioned embodiments may be combined with those of the twentieth embodiment described below.

In the twentieth embodiment, similar to the eighteenth embodiment, the stoichiometric air-fuel ratio control, the fuel cut control and the fuel amount increase control after the fuel cut control can be selectively performed. In the twentieth embodiment, a relationship between the oxygen discharge amount and the oxygen discharge amount when the fuel amount increase control after the fuel cut control is performed is previously obtained by an experiment, etc. Then, the thus obtained relationship is memorized in the electronic control unit as a base oxygen discharge amount solid solution degree relationship.

Then, while the fuel amount increase control after the fuel cut control is performed during the engine operation, the actual oxygen discharge amount (i.e. the oxygen discharge amount during the engine operation) is acquired and then, the active element solid solution degree is calculated from the oxygen discharge amount solid solution degree relationship on the basis of this oxygen discharge amount during the engine operation. Then, the thus calculated active element solid solution degree is acquired as the active element solid solution degree for the air-fuel ratio control.

In the twentieth embodiment, the oxygen discharge amounts every the active element solid solution degree when the fuel amount increase control after the fuel cut control is performed are previously obtained by an experiment, etc. then, the active element solid solution degrees are memorized in the electronic control unit as a form of a map as a function of the oxygen discharge amount on the basis of the relationship between the obtained oxygen discharge amount and the corresponding active element solid solution degree, then, while the fuel amount increase control after the fuel cut control is performed during the engine operation, the oxygen discharge amount is acquired, then, the active element solid solution degree corresponding to this oxygen discharge amount during the engine operation is acquired from the map, and then, the thus acquired active element solid solution degree may be acquired as the active element solid solution degree for the air-fuel ratio control and in this case, the aforementioned oxygen discharge amount solid solution degree relationship is the aforementioned map.

According to the twentieth embodiment, the following effect can be obtained. That is, while a constant relationship exists between the oxygen discharge amount and the active element solid solution degree, it is not easy to express such a relationship by one relational expression and if the active element solid solution degree is calculated using a relational expression which generally expresses such a relationship, the calculated active element solid solution degree may not be an accurate value. On the other hand, according to the twentieth embodiment, the relationship between the oxygen discharge amount and the active element solid solution degree previously obtained by an experiment, etc. is memorized in the electronic control unit and then, during the engine operation, the active element solid solution degree is acquired on the basis of this memorized relationship and the oxygen discharge amount during the engine operation. Thus, according to the twentieth embodiment, the effect that the accurate active element solid solution degree can be calculated can be obtained.

The acquisition method of the oxygen discharge amount is not limited to any particular method and for example, as the acquisition method of the oxygen discharge amount, a method for calculating the oxygen discharge amount on the basis of the catalyst inflow exhaust air-fuel ratio (i.e. the air-fuel ratio of the exhaust gas flowing out of the catalyst) and the intake air amount during the fuel amount increase control after the fuel cut control can be employed. In this case, as the catalyst inflow exhaust air-fuel ratio increases (i.e. as the lean degree of the catalyst inflow exhaust air-fuel ratio increases) and as the intake air amount decreases, the acquired oxygen discharge amount tends to increase.

Next, the twenty first embodiment will be described. The constitution and controls of the twenty first embodiment not described below are the same as those of the aforementioned embodiments or are those derived naturally from the technical concept of the invention embodied in the twenty first embodiment. Further, as far as no contradiction occurs, the controls of the aforementioned embodiments may be combined with those of the twenty first embodiment described below.

In the twenty first embodiment, during a constant time period from the start of the engine operation after the stop of the engine operation (hereinafter, this period may be referred to as—engine start period—), the acquisition of the active element solid solution degree on the basis of the catalyst temperature according to any of the aforementioned sixth to eleventh embodiments is performed. On the other hand, during a time period from the time when the engine star period has elapsed to the time of stop of the engine operation (hereinafter, this period may be referred to as—normal operation period—), the acquisition of the active element solid solution degree on the solid solution degree counter according to the fifth embodiment or on the basis of the output value trace length according to any of the twelfth to fourteenth embodiments or on the basis of the inversion number according to any of the fifteenth to seventeenth embodiments or on the basis of the oxygen discharge amount according to the eighteenth to twentieth embodiments is performed.

Then, when the active element solid solution degree acquired lastly during the engine start period is larger than or equal to that acquired lastly during the normal operation period immediately before the engine start period, the active element solid solution degree acquired lastly during the engine start period is employed as the active element solid solution at the time when the engine start period has elapsed. On the other hand, when the active element solid solution degree acquired lastly during the engine start period is smaller than that acquired lastly during the normal operation period immediately before the engine start period, the active element solid solution degree acquired lastly during the normal operation period immediately before the engine start period is employed as the active element solid solution at the time when the engine start period has elapsed.

According to the twenty first embodiment, the following effect can be obtained. That is, the catalyst temperature changes due to the change of the active element solid solution degree prominently when the catalyst temperature increases, compared with the period when the catalyst temperature is constant or generally constant. Therefore, in order to accurately acquire the active element solid solution degree, it is advantageous that the active element solid solution degree is acquired on the basis of the catalyst temperature during the engine start period where the catalyst temperature increases and it is not advantageous that the active element solid solution degree is acquired on the basis of the catalyst temperature during the normal operation period where the catalyst temperature is constant or generally constant.

Further, the solid solution degree counter is increased or decreased at least only when the catalyst temperature is higher than or equal to the predetermined solid solution or precipitation temperature. Therefore, in order to accurately acquire the active element solid solution degree, it is disadvantageous that the active element solid solution degree is acquired on the basis of the solid solution degree counter during the engine start period where there is a high possibility that the catalyst temperature does not become higher than or equal to the predetermined solid solution temperature or the predetermined precipitation temperature, however, it is advantageous that the active element solid solution degree is acquired on the basis of the solid solution degree counter during the normal operation period where there is a high possibility that the catalyst temperature becomes higher than or equal to the predetermined solid solution temperature or the predetermined precipitation temperature.

Further, the output value trace length and the inverse number are acquired on the basis of the output value of the downstream air-fuel ratio sensor corresponding to the catalyst inflow exhaust air-fuel ratio. Thus, when the catalyst temperature is higher than or equal to the activation temperature of the catalyst and therefore, the purification ability of the catalyst is sufficiently demonstrated, the changes of the output value trace length and the inverse number corresponding to the change of the active element solid solution degree occur.

Therefore, in order to accurately acquire the active element solid solution degree, it is disadvantageous that the active element solid solution degree is acquired on the basis of the output value trace length or the inverse number during the engine start period where there is a high possibility that the catalyst temperature does not become higher than or equal to the activation temperature of the catalyst, however, it is advantageous that the active element solid solution degree is acquired on the basis of the output value trace length or the inverse number during the normal operation period where there is a high possibility that the catalyst temperature becomes higher than or equal to the activation temperature of the catalyst.

Further, the oxygen discharge amount is influenced by the activation degree of the catalyst. Thus, when the catalyst temperature is higher than or equal to the activation temperature of the catalyst and therefore, the purification ability of the catalyst is sufficiently demonstrated, the change of the oxygen discharge amount corresponding to the change of the active element solid solution degree occurs.

Therefore, in order to accurately acquire the active element solid solution degree, it is disadvantageous that the active element solid solution degree is acquired on the basis of the oxygen discharge amount during the engine start period where there is a high possibility that the catalyst temperature does not become higher than or equal to the activation temperature of the catalyst, however, it is advantageous that the active element solid solution degree is acquired on the basis of the oxygen discharge amount during the normal operation period where there is a high possibility that the catalyst temperature becomes higher than or equal to the activation temperature of the catalyst.

According to the twenty first embodiment, basically, during the engine start period, the active element solid solution degree is acquired on the basis of the catalyst temperature and on the other hand, during the normal operation period, the active element solid solution degree is acquired on the basis of the solid solution degree counter or the output value trace length or the inverse number or the oxygen discharge amount.

Therefore, according to the twenty first embodiment, the effect that the active element solid solution degree can be accurately acquired during the engine start period as well as during the normal operation period.

In addition, according to the twenty first embodiment, the following effect can be obtained. That is, in the case that the active element solid solution degrees acquired according to two different method are different from each other, it is preferred that the larger active element solid solution degree is employed as the active element solid solution degree used for the control, etc. of the engine. This is because if the smaller active element solid solution degree is employed as the active element solid solution degree used for the control, etc. of the engine, the control, etc. of the engine may be performed assuming that the amount of the precipitated active element is large and therefore, the purification ability of the catalyst is high and in this case, the exhaust emission property relating to the exhaust gas flowing out of the catalyst may decrease.

In this regard, according to the twenty first embodiment, if the last active element solid solution degree acquired during the engine start time period is larger than or equal to the last active element solid solution degree acquired during the normal operation time period immediately before the engine start time period (in this regard, the term "immediately before" does not include any temporal meaning and includes an ordinal meaning), the last active element solid solution degree acquired during the engine start time period is directly employed as the conclusive active element solid solution degree during the engine start time period and on the other hand, if the last active element solid solution degree acquired during the engine start time period is smaller than the last active element solid solution degree acquired during the normal operation time period immediately before the engine start time period, the last active element solid solution degree acquired during the normal operation time period is employed as the conclusive active element solid solution degree during the engine start time period. That is, the larger active element solid solution degree is employed as the conclusive active element solid solution degree during the engine start time period. Therefore, according to the twenty first embodiment, the effect that the high exhaust emission property can be ensured immediately after the engine start time period, can be obtained.

In the twenty first embodiment, the engine start period may be any period as far as this period is a constant period from the start of the engine operation after the stop of the engine operation and for example, as the engine start period, a constant period from the start of the engine operation after the stop of the engine operation during a relatively long period, that is, a so-called cold start period of the engine can be employed. Further, the length of the engine start period is not limited to any particular length and for example, as the engine start period, a period from the start of the engine operation until the engine speed reaches a constant engine speed can be employed.

Figure 19:
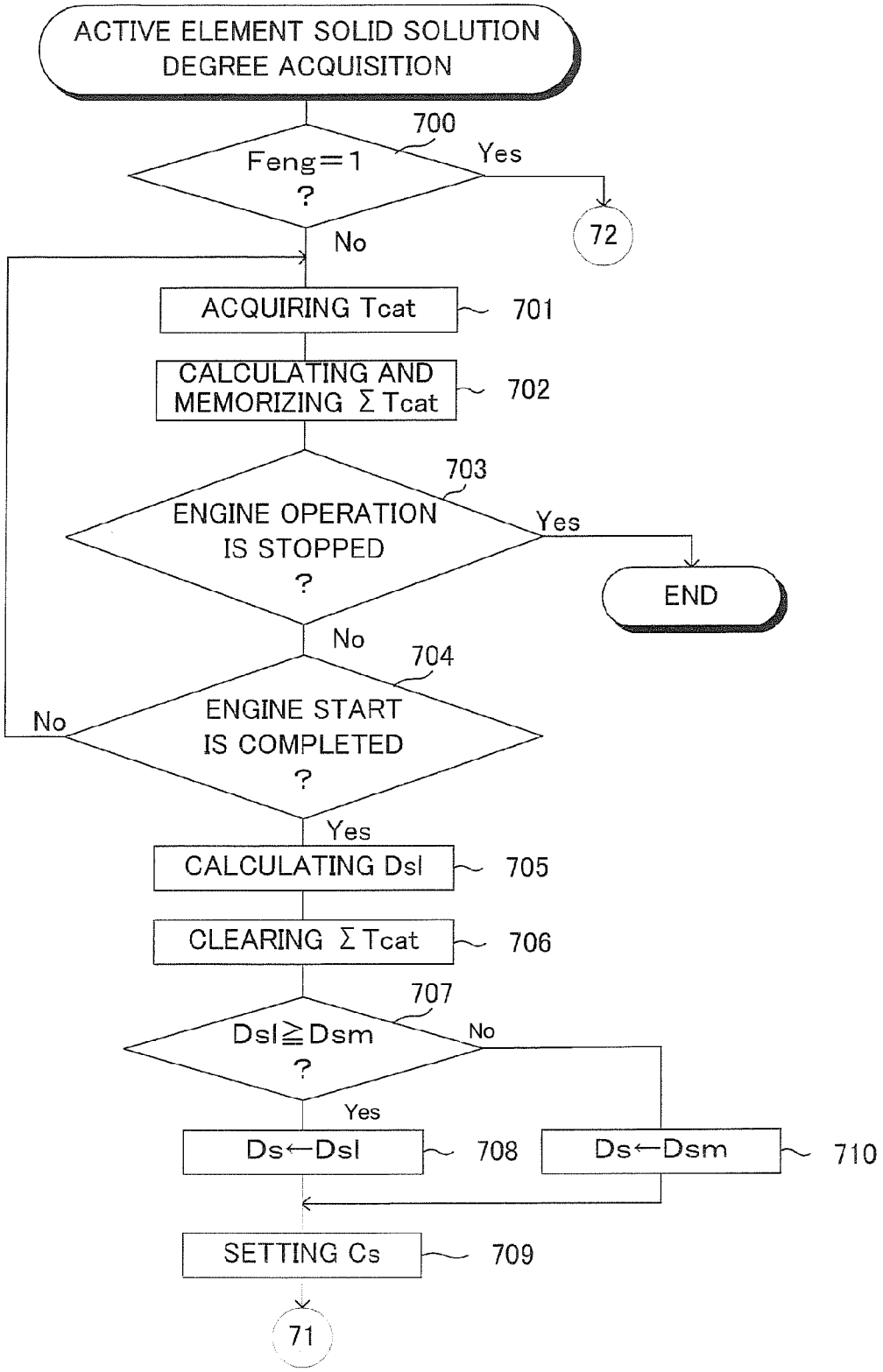
FIG. 19 is a view showing a part of an example of a routine for performing the calculation of the active element solid solution degree according to a twenty first embodiment.
Figure 20:
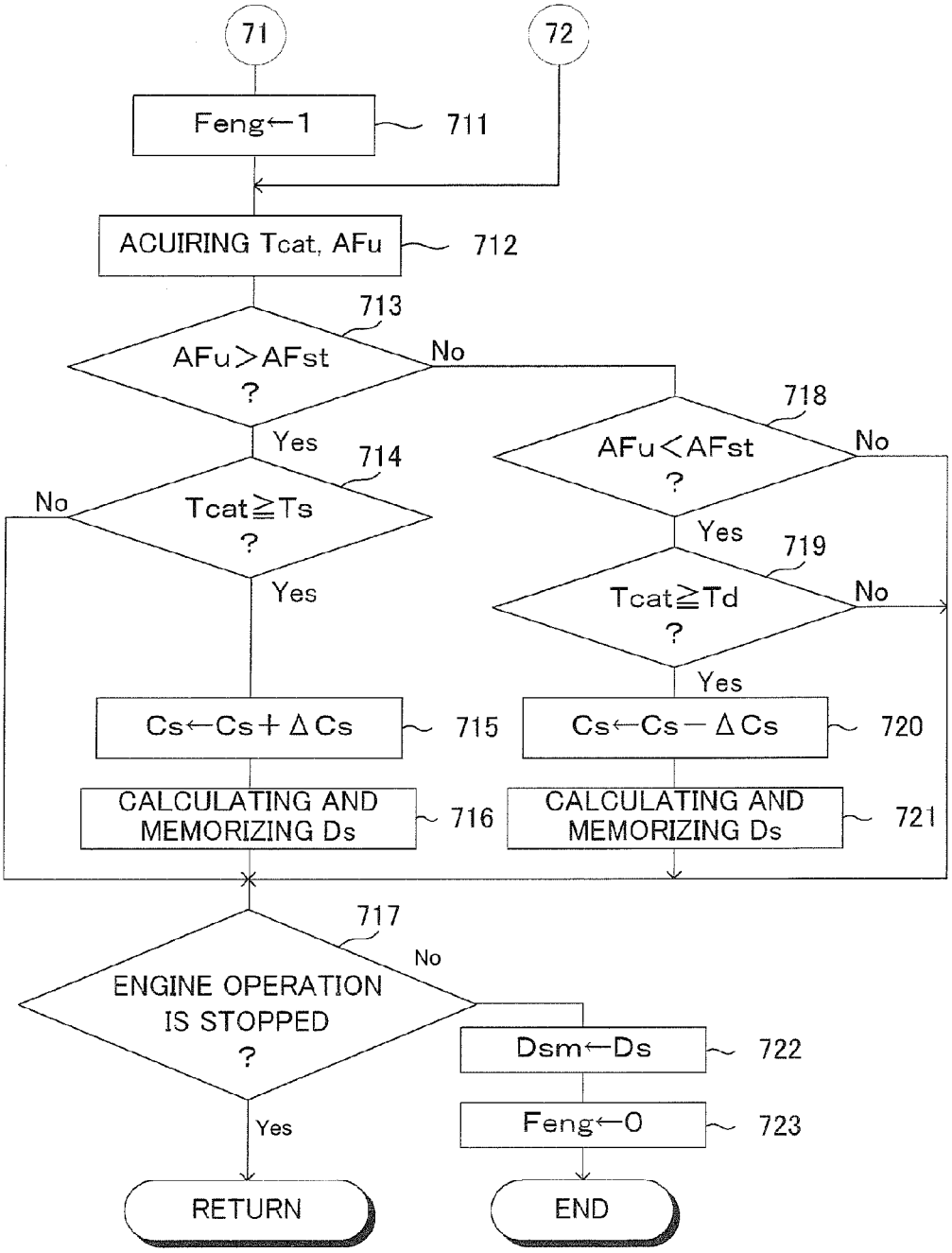
FIG. 20 is a view showing another part of the example of the routine for performing the calculation of the active element solid solution degree according to the twenty first embodiment.

Next, an example of a routine for performing the acquisition of the solid solution degree according to the twenty first embodiment will be described. This example of the routine is shown in FIGS. 19 and 20. This routine starts when the engine operation is started, this routine is continuously performed during the engine operation and this routine is stopped when the engine operation is stopped.

When the routine of FIGS. 19 and 20 starts, first, at the step 700, it is judged if an engine start completing flag Feng is set (Feng=1). The engine start completing flag Feng is set when the start of the engine is completed (i.e. when the engine start period has elapsed) and the flag is reset when the engine operation is stopped (i.e. when the normal operation period has elapsed). When it is judged that Feng=1 at the step 700, the routine proceeds to the step 712. On the other hand, when it is not judged that Feng=1, the routine proceeds to the step 701.

When it is not judged that Feng=1 at the step 700 and then, the routine proceeds to the step 701, the current catalyst temperature Tcat is acquired. Next, at the step 702, a new catalyst temperature integration value ΣTcat is calculated by adding the catalyst temperature Tcat acquired at the step 701 to the catalyst temperature integration value Tcat memorized at the step 702 of the last performance of this routine and then, this calculated catalyst temperature integration value ΣTcat is memorized in the electronic control unit. Next, at the step 703, it is judged if the engine operation is stopped. In this regard, when it is judged that the engine operation is stopped, the routine ends. On the other hand, when it is not judged that the engine operation is stopped, the routine proceeds to the step 704.

When it is not judged that the engine operation is stopped at the step 703 and then, the routine proceeds to the step 704, it is judged if the start of the engine is completed.

This judgement is performed, for example, by judging if a predetermined time period has elapsed after the engine operation is started, in particular, it is not judged that the start of the engine is completed until the predetermined time period has elapsed and it is judged that the start of the engine is completed when the predetermined time period has elapsed.

Otherwise, the judgement is performed, for example, by judging if the engine speed becomes larger than or equal to a predetermined speed, in particular, it is judged that the start of the engine is completed when the engine speed becomes larger than or equal to the predetermined speed and it is not judged that the start of the engine is completed when the engine speed is smaller than the predetermined speed.

When it is judged that the start of the engine is completed at the step 704, the routine proceeds to the step 705. On the other hand, when it is not judged that the start of the engine is completed, the routine returns to the step 701. That is, in this routine, when the start of the engine is not completed in the case that the engine operation is not stopped, the steps 701 to 704 are performed repeatedly.

When it is judged that the start of the engine is completed at the step 704 and then, the routine proceeds to the step 705, the active element solid solution degree (hereinafter, this degree may be referred to as—active element solid solution degree at the engine start—) Dsl is calculated on the basis of the catalyst temperature integration value ΣTcat memorized in the electronic control unit at the step 702. Next, at the step 706, ΣTcat memorized in the electronic control unit is cleared.

Next, at the step 707, it is judged if the active element solid solution degree at the engine start Dsl calculated at the step 705 is larger than or equal to the active element solid solution degree at the normal engine operation (i.e. the active element solid solution degree set at the step 722 and memorized in the electronic control unit at the preceding performance of this routine) Dsm (Dsl≥Dsm). In this regard, when it is judged that Dsl≥Dsm, the routine proceeds to the step 708 where the active element solid solution degree at the engine start Dsl is set as the active element solid solution degree Ds and then, the routine proceeds to the step 709. On the other hand, when it is not judged that Dsl≥Dsm at the step 707, the routine proceeds to the step 710 where the active element solid solution degree at the normal engine operation Dsm is set as the active element solid solution degree Ds and then, the routine proceeds to the step 709.

At the step 709, the solid solution degree counter Cs corresponding to the active element solid solution degree Ds set at the step 708 is set in the case that the routine proceeds to the step 709 from the step 708 and the solid solution degree counter Cs corresponding to the active element solid solution degree Ds set at the step 710 in the case that the routine proceeds to the step 709 from the step 710. Next, at the step 711, the engine start completing flag Feng is set (Feng←1) and then, the routine proceeds to the step 712.

At the step 712, the current catalyst temperature Tcat and the current upstream detected air-fuel ratio AFu are acquired. Next, at the step 713, it is judged if the upstream detected air-fuel ratio AFu acquired at the step 712 is larger than or equal to the stoichiometric air-fuel ratio (AFu>AFst) (i.e. it is judged if the catalyst inflow exhaust air-fuel ratio is leaner than the stoichiometric air-fuel ratio). In this regard, when it is judged that AFu>AFst, the routine proceeds to the step 714. On the other hand, when it is not judged that AFu>AFst, the routine proceeds to the step 718.

When it is judged that AFu>AFst at the step 713 and then, the routine proceeds to the step 714, it is judged if the catalyst temperature Tcat acquired at the step 712 is higher than or equal to the predetermined solid solution temperature Ts (Tcat≥Ts). In this regard, when it is judged that Tcat≥Ts, the routine proceeds to the step 715. On the other hand, when it is not judged that Tcat≥Ts, the routine proceeds to the step 717.

When it is judged that Tcat≥Ts at the step 714 and then, the routine proceeds to the step 715, the solid solution degree counter is increased by the predetermined value ΔCs and is set as a new solid solution degree counter Cs (Cs←Cs+ΔCs). In this regard, when the routine first proceeds to the step 715 after the start of the engine is completed, the solid solution degree counter Cs set at the step 709 is increased by the predetermined value ΔCs and is set as a new solid solution degree counter Cs and on the other hand, when the routine does not first proceed to the step 715 after the start of the engine is completed, the solid solution degree counter Cs set at the step 715 or 720 at the preceding performance of this routine is increased by the predetermined value ΔCs and is set as a new solid solution degree counter Cs.

Next, at the step 716, the active element solid solution degree Ds is calculated on the basis of the solid solution degree counter Cs set at the step 715 and this calculated active element solid solution degree Ds is memorized in the electronic control unit and then, the routine proceeds to the step 717.

When it is judged that the AFu>AFst at the step 713 and then, the routine proceeds to the step 718, the upstream detected air-fuel ratio AFu acquired at the step 712 is smaller than the stoichiometric air-fuel ratio AFst (AFu<AFst) (i.e. it is judged if the catalyst inflow exhaust air-fuel ratio is richer than the stoichiometric air-fuel ratio). In this regard, when it is judged that AFu<AFst, the routine proceeds to the step 719. On the other hand, when it is not judged that AFu<AFst, the routine proceeds to the step 717.

When it is judged that AFu<AFst at the step 718 and then, the routine proceeds to the step 719, it is judged if the catalyst temperature Tcat acquired at the step 712 is higher than or equal to the predetermined precipitation temperature Td (Tcat≥Td). In this regard, when it is judged that Tcat≥Td, the routine proceeds to the step 720. On the other hand, when it is not judged that Tcat≥Td, the routine proceeds to the step 717.

When it is judged that Tcat≥Td at the step 719 and then, the routine proceeds to the step 720, the solid solution degree counter Cs is decreased by the predetermined value ΔCs and is set as a new solid solution degree counter Cs (Cs←Cs−ΔCs). In this regard, when the routine first proceeds to the step 720 after the start of the engine is completed, the solid solution degree counter Cs set at the step 709 is decreased by the predetermined value ΔCs and is set as a new solid solution degree counter Cs and on the other hand, when the routine does not first proceed to the step 720 after the start of the engine is completed, the solid solution degree counter Cs set at the step 715 or 720 at the preceding performance of this routine is decreased by the predetermined value ΔCs and is set as a new solid solution degree counter Cs.

Next, at the step 721, the active element solid solution degree Ds is calculated on the basis of the solid solution degree counter Cs updated at the step 720 and this calculated active element solid solution degree Ds is memorized in the electronic control unit and then, the routine proceeds to the step 717.

At the step 717, it is judged if the engine operation is stopped. In this regard, when it is judged that the engine operation is stopped, the routine returns to the step 700. On the other hand, when it is not judged that the engine operation is stopped, the routine proceeds to the step 722.

When it is not judged that the engine operation is stopped at the step 717 and then, the routine proceeds to the step 722, the latest active element solid solution degree Ds presently memorized in the electronic control unit is as the active element solid solution degree at the normal operation Dsm and is memorized in the electronic control unit (Dsm←Ds). Next, at the step 723, the engine start completing flag Feng is reset (Feng←0) and then, the routine ends.

As described above, as the active element solid solution degree increases, the output value trace length increases and the inversion number increases. That is, when the active element solid solution degree is large, the output value of the downstream air-fuel ratio sensor increases and decreases in a short periods. Therefore, in the aforementioned embodiments, in particular, when the active element solid solution is relatively large (in particular, when the active element solid solution degree is larger than a predetermined value), it is preferred that a value obtained by smoothing the output values of the downstream air-fuel ratio is used for the air-fuel ratio control.

Further, the aforementioned embodiments is those in which the invention is applied to the spark ignition type internal combustion engine (so-called gasoline engine), however, the invention can be applied to the engine other than the spark ignition type engine, for example, the compression self-ignition type internal combustion engine (so-called diesel engine). Further, the aforementioned embodiments are those in which the invention is applied to the three-way catalyst, however, the invention can be applied to the NOx catalyst which can purify the nitrogen oxide (NOx) in the exhaust gas at a high purification rate even when the air-fuel ratio of the inflow exhaust gas is leaner than the stoichiometric air-fuel ratio.

Further, in the aforementioned embodiments, in the case that the base catalyst temperature is used for the acquisition of the active element solid solution degree, the base catalyst temperature which depends on the heat amount of the exhaust gas flowing into the catalyst (hereinafter, this heat amount may be referred to as—exhaust heat amount—) may be used. In this case, under the condition that the active element solid solution degree is constant, as the exhaust heat amount increases, the temperature of the catalyst increases and therefore, as the exhaust heat amount increases, the higher base catalyst temperature may be used for the acquisition of the active element solid solution or the base catalyst temperature used for the acquisition of the active element solid solution degree when the exhaust heat amount is larger than a certain value may be higher than that when the exhaust heat amount is smaller than or equal to the certain value.

Similarly, in the aforementioned embodiments, in the case that the temperature solid solution degree relationship is used for the acquisition of the active element solid solution degree, the temperature solid solution degree relationship which depends on the exhaust heat amount may be used. In this case, the temperature solid solution degree relationship in which as the exhaust heat amount increases, the active element solid solution degree obtained from this relationship on the basis of the catalyst temperature during the engine operation decreases, may be used or the temperature solid solution degree relationship in which the active element solid solution degree obtained from this relationship on the basis of the catalyst temperature during the engine operation when the exhaust heat amount is larger than a certain value is smaller than that when the exhaust heat amount is smaller than or equal to the certain value, may be used.

Similarly, in the aforementioned embodiments, in the case that the temperature integration value solid solution degree relationship is used for the acquisition of the active element solid solution degree, the temperature integration value solid solution degree relationship which depends on the exhaust heat amount may be used. In this case, the temperature integration value solid solution degree relationship in which as the exhaust heat amount increases, the active element solid solution degree obtained from this relationship on the basis of the catalyst temperature integration value during the engine operation decreases, may be used or the temperature integration value solid solution degree relationship in which the active element solid solution degree obtained from this relationship on the basis of the catalyst temperature integration value during the engine operation when the exhaust heat amount is larger than a certain value is smaller than that when the exhaust heat amount is smaller than or equal to the certain value, may be used.

Further, in the aforementioned embodiments, in the case that the exhaust heat amount is used for the acquisition of the active element solid solution degree, the acquisition method is not limited to a particular method and, for example, a method for acquiring as the exhaust heat amount used for the acquisition of the active element solid solution degree, the exhaust heat amount detected by a sensor for detecting the exhaust heat amount arranged in the exhaust passage upstream of the catalyst may be employed or a method for acquiring as the exhaust heat amount used for the acquisition of the active element solid solution degree, the exhaust heat amount calculated from the engine operation condition may be employed. In this regard, the engine operation condition used for the calculation of the exhaust heat amount is not limited to a particular operation condition and, for example, one or more of the engine speed, the intake air amount and the fuel injection amount can be employed as the engine operation condition used for the calculation of the exhaust heat amount.

Further, in the lean air-fuel ratio control of the aforementioned embodiments, if an air-fuel ratio considerably leaner than the stoichiometric air-fuel ratio is set as the predetermined lean air-fuel ratio, the air-fuel ratio of the mixture gas is controlled to the air-fuel ratio considerably leaner than the stoichiometric air-fuel ratio and as a result, the emission property relating to the exhaust gas may decrease. Therefore, in order to restrict the decrease of the emission property relating to the exhaust gas, in the lean air-fuel ratio control of the aforementioned embodiments, it is preferred that an air-fuel ration slightly leaner than the stoichiometric air-fuel ratio is set as the predetermined lean air-fuel ratio.

Further, in the rich air-fuel ratio control of the aforementioned embodiments, if an air-fuel ratio considerably richer than the stoichiometric air-fuel ratio is set as the predetermined rich air-fuel ratio, the air-fuel ratio of the mixture gas is controlled to the air-fuel ratio considerably richer than the stoichiometric air-fuel ratio and as a result, the emission property relating to the exhaust gas may decrease and the fuel consumption increases. Therefore, in order to restrict the decrease of the emission property relating to the exhaust gas and the increase of the fuel consumption, in the rich air-fuel ratio control of the aforementioned embodiments, it is preferred that an air-fuel ration slightly richer than the stoichiometric air-fuel ratio is set as the predetermined rich air-fuel ratio.

The invention claimed is:

1. An exhaust gas purification device of an internal combustion engine, comprising in an exhaust passage, a catalyst for purifying a component in an exhaust gas and having an active element for activating an oxidation reaction or a reduction reaction of the component in the exhaust gas and a carrier for caning the active element, in which catalyst, the active element transforming as a solid solution in the carrier when a temperature of the catalyst is higher than or equal to a predetermined solid solution temperature which is a predetermined temperature and an atmosphere in the catalyst is an oxidation atmosphere and the active element precipitating from the carrier when the temperature of the catalyst is higher than or equal to a predetermined precipitation temperature which is a predetermined temperature and the atmosphere in the catalyst is a reduction atmosphere, wherein an air-fuel ratio of an exhaust gas flowing into the catalyst is controlled to an air-fuel ratio leaner than the stoichiometric air-fuel ratio when an active element solid solution degree, which indicates a proportion of the active element having transformed as a solid solution in the carrier relative to the total active element is smaller than a target solid solution which is a target active element solid solution degree or smaller than a lower limit of a target solid solution degree range which is a range of the target active element solid solution degree and the temperature of the catalyst is higher than or equal to the predetermined solid solution temperature during the operation of the engine, and wherein the air-fuel ratio of the exhaust gas flowing into the catalyst is controlled to an air-fuel ratio richer than the stoichiometric air-fuel ratio when the active element solid solution degree is larger than the target solid solution degree or larger than an upper limit of the target solid solution degree range and the temperature of the catalyst is higher than or equal to the predetermined precipitation temperature.

2. The device of the engine of claim 1, wherein as the degree of the usage of the catalyst in the purification of the component in the exhaust gas increases, the target solid solution degree is set as a smaller value or the upper and lower limits of the target solid solution degree range are set as smaller values.

3. The device of the engine of claim 1, wherein the active element solid solution degree is calculated on the basis of the temperature of the catalyst and the air-fuel ratio of the exhaust gas flowing into the catalyst when the temperature of the catalyst is higher than or equal to the predetermined solid solution temperature and the air-fuel ratio of the exhaust gas flowing into the catalyst is leaner than the stoichiometric air-fuel ratio during the operation of the engine and the temperature of the catalyst and the air-fuel ratio of the exhaust gas flowing into the catalyst when the temperature of the catalyst is higher than or equal to the predetermined precipitation temperature and the air-fuel ratio of the exhaust gas flowing into the catalyst is richer than the stoichiometric air-fuel ratio during the operation of the engine.

4. The device of the engine of claim 1, wherein the active element solid solution degree is calculated on the basis of the temperature of the catalyst during the operation of the engine.

5. The device of the engine of claim 1, wherein air-fuel ratio output means for outputing an output value corresponding to the air-fuel ratio of the exhaust gas is arranged in the exhaust passage downstream of the catalyst and the active element solid solution degree is calculated on the basis of an output value trace length during the engine operation, which length being a length of the trace of the output value of the air-fuel ratio output means in a predetermined time during the operation of the engine.

6. The device of the engine of claim 1, wherein air-fuel ratio output means for outputing an output value corresponding to the air-fuel ratio of the exhaust gas is arranged in the exhaust passage downstream of the catalyst and the active element solid solution degree is calculated on the basis of a positive direction inversion number during the engine operation, which number being the number of the inversion of the change rate of the output value of the air-fuel ratio output means from the negative value to the positive value in a predetermined time during the operation of the engine, or a negative direction inversion number during the engine operation, which number being the number of the inversion of the change rate of the output value of the air-fuel ratio output means from the positive value to the negative value in a predetermined time during the operation of the engine, or a total inversion number during the engine operation, which number being the number of the sum of the positive and negative direction inversion numbers during the engine operation.

7. The device of the engine of claim 1, wherein during an engine start time period which is a time period until a predetermined time has elapsed from the start of the operation of the engine after the stop of the operation of the engine, the active element solid solution degree is calculated on the basis of the temperature of the catalyst, wherein during a normal operation time period which is a time period from when the engine start time period has elapsed to when the operation of the engine is stopped, the active element solid solution degree is calculated on the basis of the temperature of the catalyst and the air-fuel ratio of the exhaust gas flowing into the catalyst when the temperature of the catalyst is higher than or equal to the predetermined solid solution temperature and the air-fuel ratio of the exhaust gas flowing into the catalyst is leaner than the stoichiometric air-fuel ratio and the temperature of the catalyst and the air-fuel ratio of the exhaust gas flowing into the catalyst when the temperature of the catalyst is higher than or equal to the predetermined precipitation temperature and the air-fuel ratio of the exhaust gas flowing into the catalyst is richer than the stoichiometric air-fuel ratio or the active element solid solution degree is calculated on the basis of an output value trace length during the engine operation, which length being the length of the trace of the output value of the air-fuel ratio output means in the predetermined time period during the operation of the engine in the case that the air-fuel ratio output means for outputing the output value corresponding to the air-fuel ratio of the exhaust gas is arranged in the exhaust passage downstream of the catalyst or the active element solid solution degree is calculated on the basis of one of the positive direction inversion number during the engine operation, which number being the number of the inversion of the change rate of the output value of the air-fuel ratio output means in a predetermined time period during the operation of the engine from the negative value to the positive value, the negative direction inversion number during the engine operation, which number being the number of the inversion of the change rate of the output value of the air-fuel ratio output means in a predetermined time period during the operation of the engine from the positive value to the negative value, and the total inversion number during the engine operation, which number being the number of the sum of the positive and negative direction inversion numbers during the engine operation in the case that the air-fuel ratio output means for outputing the output value corresponding to the air-fuel ratio of the exhaust gas is arranged in the exhaust passage downstream of the catalyst, wherein when the last active element solid solution degree acquired during the engine start time period is larger than or equal to the last active element solid solution degree acquired during the normal operation time period immediately before the engine start time period, the last active element solid solution degree acquired during the engine start time period is employed as the active element solid solution degree at the engine start time period having elapsed, and on the other hand, when the last active element solid solution degree acquired during the engine start time period is smaller than the last active element solid solution degree acquired during the normal operation time period immediately before the engine start time period, the last active element solid solution degree acquired during the normal operation time period immediately before the engine start time period is employed as the active element solid solution degree at the engine start time period having elapsed.

8. The device of the engine of claim 3, wherein a parameter is prepared, the parameter being increased gradually while the temperature of the catalyst is higher than or equal to the predetermined solid solution temperature and the air-fuel ratio of the exhaust gas flowing into the catalyst is leaner than the stoichiometric air-fuel ratio during the operation of the engine and on the other hand, the parameter being decreased gradually while the temperature of the catalyst is higher than or equal to the predetermined precipitation temperature and the air-fuel ratio of the exhaust gas flowing into the catalyst is richer than the stoichiometric air-fuel ratio during the operation of the engine, and the calculation of the active element solid solution degree on the basis of the temperature of the catalyst and the air-fuel ratio of the exhaust gas flowing into the catalyst is performed by calculating the active element solid solution degree on the basis of the parameter.

9. The device of the engine of claim 4, wherein the calculation of the active element solid solution degree on the basis of the temperature of the catalyst is performed by calculating the active element solid solution degree on the basis of a base catalyst temperature which is the temperature of the catalyst when the active element solid solution degree is a predetermined solid solution degree and the temperature of the catalyst during the operation of the engine.

10. The device of the engine of claim 9, wherein the calculation of the active element solid solution degree on the basis of the base catalyst temperature and the temperature of the catalyst during the operation of the engine is performed by calculating the active element solid solution degree on the basis of a catalyst temperature difference which is a difference between the base catalyst temperature and the temperature of the catalyst during the operation of the engine.

11. The device of the engine of claim 4, wherein the calculation of the active element solid solution degree on the basis of the temperature of the catalyst is performed by calculating the active element solid solution degree on the basis of a catalyst temperature integration value during the engine operation, which value being an integration value of the temperature of the catalyst in a predetermined time period during the operation of the engine.

12. The device of the engine of claim 11, wherein the calculation of the active element solid solution degree on the basis of the catalyst temperature integration value during the engine operation is performed by calculating the active element solid solution degree on the basis of a base catalyst temperature integration value which is an integration value of the temperature of the catalyst in the predetermined time period when the active element solid solution degree is a predetermined solid solution degree and the catalyst temperature integration value during the engine operation.

13. The device of the engine of claim 12, wherein the calculation of the active element solid solution degree on the basis of the base catalyst temperature integration value and the catalyst temperature integration value during the engine operation is performed by calculating the active element solid solution degree on the basis of a catalyst temperature integration value difference which is a difference between the base catalyst temperature integration value and the catalyst temperature integration value during the engine operation.

14. The device of the engine of claim 5, wherein the calculation of the active element solid solution degree on the basis of the output value trace length during the engine operation is performed by calculating the active element solid solution degree on the basis of a base output value trace length which is a length of the trace of the output value of the air-fuel ratio output means in the predetermined time period when the active element solid solution degree is a predetermined solid solution degree and the output value trace length during the engine operation.

15. The device of the engine of claim 14, wherein the calculation of the active element solid solution degree on the basis of the base output value trace length and the output value trace length during the engine operation is performed by calculating the active element solid solution degree on the basis of an output value trace length difference which is a difference between the base output value trace length and the output value trace length during the engine operation.

16. The device of the engine of claim 6, wherein in the case that the active element solid solution degree is calculated on the basis of the positive direction inversion number during the engine operation, the calculation of the active element solid solution degree on the basis of the positive direction inversion number during the engine operation is performed by calculating the active element solid solution degree on the basis of a base positive direction inversion number which is the number of the inversion of the change rate of the output value of the air-fuel ratio output means from the negative value to the positive value in the predetermined time period when the active element solid solution degree is a predetermined solid solution degree and the positive direction inversion number during the engine operation, in the case that the active element solid solution degree is calculated on the basis of the negative direction inversion number during the engine operation, the calculation of the active element solid solution degree on the basis of the negative direction inversion number during the engine operation is performed by calculating the active element solid solution degree on the basis of a base negative direction inversion number which is the number of the inversion of the change rate of the output value of the air-fuel ratio output means from the positive value to the negative value in the predetermined time period when the active element solid solution degree is a predetermined solid solution degree and the negative direction inversion number during the engine operation, and in the case that the active element solid solution degree is calculated on the basis of the total inversion number during the engine operation, the calculation of the active element solid solution degree on the basis of the total inversion number during the engine operation is performed by calculating the active element solid solution degree on the basis of the base total inversion number which is the total number of the base positive and negative direction inversion numbers and the total inversion number during the engine operation.

17. The device of the engine of claim 16, wherein in the case that the active element solid solution degree is calculated on the basis of the base positive direction inversion number and the positive direction inversion number during the engine operation, the calculation of the active element solid solution degree on the basis of the base positive direction inversion number and the positive direction inversion number during the engine operation is performed by calculating the active element solid solution degree on the basis of a positive direction inversion number difference which is a difference between the base positive direction inversion number and the positive direction inversion number during the engine operation, in the case that the active element solid solution degree is calculated on the basis of the base negative direction inversion number and the negative direction inversion number during the engine operation, the calculation of the active element solid solution degree on the basis of the base negative direction inversion number and the negative direction inversion number during the engine operation is performed by calculating the active element solid solution degree on the basis of a negative direction inversion number difference which is a difference between the base negative direction inversion number and the negative direction inversion number during the engine operation, and in the case that the active element solid solution degree is calculated on the basis of the base total inversion number and the total inversion number during the engine operation, the calculation of the active element solid solution degree on the basis of the base total inversion number and the total inversion number during the engine operation is performed by calculating the active element solid solution degree on the basis of a total inversion number difference which is a difference between the base total inversion number and the total inversion number during the engine operation.

* * * * *